US011678721B2

(12) United States Patent
Dua et al.

(10) Patent No.: US 11,678,721 B2
(45) Date of Patent: Jun. 20, 2023

(54) POLYOLEFIN-BASED SYNTHETIC LEATHER AND ARTICLES FORMED THEREFROM

(71) Applicant: NIKE, Inc., Beaverton, OR (US)

(72) Inventors: Bhupesh Dua, Portland, OR (US); Isaac Farr, Beaverton, OR (US); Devon Frazier, Beaverton, OR (US); Jeremy D. Walker, Portland, OR (US); Zachary C. Wright, Beaverton, OR (US)

(73) Assignee: NIKE, INC., Beaverton, OR (US)

( * ) Notice: Subject to any disclaimer, the term of this patent is extended or adjusted under 35 U.S.C. 154(b) by 355 days.

(21) Appl. No.: 16/934,936

(22) Filed: Jul. 21, 2020

(65) Prior Publication Data

US 2021/0022445 A1 Jan. 28, 2021

Related U.S. Application Data

(60) Provisional application No. 62/945,509, filed on Dec. 9, 2019, provisional application No. 62/939,809, filed (Continued)

(51) Int. Cl.
*A43B 23/02* (2006.01)
*D06N 3/04* (2006.01)

(Continued)

(52) U.S. Cl.
CPC ..... *A43B 23/0215* (2013.01); *A43B 1/14* (2013.01); *A43B 5/02* (2013.01); *A43B 9/12* (2013.01);

(Continued)

(58) Field of Classification Search
CPC ..... A43B 23/0215; A43B 23/0235; A43B 23/0205; A43B 1/14
See application file for complete search history.

(56) References Cited

U.S. PATENT DOCUMENTS 2,700,625 A 1/1955 Morris
2,732,324 A 1/1956 Morris (Continued)

FOREIGN PATENT DOCUMENTS

EP 1149693 A2 10/2001
EP 2505600 A1 10/2012

(Continued)

OTHER PUBLICATIONS

International Search Report and Written Opinion for PCT/US2020/042862, dated Nov. 3, 2020.

(Continued)

*Primary Examiner* — Marie D Bays
(74) *Attorney, Agent, or Firm* — Thomas | Horstemeyer, LLP

(57) ABSTRACT

A variety of plates for footwear are provided including a polyolefin resin. Sole structures and articles of footwear formed therefrom are also provided. Methods of making the polyolefin resin compositions, plates, sole structures, and articles of footwear are also provided. In some aspects, the polyolefin resin composition includes an effective amount of a polymeric resin modifier. The effective amount can be an amount effective to allow the resin composition to pass a flex test, and in particular to pass a flex test without significant change in abrasion loss. In some aspects, the resin composition also includes a clarifying agent to improve optical clarity of the plate. In some aspects, the plates include a textile disposed on one or both of a first side and the second side of the plate. The textile can provide for improved bonding of the plate to other components such as a chassis or an upper.

18 Claims, 14 Drawing Sheets

Related U.S. Application Data on Nov. 25, 2019, provisional application No. 62/878,239, filed on Jul. 24, 2019.

(51) Int. Cl.

| | |
|---|---|
| ***A43B 1/14*** | (2006.01) |
| ***A43B 9/12*** | (2006.01) |
| ***A43B 5/02*** | (2006.01) |
| ***D06N 3/00*** | (2006.01) |
| *A43C 15/16* | (2006.01) |

(52) U.S. Cl.

CPC ..... *A43B 23/025* (2013.01); *D06N 3/0038* (2013.01); *D06N 3/045* (2013.01); *A43C 15/16* (2013.01); *D06N 2201/0254* (2013.01); *D06N 2203/042* (2013.01); *D06N 2211/106* (2013.01)

(56) References Cited

U.S. PATENT DOCUMENTS

| | | | | |
|---|---|---|---|---|
| 3,851,411 | A | 12/1974 | Crosbie et al. | |
| 5,820,719 | A | 10/1998 | Strickland et al. | |
| 10,161,080 | B2 | 12/2018 | Jarre et al. | |
| 2008/0229612 | A1 | 9/2008 | Sommer et al. | |
| 2010/0083534 | A1 | 4/2010 | Howlett | |
| 2010/0199520 | A1* | 8/2010 | Dua | A43B 23/0265 264/293 |
| 2011/0283562 | A1 | 11/2011 | Shrum et al. | |
| 2016/0053434 | A1* | 2/2016 | Feng | B32B 5/00 442/364 |
| 2016/0058107 | A1 | 3/2016 | Walker et al. | |
| 2017/0251751 | A1 | 9/2017 | Baghdadi et al. | |
| 2017/0251752 | A1 | 9/2017 | Baghdadi et al. | |
| 2017/0313882 | A1* | 11/2017 | Boucard | C08L 23/14 |
| 2018/0160767 | A1 | 6/2018 | Gopalan et al. | |
| 2019/0039342 | A1 | 2/2019 | Dyer | |
| 2019/0106551 | A1 | 4/2019 | Fischer et al. | |
| 2019/0225784 | A1 | 7/2019 | Farr et al. | |
| 2019/0335852 | A1 | 11/2019 | Constantinou et al. | |
| 2019/0343220 | A1* | 11/2019 | Farr | B32B 27/32 |
| 2019/0343221 | A1 | 11/2019 | Farr et al. | |
| 2021/0046731 | A1* | 2/2021 | Nishikawa | B32B 21/047 |
| 2021/0227936 | A1* | 7/2021 | Nagata | A43B 9/00 |

FOREIGN PATENT DOCUMENTS

| | | | |
|---|---|---|---|
| EP | 3078290 | A1 | 10/2016 |
| EP | 3327054 | A1 | 5/2018 |
| WO | 2008079784 | A2 | 7/2008 |
| WO | 2010008371 | A1 | 1/2010 |
| WO | 2011008336 | A1 | 1/2011 |
| WO | 2018144120 | A1 | 8/2018 |
| WO | 2019147858 | A2 | 8/2019 |

OTHER PUBLICATIONS

International Search Report and Written Opinion for PCT/US2021/041212, dated Oct. 29, 2021.

International Preliminary Report on Patentability for PCT/US2020/042862, dated Jan. 25, 2022.

International Preliminary Report on Patentability for PCT/US2021/041212, dated Jan. 26, 2023.

* cited by examiner

POLYOLEFIN-BASED SYNTHETIC LEATHER AND ARTICLES FORMED THEREFROM

CROSS-REFERENCE TO RELATED APPLICATIONS

This application claims the benefit of and priority to U.S. Provisional Application Ser. No. 62/878,239, having the title "SYNTHETIC LEATHER HAVING POLYOLEFIN AND ARTICLES OF FOOTWEAR FORMED THEREFROM", filed on Jul. 24, 2019, and to U.S. Provisional Application Ser. No. 62/939,809, having the title "SYNTHETIC LEATHER HAVING POLYOLEFIN AND ARTICLES OF FOOTWEAR FORMED THEREFROM", filed on Nov. 25, 2019, and to U.S. Provisional Application Ser. No. 62/945,509, having the title "SYNTHETIC LEATHER HAVING POLYOLEFIN AND ARTICLES OF FOOTWEAR FORMED THEREFROM", filed on Dec. 9, 2019, the disclosures of which are incorporated herein by reference in their respective entireties.

TECHNICAL FIELD

The present disclosure generally relates to sole structures and plates including polyolefin resins and articles of footwear including said sole structures.

BACKGROUND

The design and manufacture of footwear and sporting equipment involves a variety of factors from the aesthetic aspects, to the comfort and feel, to the performance and durability. While design and fashion may be rapidly changing, the demand for increasing performance in the footwear and sporting equipment market is unchanging. In addition, the market has shifted to demand lower-cost and recyclable materials still capable of meeting increasing performance demands. To balance these demands, designers of footwear and sporting equipment employ a variety of materials and designs for the various components.

BRIEF DESCRIPTION OF THE DRAWINGS

Further aspects of the present disclosure will be readily appreciated upon review of the detailed description, described below, when taken in conjunction with the accompanying drawings.

FIG. 1A is a lateral side perspective view of the exemplary article of athletic footwear. FIG. 1B is a lateral side elevational view of the exemplary article of athletic footwear. FIG. 1C is a medial side elevational view of the exemplary article of athletic footwear. FIG. 1D is a top view of the exemplary article of athletic footwear. FIG. 1E is a front view of the exemplary article of athletic footwear. FIG. 1F is a rear view of the exemplary article of athletic footwear. FIG. 1G is an exploded perspective view of the exemplary article of athletic footwear. FIG. 1H is a sectional view along 1-1 of the exemplary article of athletic footwear.

FIG. 2A is a lateral side elevational view of the exemplary article of athletic footwear. FIG. 2B is an exploded perspective view of the second exemplary article of athletic footwear. FIG. 2C is a sectional view along 2-2 of the second exemplary article of athletic footwear.

FIG. 4A is a lateral side elevational view of the exemplary article of athletic footwear. FIG. 4B is an exploded perspective view of the second exemplary article of athletic footwear. FIG. 4C is a sectional view along 4-4 of the second exemplary article of athletic footwear.

FIG. 5A is a lateral side elevational view of the fifth exemplary article of athletic footwear. FIG. 5B is an exploded perspective view of the fifth exemplary article of athletic footwear.

FIG. 6A is a cross-sectional view of a disclosed synthetic leather material 600 comprising a synthetic leather textile layer 610, to which is affixed a synthetic leather polymeric coating layer 620. FIG. 6B is a cross-sectional view of a disclosed synthetic leather material 600 comprising a synthetic leather textile layer 610, to which is affixed a synthetic leather polymeric coating layer 620, and further comprising a synthetic leather protective or decorative layer 630 affixed to the synthetic leather polymeric coating layer 620.

FIG. 7A is a cross-sectional view of a disclosed synthetic leather material 700 comprising a synthetic leather textile layer 710, to which is affixed a first synthetic leather polymeric coating layer 720 and a second synthetic leather polymeric coating composition 730 affixed to the first synthetic leather polymeric coating layer 720. FIG. 7B is a cross-sectional view of a disclosed synthetic leather material 700 comprising a synthetic leather textile layer 710, to which is affixed a first synthetic leather polymeric coating layer 720 and a second synthetic leather polymeric coating composition 730 affixed to the first synthetic leather polymeric coating layer 720, and further comprising a synthetic leather protective or decorative layer 740 affixed to the second synthetic leather polymeric coating layer 730.

DETAILED DESCRIPTION

Figure 1A:
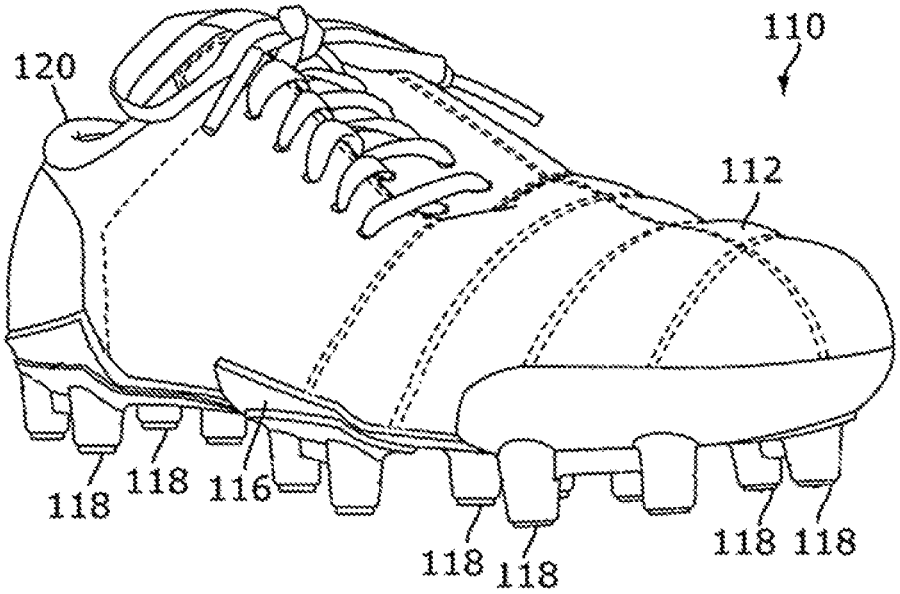
FIGS. 1A-1H depict an exemplary article of athletic footwear.

State of the art specialty polymers for footwear and sporting equipment include polymers such as polyurethane and polyamide polymers, but there remains a need for lower-cost alternatives to these performance polymers, especially lower-cost alternatives that are recyclable and readily processable. Alternatives such as polyolefins, while cost-effective, have traditionally suffered from poor mechanical properties and poor surfaces and surface energies for bonding. New designs and materials are needed. In particular, there remains a need for improved polymer resins for making components of footwear and sporting equipment that are resistant to stress whitening or cracking when flexed under cold conditions, resistant to abrasion, and that are capable of adequate bonding for footwear and other athletic equipment applications.

In various aspects, this disclosure provides sole structures including a plate containing a polyolefin resin. In some aspects, the sole structures include the plate and a textile on one or more surfaces of the plate. The textile can improve the bonding of other components (e.g. an upper or a chassis) to the plate. The textile can also be used for decorative purposes. Plates having the polyolefin resin compositions can have improved mechanical properties making them particularly suitable for use in components for footwear and sporting equipment. Specifically, these resin compositions are both resistant to stress whitening or cracking when flexed under cold conditions and resistant to abrasion to the levels needed for use in footwear and sporting equipment. The present disclosure provides a variety of plates for articles of footwear which include these polyolefin resin compositions.

In some aspects, this disclosure provides a sole structure for an article of footwear, the sole structure having a plate containing a polyolefin resin, the plate having a first side and a second side, wherein the first side is configured to be ground-facing when the plate is a component of an article of footwear; and a textile disposed on one or both of the first side and the second side. In some aspects, the sole structure further includes a chassis configured to be on the first side of the plate. The chassis can wrap around the plate and engage or be attached to an upper when the sole structure is a component of an article of footwear, for example the chassis can attach to the upper at the bite line. In some aspects, the sole structures do not include a textile, e.g. the sole structure can include the plate and a chassis as described above and detailed more fully below.

In various aspects, this disclosure also provides articles of footwear including a sole structure described herein.

The present disclosure will be better understood upon reading the following numbered aspects, which should not be confused with the claims. Any of the numbered aspects below can, in some instances, be combined with aspects described elsewhere in this disclosure and such combinations are intended to form part of the disclosure.

Aspect 1. A synthetic leather material comprising: a synthetic leather polymeric coating layer affixed to a synthetic leather textile layer; wherein the synthetic leather polymeric coating layer comprises a synthetic leather polymeric coating composition; and wherein the synthetic leather textile layer comprises a fiber or a yarn comprising a fiber/yarn polymeric composition, and wherein the synthetic leather polymeric coating composition comprises a polyolefin resin composition, or the fiber/yarn polymeric composition comprises the polyolefin resin composition, or both the synthetic leather polymeric coating composition and the fiber/yarn polymeric composition comprises the polyolefin resin composition.

Aspect 2. The synthetic leather material according to Aspect 1, wherein the fiber/yarn polymeric composition comprises or consist essentially of the polyolefin resin composition.

Aspect 3. The synthetic leather material according to Aspect 2, wherein the synthetic leather polymeric coating composition is substantially free of the polyolefin resin composition.

Aspect 4. The synthetic leather material according to Aspect 3, wherein the synthetic leather polymeric coating composition comprises one or more thermoplastic polymers chosen from polyesters, polyethers, polyamides, or polyurethanes.

Aspect 5. The synthetic leather material according to Aspect 3 or Aspect 4, wherein the synthetic leather polymeric coating composition has a melting or softening temperature that is at least 20 degrees centigrade lower, or at least 50 degrees centigrade lower centigrade lower than the melting or softening temperature of the fiber/yarn polymeric composition; or wherein the synthetic leather polymeric coating composition has a melting or softening temperature that is at least 20 degrees centigrade higher, or at least 50 degrees centigrade higher centigrade lower than the melting or softening temperature of the fiber/yarn polymeric composition.

Aspect 6. The synthetic leather material according to Aspect 1, wherein the synthetic leather textile layer comprises: a first fiber or a first yarn comprising a first fiber/yarn polymeric composition comprising or consisting essentially of the polyolefin resin composition; and a second fiber or a second yarn comprising a second fiber/yarn polymeric composition comprising one or more thermoplastic polymers chosen from polyesters, polyethers, polyamides, or polyurethanes.

Aspect 7. The synthetic leather material according to Aspect 6, wherein the second fiber/yarn polymeric composition has a melting or softening temperature that is at least 20 degrees centigrade lower, or at least 50 degrees centigrade lower than the melting or softening temperature of the first fiber/yarn polymeric composition; or wherein the first fiber/yarn polymeric composition has a melting or softening temperature that is at least 20 degrees centigrade lower, or at least 50 degrees centigrade lower than the melting or softening temperature of the second fiber/yarn polymeric composition.

Aspect 8. The synthetic leather material according to Aspect 6, wherein the one or more thermoplastic polymers of the second fiber or second yarn have a melting or softening temperature that is at least 20 degrees centigrade lower, or at least 50 degrees centigrade lower than the melting or softening temperature of the polyolefin resin composition of the first fiber or first yarn; or wherein the one or more thermoplastic polymers of the second fiber or second yarn have a melting or softening temperature that is at least 20 degrees centigrade higher, or at least 50 degrees centigrade higher than the melting or softening temperature of the polyolefin resin composition of the first fiber or first yarn.

Aspect 9. The synthetic leather material of any one of Aspect 6 to Aspect 8, wherein the synthetic leather polymeric coating composition is substantially free of polyolefins.

Aspect 10. The synthetic leather material according to Aspect 9, wherein the synthetic leather polymeric coating composition comprises one or more thermoplastic polymers chosen from polyesters, polyethers, polyamides, or polyurethanes.

Aspect 11. The synthetic leather material according to Aspect 10, wherein the synthetic leather polymeric coating composition has melting or softening temperature that is at least 20 degrees centigrade lower, or at least 50 degrees centigrade lower than the melting or softening temperature of the first fiber/yarn polymeric composition; or wherein the synthetic leather polymeric coating composition has melting or softening temperature that is at least 20 degrees centigrade higher, or at least 50 degrees centigrade higher than the melting or softening temperature of the first fiber/yarn polymeric composition.

Aspect 12. The synthetic leather material according to Aspect 10, wherein the one or more thermoplastic polymers of the synthetic leather polymeric coating layer have a melting or softening temperature that is at least 20 degrees centigrade lower, or at least 50 degrees centigrade lower than the melting or softening temperature of the polyolefin resin composition of the first fiber or first yarn; or wherein the one or more thermoplastic polymers of the synthetic leather polymeric coating layer have a melting or softening temperature that is at least 20 degrees centigrade higher, or at least 50 degrees centigrade higher than the melting or softening temperature of the polyolefin resin composition of the first fiber or first yarn.

Aspect 13. The synthetic leather material according to Aspect 1, wherein the fiber/yarn polymeric composition is substantially free of polyolefins; and wherein the fiber/yarn polymeric composition comprises one or more thermoplastic polymers.

Aspect 14. The synthetic leather material according to Aspect 13, wherein the fiber/yarn polymeric composition has a melting or softening temperature that is at least 20 degrees centigrade lower, or at least 50 degrees centigrade lower than the melting or softening temperature of the synthetic leather polymeric coating composition; or wherein the fiber/yarn polymeric composition has a melting or softening temperature that is at least 20 degrees centigrade higher, or at least 50 degrees centigrade higher than the melting or softening temperature of the synthetic leather polymeric coating composition.

Aspect 15. The synthetic leather material according to Aspect 13 or Aspect 14, wherein the synthetic leather polymeric coating composition comprises or consists essentially of the polyolefin resin composition.

Aspect 16. The synthetic leather material according to Aspect 15, wherein the one or more thermoplastic polymers of the fiber/yarn composition have a melting or softening temperature that at least 20 degrees centigrade lower, or at least 50 degrees centigrade lower than the melting or softening temperature of the polyolefin resin composition; or wherein the one or more thermoplastic polymers of the fiber/yarn composition have a melting or softening temperature that at least 20 degrees centigrade higher, or at least 50 degrees centigrade higher than the melting or softening temperature of the polyolefin resin composition.

Aspect 17. The synthetic leather material according to Aspect 2, Aspect 6, or Aspect 13, wherein the synthetic leather polymeric coating composition comprises the polyolefin resin composition.

Aspect 18. The synthetic leather material according to any one of Aspect 1 to Aspect 17, wherein the one or more thermoplastic polymers is chosen from polyesters, polyethers, polyamides, or polyurethanes.

Aspect 19. The synthetic leather material according to Aspect 18, wherein the one or more thermoplastic polymers comprises one or more polyester.

Aspect 20. The synthetic leather material according to Aspect 18 or Aspect 19, wherein the polyester comprises polyethylene terephthalate (PET).

Aspect 21. The synthetic leather material according to Aspect 18, wherein one or more thermoplastic polymers comprises one or more polyamide.

Aspect 22. The synthetic leather material according to Aspect 18 or Aspect 21, wherein the polyamide comprises nylon 6,6, nylon 6, nylon 12, and combinations thereof.

Aspect 23. The synthetic leather material according to Aspect 18, wherein one or more thermoplastic polymers comprise one or more polyurethane.

Aspect 24. The synthetic leather material according to any one of Aspect 18 to Aspect 23, wherein the one or more thermoplastic polymers comprise one or more thermoplastic copolymers.

Aspect 25. The synthetic leather material according to Aspect 24, wherein the one or more thermoplastic copolymers comprises thermoplastic copolymers selected from the group consisting of thermoplastic co-polyesters, thermoplastic co-polyethers, thermoplastic co-polyamides, thermoplastic co-polyurethanes, and combinations thereof.

Aspect 26. The synthetic leather material according to Aspect 24, wherein the one or more thermoplastic copolymers comprise thermoplastic co-polyesters.

Aspect 27. The synthetic leather material according to Aspect 24, wherein the one or more thermoplastic copolymers comprise thermoplastic co-polyethers.

Aspect 28. The synthetic leather material according to Aspect 24, wherein the one or more thermoplastic copolymers comprise thermoplastic co-amides.

Aspect 29. The synthetic leather material according to Aspect 24, wherein the one or more thermoplastic copolymers comprise thermoplastic co-polyurethanes.

Aspect 30. The synthetic leather material according to any one of Aspect 18 to Aspect 29, wherein the one or more thermoplastic polymers comprise one or more thermoplastic polyether block amide (PEBA) copolymers.

Aspect 31. The synthetic leather material of according to any one of Aspect 18 to Aspect 30, wherein the one or more thermoplastic polymers have a melting or softening temperature that is at least 20 degrees centigrade lower, or at least 50 degrees centigrade lower than the melting or softening temperature of the polyolefin resin composition; or wherein the one or more thermoplastic polymers have a melting or softening temperature that is at least 20 degrees centigrade higher, or at least 50 degrees centigrade higher than the melting or softening temperature of the polyolefin resin composition.

Aspect 32. The synthetic leather material according to any one of Aspect 18 to Aspect 30, wherein a fiber/yarn polymeric composition comprising one or more thermoplastic polymers has a melting or softening temperature that is at least 20 degrees centigrade lower, or at least 50 degrees centigrade lower than a melting or softening temperature of a synthetic leather polymeric coating composition; or wherein a fiber/yarn polymeric composition comprising one or more thermoplastic polymers has a melting or softening temperature that is at least 20 degrees centigrade higher, or at least 50 degrees centigrade higher than a melting or softening temperature of a synthetic leather polymeric coating composition.

Aspect 33. The synthetic leather material according to any one of Aspect 18 to Aspect 30, wherein a fiber/yarn polymeric composition comprising one or more thermoplastic polymers has a melting or softening temperature that is at least 20 degrees centigrade lower, or at least 50 degrees centigrade lower than a melting or softening temperature of a synthetic leather polymeric coating composition comprising the polyolefin resin composition; or wherein a fiber/yarn polymeric composition comprising one or more thermoplastic polymers has a melting or softening temperature that is at least 20 degrees centigrade higher, or at least 50 degrees centigrade higher than a melting or softening temperature of a synthetic leather polymeric coating composition comprising the polyolefin resin composition.

Aspect 34. The synthetic leather material according to any one of Aspect 18 to Aspect 30, wherein a second fiber/yarn polymeric composition comprising one or more thermoplastic polymers has a melting or softening temperature that is at least 20 degrees centigrade lower, or at least 50 degrees centigrade lower than a first fiber/yarn polymeric composition; or wherein a second fiber/yarn polymeric composition comprising one or more thermoplastic polymers has a melting or softening temperature that is at least 20 degrees centigrade higher, or at least 50 degrees centigrade higher than a first fiber/yarn polymeric composition.

Aspect 35. The synthetic leather material according to any one of Aspect 18 to Aspect 30, wherein a second fiber/yarn polymeric composition comprising one or more thermoplastic polymers has a melting or softening temperature that is at least 20 degrees centigrade lower, or at least 50 degrees centigrade lower than a first fiber/yarn polymeric composition comprising the polyolefin resin composition; or wherein a second fiber/yarn polymeric composition comprising one or more thermoplastic polymers has a melting or softening temperature that is at least 20 degrees centigrade higher, or at least 50 degrees centigrade higher than a first fiber/yarn polymeric composition comprising the polyolefin resin composition.

Aspect 36. The synthetic leather material according to any one of Aspect 18 to Aspect 30, wherein a second fiber/yarn polymeric composition comprising one or more thermoplastic polymers has a melting or softening temperature that is at least 20 degrees centigrade lower, or at least 50 degrees centigrade lower than a melting or softening temperature of a synthetic leather polymeric coating composition; or wherein a second fiber/yarn polymeric composition comprising one or more thermoplastic polymers has a melting or softening temperature that is at least 20 degrees centigrade higher, or at least 50 degrees centigrade higher than a melting or softening temperature of a synthetic leather polymeric coating composition.

Aspect 37. The synthetic leather material according to any one of Aspect 18 to Aspect 30, wherein a second fiber/yarn polymeric composition comprising one or more thermoplastic polymers has a melting or softening temperature that is at least 20 degrees centigrade lower, or at least 50 degrees centigrade lower than a melting or softening temperature of a synthetic leather polymeric coating composition comprising the polyolefin resin composition; or wherein a second fiber/yarn polymeric composition comprising one or more thermoplastic polymers has a melting or softening temperature that is at least 20 degrees centigrade higher, or at least 50 degrees centigrade higher than a melting or softening temperature of a synthetic leather polymeric coating composition comprising the polyolefin resin composition.

Aspect 38. The synthetic leather material according to Aspect 1, wherein the synthetic leather polymeric coating layer comprises a plurality of synthetic leather polymeric coating layers, optionally wherein at least one of the plurality of synthetic leather polymeric coating layers comprise the polyolefin resin composition.

Aspect 39. The synthetic leather material according to Aspect 38, wherein the synthetic leather polymeric coating layer comprises a first synthetic leather polymeric coating layer and a second synthetic leather polymeric coating layer, wherein the first synthetic leather polymeric coating layer is affixed to the synthetic leather textile layer, and the second synthetic leather polymeric coating layer is affixed to the first synthetic leather polymeric coating layer.

Aspect 40. The synthetic leather material according to Aspect 39, wherein the synthetic leather polymeric coating composition of the first synthetic leather polymeric coating layer is substantially free of polyolefins, and the synthetic leather polymeric coating composition of the second synthetic leather polymeric coating layer comprises the polyolefin resin composition.

Aspect 41. The synthetic leather material according to Aspect 40, wherein the synthetic leather polymeric coating composition of the first synthetic leather polymeric coating layer comprises one or more polymers chosen from polyesters, polyethers, polyamides, or polyurethanes, optionally wherein the one or more polymers include one or more thermoplastic polymers.

Aspect 42. The synthetic leather material according to Aspect 40 or Aspect 41, wherein the synthetic leather polymeric coating composition of the first synthetic leather polymeric coating layer has a melting or softening temperature that is at least 20 degrees centigrade lower, or at least 50 degrees centigrade lower than the melting or softening temperature of the fiber/yarn polymeric composition; or wherein the synthetic leather polymeric coating composition of the first synthetic leather polymeric coating layer has a melting or softening temperature that is at least 20 degrees centigrade higher, or at least 50 degrees centigrade higher than the melting or softening temperature of the fiber/yarn polymeric composition.

Aspect 43. The synthetic leather material according to any one of Aspect 38 to Aspect 42, wherein the synthetic leather polymeric coating composition of the second synthetic leather polymeric coating layer has a melting or softening temperature that is at least 20 degrees centigrade lower, or at least 50 degrees centigrade lower than the melting or softening temperature of the fiber/yarn polymeric composition; or wherein the synthetic leather polymeric coating composition of the second synthetic leather polymeric coating layer has a melting or softening temperature that is at least 20 degrees centigrade higher, or at least 50 degrees centigrade higher than the melting or softening temperature of the fiber/yarn polymeric composition.

Aspect 44. The synthetic leather material according to Aspect 38, wherein the first synthetic leather polymeric coating composition comprises or consists essentially of the polyolefin resin composition and the second synthetic leather polymeric coating composition is substantially free of polyolefins.

Aspect 45. The synthetic leather material according to Aspect 44, wherein the second synthetic leather polymeric coating composition comprises one or more thermoplastic polymers chosen from polyesters, polyethers, polyamides, or polyurethanes.

Aspect 46. The synthetic leather material according to Aspect 44 or Aspect 45, wherein the first synthetic leather polymeric coating composition has a melting or softening temperature that is at least 20 degrees centigrade lower, or at least 50 degrees centigrade lower than the melting or softening temperature of the fiber/yarn polymeric composition; or wherein the first synthetic leather polymeric coating composition has a melting or softening temperature that is at least 20 degrees centigrade higher, or at least 50 degrees centigrade higher than the melting or softening temperature of the fiber/yarn polymeric composition.

Aspect 47. The synthetic leather material according to any one of Aspect 44 to Aspect 46, wherein the second synthetic leather polymeric coating composition has a melting or softening temperature that is at least 20 degrees centigrade lower, or at least 50 degrees centigrade lower than the melting or softening temperature of the fiber/yarn polymeric composition; or wherein the second synthetic leather polymeric coating composition has a melting or softening temperature that is at least 20 degrees centigrade higher, or at least 50 degrees centigrade higher than the melting or softening temperature of the fiber/yarn polymeric composition.

Aspect 48. The synthetic leather material according to Aspect 38, wherein the first synthetic leather polymeric coating composition comprises a first polyolefin resin composition and the second synthetic leather polymeric coating composition comprises a second polyolefin resin composition.

Aspect 49. The synthetic leather material according to Aspect 48, wherein the first synthetic leather polymeric coating composition and the second synthetic leather polymeric coating composition are substantially the same polyolefin resin composition.

Aspect 50. The synthetic leather material according to Aspect 48, wherein the first synthetic leather polymeric coating composition and the second synthetic leather polymeric coating composition comprise one or more different polyolefins, or comprise different concentrations of the same polyolefins.

Aspect 51. The synthetic leather material according to any one of Aspect 38 to Aspect 50, wherein the one or more thermoplastic polymers comprises one or more polyester.

Aspect 52. The synthetic leather material according to Aspect 51, wherein the polyester comprises polyethylene terephthalate (PET).

Aspect 53. The synthetic leather material according to any one of Aspect 38 to Aspect 50, wherein one or more thermoplastic polymers comprises one or more polyamide.

Aspect 54. The synthetic leather material according to Aspect 53, wherein the polyamide comprises nylon 6,6, nylon 6, nylon 11, nylon 12, and combinations thereof.

Aspect 55. The synthetic leather material according to any one of Aspect 38 to Aspect 50, wherein the one or more thermoplastic polymers comprises one or more polyurethane.

Aspect 56. The synthetic leather material according to any one of Aspect 38 to Aspect 50, wherein the one or more thermoplastic polymers comprises one or more thermoplastic copolymers.

Aspect 57. The synthetic leather material according to Aspect 56, wherein the one or more thermoplastic copolymers comprises thermoplastic copolymers chosen from thermoplastic co-polyesters, thermoplastic co-polyethers, thermoplastic co-polyamides, thermoplastic co-polyurethanes, or combinations thereof.

Aspect 58. The synthetic leather material according to Aspect 56, wherein the one or more thermoplastic copolymers comprise thermoplastic co-polyesters.

Aspect 59. The synthetic leather material according to Aspect 56, wherein the one or more thermoplastic copolymers comprise thermoplastic co-polyethers.

Aspect 60. The synthetic leather material according to Aspect 56, wherein the one or more thermoplastic copolymers comprise thermoplastic co-amides.

Aspect 61. The synthetic leather material according to Aspect 56, wherein the one or more thermoplastic copolymers comprise thermoplastic co-polyurethanes.

Aspect 62. The synthetic leather material according to any one of Aspect 41 to Aspect 61, wherein the one or more thermoplastic polymers comprise one or more thermoplastic polyether block amide (PEBA) copolymers.

Aspect 63. The synthetic leather material according to any one of Aspect 38 to Aspect 62, wherein the fiber/yarn polymeric composition has a melting or softening temperature that is at least 20 degrees centigrade lower, or at least 50 degrees centigrade lower than a melting or softening temperature of a synthetic leather polymeric coating composition; or wherein the fiber/yarn polymeric composition has a melting or softening temperature that is at least 20 degrees centigrade higher, or at least 50 degrees centigrade higher than a melting or softening temperature of a synthetic leather polymeric coating composition.

Aspect 64. The synthetic leather material according to any one of Aspect 38 to Aspect 63, wherein the synthetic leather textile layer comprises: a first fiber or a first yarn comprising a first fiber/yarn polymeric composition comprising the polyolefin resin composition; and a second fiber or a second yarn comprising a second fiber/yarn polymeric composition comprising one or more thermoplastic polymers selected from the group consisting of polyesters, polyethers, polyamides, and polyurethanes.

Aspect 65. The synthetic leather material according to Aspect 64, wherein the second fiber/yarn polymeric composition has a melting or softening temperature that is at least 20 degrees centigrade lower, or at least 50 degrees centigrade lower than the melting or softening temperature of the first fiber/yarn polymeric composition; or wherein the second fiber/yarn polymeric composition has a melting or softening temperature that is at least 20 degrees centigrade higher, or at least 50 degrees centigrade higher than the melting or softening temperature of the first fiber/yarn polymeric composition.

Aspect 66. The synthetic leather material according to Aspect 64, wherein the one or more thermoplastic polymers of the second fiber or second yarn have a melting or softening temperature that is at least 20 degrees centigrade lower, or at least 50 degrees centigrade lower than the melting or softening temperature of the polyolefin resin composition of the first fiber or first yarn; or wherein the one or more thermoplastic polymers of the second fiber or second yarn have a melting or softening temperature that is at least 20 degrees centigrade higher, or at least 50 degrees centigrade higher than the melting or softening temperature of the polyolefin resin composition of the first fiber or first yarn.

Aspect 67. The synthetic leather material according to any one of Aspect 38 to Aspect 66, wherein each synthetic leather polymeric coating layer comprises a film.

Aspect 68. The synthetic leather material according to any one of Aspect 1 to Aspect 66, wherein the synthetic leather textile layer is a knit textile.

Aspect 69. The synthetic leather material according to Aspect 68, wherein the knit textile is a flat knit textile, a circular knit textile, or a weft knit textile.

Aspect 70. The synthetic leather material according to any one of Aspect 1 to Aspect 66, wherein the synthetic leather textile layer is a crocheted textile.

Aspect 71. The synthetic leather material according to any one of Aspect 1 to Aspect 66, wherein the synthetic leather textile layer is a braided textile.

Aspect 72. The synthetic leather material according to any one of Aspect 1 to Aspect 66, wherein the synthetic leather textile layer is a woven textile.

Aspect 73. The synthetic leather material according to any one of Aspect 1 to Aspect 66, wherein the synthetic leather textile layer is a non-woven textile.

Aspect 74. The synthetic leather material according to any one of Aspect 1 to Aspect 73, further comprising a protective or decorative layer affixed to the synthetic leather polymeric coating layer.

Aspect 75. The synthetic leather material according to Aspect 74, wherein the protective or decorative layer is substantially free of polyolefins.

Aspect 76. The synthetic leather material according to Aspect 74, wherein the protective or decorative layer comprises the polyolefin resin composition.

Aspect 77. The synthetic leather material according to Aspect 74, wherein the protective or decorative layer comprises one or more thermoplastic polymers.

Aspect 78. The synthetic leather material according to Aspect 77, wherein the one or more thermoplastic polymers is chosen from a polyester, a polyether, a polyamide, or a polyurethane Aspect 79. The synthetic leather material according to Aspect 78, wherein the one or more thermoplastic polymers comprises one or more polyester.

Aspect 80. The synthetic leather material according to Aspect 78 or Aspect 79, wherein the polyester comprises polyethylene terephthalate (PET).

Aspect 81. The synthetic leather material according to Aspect 78, wherein one or more thermoplastic polymers comprises one or more polyamide.

Aspect 82. The synthetic leather material according to Aspect 78 or Aspect 81, wherein the polyamide comprises nylon 6,6, nylon 6, nylon 12, and combinations thereof.

Aspect 83. The synthetic leather material according to Aspect 77, wherein one or more thermoplastic polymers one or more polyurethane.

Aspect 84. The synthetic leather material according to any one of Aspect 77 to Aspect 83, wherein the one or more thermoplastic polymers comprises one or more thermoplastic copolymers.

Aspect 85. The synthetic leather material according to Aspect 84, wherein the one or more thermoplastic copolymers comprises one or more thermoplastic copolymers chosen from thermoplastic co-polyesters, thermoplastic co-polyethers, thermoplastic co-polyamides, thermoplastic co-polyurethanes, or combinations thereof.

Aspect 86. The synthetic leather material according to Aspect 84, wherein the one or more thermoplastic copolymers comprise thermoplastic co-polyesters.

Aspect 87. The synthetic leather material according to Aspect 84, wherein the one or more thermoplastic copolymers comprise thermoplastic co-polyethers.

Aspect 88. The synthetic leather material according to Aspect 84, wherein the one or more thermoplastic copolymers comprise thermoplastic co-amides.

Aspect 89. The synthetic leather material according to Aspect 84, wherein the one or more thermoplastic copolymers comprise thermoplastic co-polyurethanes.

Aspect 90. The synthetic leather material according to any one of Aspect 77 to Aspect 89, wherein the one or more thermoplastic polymers comprise one or more thermoplastic polyether block amide (PEBA) copolymers.

Aspect 91. The synthetic leather material according to any one of Aspect 77 to Aspect 90, wherein the one or more thermoplastic polymers have a melting or softening temperature that is at least 20 degrees centigrade lower, or at least 50 degrees centigrade lower than the melting or softening temperature of the polyolefin resin composition; or wherein the one or more thermoplastic polymers have a melting or softening temperature that is at least 20 degrees centigrade higher, or at least 50 degrees centigrade higher than the melting or softening temperature of the polyolefin resin composition.

Aspect 92. The synthetic leather material according to any one of Aspect 1 to Aspect 145 wherein the polyolefin resin composition comprises a polyolefin homopolymer or a polyolefin copolymer or both a polyolefin homopolymer and a polyolefin copolymer.

Aspect 93. The synthetic leather material according to Aspect 92, wherein the polyolefin composition comprises the polyolefin homopolymer.

Aspect 94. The synthetic leather material according to Aspect 92, wherein the polyolefin composition comprises the polyolefin copolymer.

Aspect 95. The synthetic leather material according to any one of Aspect 1 to Aspect 145, wherein the polyolefin resin composition comprises an effective amount of a polymeric resin modifier.

Aspect 96. The synthetic leather material according to any one of Aspect 1 to Aspect 145, wherein the polyolefin resin composition has an abrasion loss of about 0.05 cubic centimeters to about 0.1 cubic centimeters or about 0.08 cubic centimeters to about 0.1 cubic centimeters pursuant to the Abrasion Loss Test using the Neat Material Sampling Procedure.

Aspect 97. The synthetic leather material according to any one of Aspect 1 to Aspect 145, wherein the effective amount of the polymeric resin modifier is an amount effective to allow the polyolefin resin composition to pass a flex test pursuant to the Cold Ross Flex Test using the Plaque Sampling Procedure.

Aspect 98. The synthetic leather material according to any one of Aspect 1 to Aspect 145, wherein the effective amount of the polymeric resin modifier is an amount effective to allow the polyolefin resin composition to pass a flex test pursuant to the Cold Ross Flex Test using the Plaque Sampling Procedure without a significant change in an abrasion loss as compared to an abrasion loss of a second polyolefin resin composition identical to the polyolefin resin composition except without the polymeric resin modifier when measured pursuant to the Abrasion Loss Test using the Neat Material Sampling Procedure.

Aspect 99. The synthetic leather material according to any one of Aspect 1 to Aspect 145, wherein the abrasion loss of the polyolefin resin composition is about 0.08 cubic centimeters to about 0.1 cubic centimeters.

Aspect 100. The synthetic leather material according to any one of Aspect 1 to Aspect 145, wherein the polyolefin resin composition comprises a polyolefin copolymer, and the polyolefin copolymer is a random copolymer.

Aspect 101. The synthetic leather material according to any one of Aspect 1 to Aspect 145, wherein the polyolefin resin composition comprises a polyolefin copolymer, and the polyolefin copolymer comprises a plurality of repeat units, with each of the plurality of repeat units individually derived from an alkene monomer having about 1 to about 6 carbon atoms.

Aspect 102. The synthetic leather material according to any one of Aspect 1 to Aspect 145, wherein the polyolefin resin composition comprises a polyolefin copolymer, and the polyolefin copolymer comprises a plurality of repeat units, with each of the plurality of repeat units individually derived from a monomer selected from the group consisting of ethylene, propylene, 4-methyl-1-pentene, 1-butene, and a combination thereof.

Aspect 103. The synthetic leather material according to any one of Aspect 1 to Aspect 145, wherein the polyolefin resin composition comprises a polyolefin copolymer, and the polyolefin copolymer comprises a plurality of repeat units each individually selected from Formula 1A-1D Formula 1A

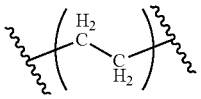

Formula 1B

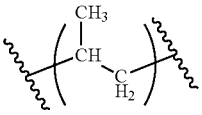

-continued

Formula 1C

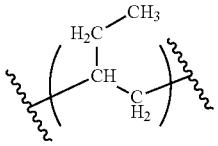

Formula 1D

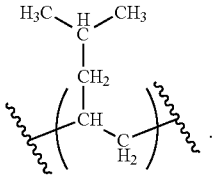

Aspect 104. The synthetic leather material according to any one of Aspect 1 to Aspect 145, wherein the polyolefin resin composition comprises a polyolefin copolymer, and the polyolefin copolymer comprises a plurality of repeat units each individually having a structure according to Formula 2

Formula 2

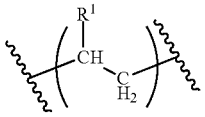

where $R^1$ is a hydrogen or a substituted or unsubstituted, linear or branched, $C_1$-$C_{12}$ alkyl or heteroalkyl.

Aspect 105. The synthetic leather material according to any one of Aspect 1 to Aspect 145, wherein polymers in the polyolefin resin composition consist essentially of polyolefin copolymers, or consist essentially of polyolefin copolymers and a polymeric resin modifier.

Aspect 106. The synthetic leather material according to any one of Aspect 294 to Aspect 358, wherein the polyolefin resin composition comprises a polyolefin copolymer, and the polyolefin copolymer is a random copolymer of a first plurality of repeat units and a second plurality of repeat units, and wherein each repeat unit in the first plurality of repeat units is derived from ethylene and the each repeat unit in the second plurality of repeat units is derived from a second olefin.

Aspect 107. The synthetic leather material according to any one of Aspect 106, wherein the second olefin is selected from the group consisting of propylene, 4-methyl-1-pentene, 1-butene, and other linear or branched terminal alkenes having about 3 to 12 carbon atoms.

Aspect 108. The synthetic leather material according to any one of Aspect 106 or Aspect 107, wherein each of the repeat units in the first plurality of repeat units has a structure according to Formula 1A, and wherein each of the repeat units in the second plurality of repeat units has a structure selected from Formula 1B-1D Formula 1A

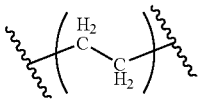

-continued

Formula 1B

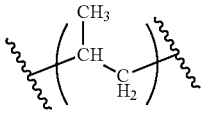

Formula 1C

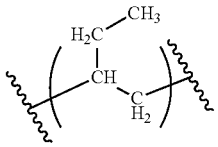

Formula 1D

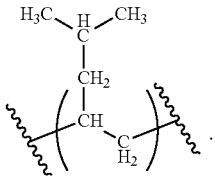

Aspect 109. The synthetic leather material according to any one of Aspect 106 to Aspect 108, wherein each of the repeat units in the first plurality of repeat units has a structure according to Formula 1A, and wherein each of the repeat units in the second plurality of repeat units has a structure according to Formula 2

Formula 1A

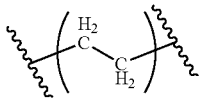

Formula 2

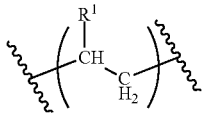

where $R^1$ is a hydrogen or a substituted or unsubstituted, linear or branched, $C_2$-$C_{12}$ alkyl or heteroalkyl.

Aspect 110. The synthetic leather material according to any one of Aspect 1 to Aspect 145, wherein the polyolefin resin composition comprises a polyolefin copolymer, and the polyolefin copolymer comprises about 80 percent to about 99 percent, about 85 percent to about 99 percent, about 90 percent to about 99 percent, or about 95 percent to about 99 percent polyolefin repeat units by weight based upon a total weight of the polyolefin copolymer.

Aspect 111. The synthetic leather material according to any one of Aspect 1 to Aspect 145, wherein the polyolefin resin composition comprises a polyolefin copolymer, and the polyolefin copolymer comprises about 1 percent to about 5 percent, about 1 percent to about 3 percent, about 2 percent to about 3 percent, or about 2 percent to about 5 percent ethylene by weight based upon a total weight of the polyolefin copolymer.

Aspect 112. The synthetic leather material according to any one of Aspect 1 to Aspect 145, wherein the polyolefin resin composition is substantially free of polyurethanes; or the polyolefin resin composition comprises a polyolefin copolymer, and polymer chains of the polyolefin copolymer are substantially free of urethane repeat units; or the polyolefin resin composition is substantially free of polymers with polymer chains including urethane repeat units.

Aspect 113. The synthetic leather material according to any one of Aspect 1 to Aspect 145, wherein the polyolefin resin composition is substantially free of polyamides; or the polyolefin resin composition comprises a polyolefin copolymer, and polymer chains of the polyolefin copolymer are substantially free of amide repeat units; or wherein the polyolefin resin composition is substantially free of polymers with polymer chains including amide repeat units.

Aspect 114. The synthetic leather material according to any one of Aspect 1 to Aspect 145, wherein the polyolefin resin composition comprises a polypropylene copolymer, alone or in combination with an effective amount of a polymeric resin modifier.

Aspect 115. The synthetic leather material according to any one of Aspect 1 to Aspect 145, wherein the polyolefin resin composition has an abrasion loss of a about 0.05 cubic centimeters ($cm^3$) to about 0.1 cubic centimeters ($cm^3$), about 0.07 cubic centimeters ($cm^3$) to about 0.1 cubic centimeters ($cm^3$), about 0.08 cubic centimeters ($cm^3$) to about 0.1 cubic centimeters ($cm^3$), or about 0.08 cubic centimeters ($cm^3$) to about 0.11 cubic centimeters ($cm^3$) pursuant to the Abrasion Loss Test using the Neat Material Sampling Procedure.

Aspect 116. The synthetic leather material according to any one of Aspect 1 to Aspect 145, wherein the polyolefin resin composition comprises an effective amount of a polymeric resin modifier, and the effective amount of the polymeric resin modifier is an amount effective to allow the polyolefin resin composition to pass a flex test pursuant to the Cold Ross Flex Test using the Plaque Sampling Procedure.

Aspect 117. The synthetic leather material according to any one of Aspect 1 to Aspect 145, wherein the polyolefin resin composition comprises an effective amount of a polymeric resin modifier, and the effective amount of the polymeric resin modifier is an amount effective to allow the polyolefin resin composition to pass a flex test pursuant to the Cold Ross Flex Test using the Plaque Sampling Procedure without a significant change in an abrasion loss as compared to an abrasion loss of a second polyolefin resin composition identical to the polyolefin resin composition except without the polymeric resin modifier when measured pursuant to the Abrasion Loss Test using the Neat Material Sampling Procedure.

Aspect 118. The synthetic leather material according to any one of Aspect 1 to Aspect 145, wherein the polyolefin resin composition comprises a polypropylene copolymer, optionally wherein the polypropylene copolymer is a random copolymer.

Aspect 119. The synthetic leather material according to any one of Aspect 1 to Aspect 145, wherein the polyolefin resin composition comprises a polypropylene copolymer, and the polypropylene copolymer comprises about 80 percent to about 99 percent, about 85 percent to about 99 percent, about 90 percent to about 99 percent, or about 95 percent to about 99 percent polypropylene repeat units by weight based upon a total weight of the polypropylene copolymer.

Aspect 120. The synthetic leather material according to any one of Aspect 1 to Aspect 145, wherein the polyolefin resin composition comprises a polypropylene copolymer, and the polypropylene copolymer comprises about 1 percent to about 5 percent, about 1 percent to about 3 percent, about 2 percent to about 3 percent, or about 2 percent to about 5 percent ethylene by weight based upon a total weight of the polypropylene copolymer.

Aspect 121. The synthetic leather material according to any one of Aspect 1 to Aspect 145, wherein the polyolefin resin composition comprises a polypropylene copolymer, and the polypropylene copolymer is a random copolymer comprising about 2 percent to about 3 percent of a first plurality of repeat units by weight and about 80 percent to about 99 percent by weight of a second plurality of repeat units based upon a total weight of the polypropylene copolymer; wherein each of the repeat units in the first plurality of repeat units has a structure according to Formula 1A and each of the repeat units in the second plurality of repeat units has a structure according to Formula 1B Formula 1A

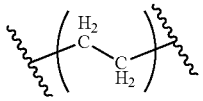

Formula 1B

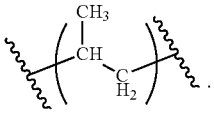

Aspect 123. The synthetic leather material according to any one of Aspect 1 to Aspect 145, wherein polymers in the polyolefin resin composition consist essentially of polymers including propylene repeat units.

Aspect 124. The synthetic leather material according to any one of Aspect 1 to Aspect 145, wherein a polymeric component of the polyolefin resin composition, consisting of all the polymers present in the polyolefin resin composition, consists essentially of polypropylene copolymers.

Aspect 125. The synthetic leather material according to any one of Aspect 1 to Aspect 145, wherein the polyolefin resin composition comprises a polypropylene copolymer, and the polypropylene copolymer is a random copolymer of ethylene and propylene.

Aspect 126. The synthetic leather material according to any one of Aspect 1 to Aspect 145, wherein the abrasion loss of the polyolefin resin composition is within about 20 percent of an abrasion loss of the otherwise same polyolefin resin composition except without the resin modifier when measured pursuant to the Abrasion Loss Test using the Neat Material Sampling Procedure.

Aspect 127. The synthetic leather material according to any one of Aspect 1 to Aspect 145, wherein the polyolefin resin composition has a percent crystallization of about 35 percent, about 30 percent, about 25 percent, or less when measured according to the Crystallinity Test using the Neat Material Sampling Procedure.

Aspect 128. The synthetic leather material according to any one of Aspect 1 to Aspect 145, wherein the polyolefin resin composition has a percent crystallization that is at least 4 percentage points less than a percent crystallization of the otherwise same polyolefin resin composition except without the polymeric resin modifier when measured according to the Crystallinity Test using the Neat Material Sampling Procedure.

Aspect 129. The synthetic leather material according to any one of Aspect 1 to Aspect 145, wherein the polyolefin resin composition comprises an effective amount of the polymeric resin modifier, and the effective amount of the polymeric resin modifier is about 5 percent to about 30 percent, about 5 percent to about 25 percent, about 5 percent to about 20 percent, about 5 percent to about 15 percent, about 5 percent to about 10 percent, about 10 percent to about 15 percent, about 10 percent to about 20 percent, about 10 percent to about 25 percent, or about 10 percent to about 30 percent by weight based upon a total weight of the resin composition.

Aspect 130. The synthetic leather material according to any one of Aspect 1 to Aspect 145, wherein the polyolefin resin composition comprises an effective amount of the polymeric resin modifier, and the effective amount of the polymeric resin modifier is about 20 percent, about 15 percent, about 10 percent, about 5 percent, by weight, or less based upon a total weight of the resin composition.

Aspect 131. The synthetic leather material according to any one of Aspect 1 to Aspect 145, wherein the polyolefin resin composition comprises the polymeric resin modifier, and the polymeric resin modifier comprises about 10 percent to about 15 percent ethylene repeat units by weight based upon a total weight of the polymeric resin modifier.

Aspect 132. The synthetic leather material according to any one of Aspect 1 to Aspect 145, wherein the polyolefin resin composition comprises the polymeric resin modifier, and the polymeric resin modifier comprises about 10 percent to about 15 percent repeat units according to Formula 1A by weight based upon a total weight of the polymeric resin modifier Formula 1A

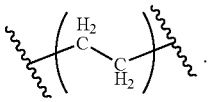

Aspect 133. The synthetic leather material according to any one of Aspect 1 to Aspect 145, wherein the polyolefin resin composition has a total ethylene repeat unit content of about 3 percent to about 7 percent by weight based upon a total weight of the resin composition.

Aspect 134. The synthetic leather material according to any one of Aspect 1 to Aspect 145, wherein the polyolefin resin composition comprises a polymeric resin modifier, and the polymeric resin modifier has an ethylene repeat unit content of about 10 percent to about 15 percent by weight based upon a total weight of the polymeric resin modifier.

Aspect 135. The synthetic leather material according to any one of Aspect 1 to Aspect 145, wherein the polyolefin resin composition comprises a polymeric resin modifier, and the polymeric resin modifier is a copolymer comprising isotactic repeat units derived from an olefin.

Aspect 136. The synthetic leather material according to any one of Aspect 1 to Aspect 145, wherein the polyolefin resin composition comprises a polymeric resin modifier, and the polymeric resin modifier is a copolymer comprising repeat units according to Formula 1B, and wherein the repeat units according to Formula 1B are arranged in an isotactic stereochemical configuration Formula 1B

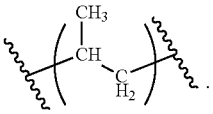

Aspect 137. The synthetic leather material according to any one of Aspect 1 to Aspect 145, wherein the polyolefin resin composition comprises the polymeric resin modifier, and an otherwise same polyolefin resin composition except without the polymeric resin modifier does not pass the cold Ross flex test using the Neat Material Sampling Procedure.

Aspect 138. The synthetic leather material according to any one of Aspect 1 to Aspect 145, wherein the polyolefin resin composition comprises a polymeric resin modifier, and the polymeric resin modifier is a copolymer comprising isotactic propylene repeat units and ethylene repeat units.

Aspect 139. The synthetic leather material according to any one of Aspect 1 to Aspect 145, wherein the polyolefin resin composition comprises a polymeric resin modifier, and the polymeric resin modifier is a copolymer comprising a first plurality of repeat units and a second plurality of repeat units; wherein each of the repeat units in the first plurality of repeat units has a structure according to Formula 1A and each of the repeat units in the second plurality of repeat units has a structure according to Formula 1B, and wherein the repeat units in the second plurality of repeat units are arranged in an isotactic stereochemical configuration Formula 1A

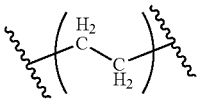

Formula 1B

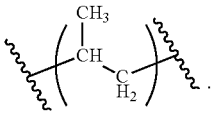

Aspect 140. The synthetic leather material according to any one of Aspect 1 to Aspect 145, wherein the polyolefin resin composition comprises a polymeric resin modifier, and the polymeric resin modifier is a metallocene catalyzed polymer, optionally a metallocene catalyzed copolymer, optionally a metallocene catalyzed propylene copolymer.

Aspect 140. The synthetic leather material according to any one of Aspect 1 to Aspect 145, wherein the polyolefin resin composition further comprises a clarifying agent.

Aspect 141. The synthetic leather material according to any one of Aspect 1 to Aspect 145, wherein the polyolefin resin composition comprises a clarifying agent, and the clarifying agent is present in an amount from about 0.5 percent by weight to about 5 percent by weight or about 1.5 percent by weight to about 2.5 percent by weight based upon a total weight of the polyolefin resin.

Aspect 142. The synthetic leather material according to any one of Aspect 1 to Aspect 145, wherein the polyolefin resin composition comprises a clarifying agent, and the clarifying agent is chosen from a substituted or unsubstituted dibenzylidene sorbitol, 1,3-O-2,4-bis(3,4-dimethylbenzylidene) sorbitol, 1,2,3-trideoxy-4,6:5,7-bis-O-[(4-propylphenyl)methylene], or a derivative thereof.

Aspect 143. The synthetic leather material according to any one of Aspect 1 to Aspect 145, wherein the polyolefin resin composition comprises a clarifying agent, and the clarifying agent comprises an acetal compound that is the condensation product of a polyhydric alcohol and an aromatic aldehyde.

Aspect 144. The synthetic leather material according to any one of Aspect 143, wherein the polyhydric alcohol is chosen from an acyclic polyol, such as xylitol or sorbitol, or an acyclic deoxy polyol, such as 1,2,3-trideoxynonitol or 1,2,3-trideoxynon-1-enitol, or a combination of an acyclic polyol and an acyclic deoxy polyol.

Aspect 145. The synthetic leather material according to Aspect 143, wherein the aromatic aldehyde is chosen from benzaldehyde, a substituted benzaldehyde, and a mixture of a benzaldehyde and a substituted benzaldehyde.

Aspect 146. A component comprising the synthetic leather material according to any one of Aspect 1 to Aspect 145.

Aspect 147. The component according to Aspect 146, wherein the component is a component of an article of footwear, a component of an article of apparel, or is a component of an article of sporting equipment.

Aspect 148. The component according to Aspect 147, wherein the component is a component of an article of footwear.

Aspect 149. The component according to Aspect 147, wherein the component is a component of an article of sporting equipment.

Aspect 150. The component according to Aspect 149, wherein the component is a component of an article of sporting equipment is chosen from a component of a hat, a component of a bag, a component of a ball, or a component of protective equipment.

Aspect 151. The component according to Aspect 147, wherein the component is a component of an article of apparel.

Aspect 152. The component according to Aspect 147, wherein the component is a component of an article of footwear.

Aspect 153. The component according to Aspect 152, wherein the component is an upper for an article of footwear.

Aspect 154. The component according to Aspect 152, wherein the component is a component of an upper chosen from a forefoot opening area, an ankle collar area, a ground-facing area, a sole perimeter area, a heel area, a toe-box area, a tongue, an eye stay, a medial side, a lateral side, or combinations thereof.

Aspect 155. A method of manufacturing a synthetic leather material, the method comprising: affixing a synthetic leather polymeric coating layer and a synthetic leather textile layer to each other; wherein synthetic leather polymeric coating layer comprises a synthetic leather polymeric coating composition; and wherein the synthetic leather textile layer comprises a fiber or a yarn comprising a fiber/yarn polymeric composition, and wherein the synthetic leather polymeric coating composition comprises a polyolefin resin composition, or the fiber/yarn polymeric composition comprises the polyolefin resin composition, or both the synthetic leather polymeric coating composition and the fiber/yarn polymeric composition comprises the polyolefin resin composition; optionally wherein the affixing comprises one or more step chosen from laminating the textile onto a surface of the resin composition, laminating the resin composition onto a surface of the textile, welding the textile onto a surface of the resin composition, welding the resin composition onto a surface of the textile, bonding the textile to a surface of the resin composition using an adhesive, or bonding the resin composition to a surface of the textile using an adhesive.

Aspect 156. The process according to Aspect 155, further comprising affixing a protective or decorative layer to the synthetic leather polymeric coating layer.

Aspect 157. The process according to Aspect 155 or Aspect 156, wherein the synthetic leather material is a synthetic leather material according to any one of Aspects 1 to 145.

Aspect 158. An article comprising: a synthetic leather material according to any one of Aspect 1 to Aspect 145.

Aspect 159. The article according to Aspect 158, wherein the article is an article of footwear, apparel, or sporting equipment.

Aspect 160. The article according to Aspect 159, wherein the article is an article of apparel.

Aspect 161. The article according to Aspect 159, wherein the article is an article of sporting equipment.

Aspect 162. The article according to Aspect 161, wherein the article of sporting equipment is a hat, a bag, a ball, or protective equipment.

Aspect 163. The article according to Aspect 159, wherein the article is an article of footwear.

Aspect 164. An article of footwear comprising: an upper and a sole structure; wherein the upper comprises the synthetic leather material according to any one of Aspect 1 to Aspect 145, the sole structure comprises the synthetic leather material according to any one of Aspect 1 to Aspect 145, or both the upper and the sole structure comprise the synthetic leather material according to any one of Aspect 1 to Aspect 145.

Aspect 165. The article according to Aspect 164, wherein the upper comprises the synthetic leather material according to any one of Aspect 1 to Aspect 145.

Aspect 166. The article of footwear according to any one of Aspect 164 to Aspect 209, wherein the sole structure comprises a sole component comprising a polyolefin resin.

Aspect 167. The article of footwear according to any one of Aspect 164 to Aspect 209, wherein a surface of the synthetic leather material is defined by a first polyolefin resin composition, a surface of the sole component is defined by a second polyolefin resin composition, and the surface of the upper defined by the first polyolefin resin composition is bonded to the surface of the sole component defined by the second polyolefin resin composition.

Aspect 168. The article of footwear according to any one of Aspect 164 to Aspect 209, wherein the bond between the surface of the upper defined by the first polyolefin resin composition and the surface of the sole component defined by the second polyolefin resin composition is a thermal bond.

Aspect 169. The article of footwear according to any one of Aspect 164 to Aspect 209, wherein the first polyolefin resin composition of the upper, or the second polyolefin composition of the sole component, or both, comprise a polyolefin resin composition according to any one of Aspect 92 to Aspect 145.

Aspect 170. The article of footwear according to any one of Aspect 164 to Aspect 209, wherein the sole component includes a first side and a second side, wherein the first side is configured to be ground-facing when the sole component is a component of an article of footwear.

Aspect 171. The article of footwear according to any one of Aspect 164 to Aspect 209, wherein the sole structure further comprises a textile disposed on one or both of the first side and the second side of the sole component.

Aspect 172. The article of footwear according to any one of Aspect 164 to Aspect 209. wherein the bond between the upper and the sole component includes a mechanical bond between the upper and the textile disposed on the sole component.

Aspect 173. The article of footwear according to any one of Aspect 164 to Aspect 209, wherein the sole component is a plate.

Aspect 174. The article of footwear according to Aspect 173, wherein the textile of sole component comprises a fiber/yarn polymeric composition, and the fiber/yarn polymeric composition comprises the polyolefin resin composition according to any one of Aspect 92 to Aspect 145.

Aspect 175. The article of footwear according to Aspect 174, wherein the textile of the sole structure further comprises a polymeric coating composition affixed to the textile; and wherein the polymeric coating composition comprises the polyolefin resin composition according to any one of Aspect 92 to Aspect 145.

Aspect 176. The article of footwear according to Aspect 105, wherein the textile of the sole component further comprises a polymeric coating composition affixed to the textile; and wherein the polymeric coating composition is substantially free of the polyolefin resin composition according to any one of Aspect 92 to Aspect 145.

Aspect 177. The article of footwear according to Aspect 176, wherein the polymeric coating composition comprises one or more thermoplastic polymers chosen from polyesters, polyethers, polyamides, or polyurethanes.

Aspect 178. The article of footwear according to Aspect 177, wherein the polymeric coating composition has a melting or softening temperature that is at least 20 degrees centigrade lower, or at least 50 degrees centigrade lower than the melting or softening temperature of the fiber/yarn polymeric composition of the textile of the sole component; or wherein the polymeric coating composition has a melting or softening temperature that is at least 20 degrees centigrade higher, or at least 50 degrees centigrade higher than the melting or softening temperature of the fiber/yarn polymeric composition of the textile of the sole component.

Aspect 179. The article of footwear according to Aspect 173, wherein the textile of the sole component comprises: a first fiber or a first yarn comprising a first fiber/yarn polymeric composition comprising the polyolefin resin composition according to any one of Aspect 92 to Aspect 145; and a second fiber or a second yarn comprising a second fiber/yarn polymeric composition.

Aspect 180. The article of footwear according to Aspect 179, wherein second fiber/yarn polymeric composition comprises one or more thermoplastic polymers chosen from polyesters, polyethers, polyamides, or polyurethanes.

Aspect 181. The article of footwear according to any one of Aspect 171 to Aspect 209, wherein the textile is on the first side of the sole component, and wherein the textile comprises a patterned or decorative textile.

Aspect 182. The article of footwear according to any one of Aspect 171 to Aspect 209, wherein the textile is on the second side of the sole component, and wherein a bond strength of the second side of the sole component to the upper is greater than a bond strength of the otherwise same sole component to the otherwise same upper using the otherwise same bonding procedure except without the textile disposed on the first side of the sole component.

Aspect 183. The article of footwear according to any one of Aspect 164 to Aspect 209, wherein the textile comprises a first textile on the first side of the sole component and a second textile on the second side of the sole component.

Aspect 184. The article of footwear according to any one of Aspect 164 to Aspect 209, wherein the sole structure extends from a medial side to a lateral side of the article of footwear.

Aspect 185. The article of footwear according to any one of Aspect 164 to Aspect 209, wherein a length of the sole component extends through a metatarsal region to a midfoot region of the article of footwear.

Aspect 186. The article of footwear according to any one of Aspect 164 to Aspect 209, wherein a length of the sole component extends through a midfoot region to a heel region of the article of footwear.

Aspect 187. The article of footwear according to any one of Aspect 164 to Aspect 209, wherein a length of the sole component extends from a toe region to a heel region of the article of footwear.

Aspect 188. The article of footwear according to any one of Aspect 164 to Aspect 209, wherein the first side of the sole component includes one or more traction elements.

Aspect 189. The article of footwear according to any one of Aspect 164 to Aspect 209, wherein the one or more traction elements are integrally formed in the sole component.

Aspect 190. The article of footwear according to any one of Aspect 164 to Aspect 209, wherein the traction elements include a polyolefin resin composition, optionally the polyolefin resin composition according to any one of Aspect 92 to Aspect 145.

Aspect 191. The article of footwear according to any one of Aspect 164 to Aspect 209, wherein the one or more traction elements comprise a second resin composition that is substantially free of polyolefins.

Aspect 192. The article of footwear according to any one of Aspect 164 to Aspect 209, wherein the second resin comprises an elastomeric material, optionally an olefin elastomer.

Aspect 193. The article of footwear according to any one of Aspect 164 to Aspect 209, wherein the second resin comprises a polystyrene, a polyethylene, an ethylene-α-olefin copolymer, an ethylene-propylene rubber (EPDM), a polybutene, a polyisobutylene, a poly-4-methylpent-1-ene, a polyisoprene, a polybutadiene, a ethylene-methacrylic acid copolymer, a copolymer thereof, or a blend or mixture thereof.

Aspect 194. The article of footwear according to any one of Aspect 164 to Aspect 209, wherein the second resin composition comprises less than 10 weight percent, or less than 5 weight percent of a polyolefin, optionally wherein the second resin composition comprises less than 10 weight percent, or less than 5 weight percent of polypropylene.

Aspect 195. The article of footwear according to any one of Aspect 164 to Aspect 209, wherein the second resin composition comprises an ethylene-propylene rubber (EPDM) dispersed in a polyolefin, optionally an EPDM dispersed in polypropylene.

Aspect 196. The article of footwear according to any one of Aspect 164 to Aspect 209, wherein the second resin composition comprises a block copolymer comprising a polystyrene block.

Aspect 197. The article of footwear according to any one of Aspect 164 to Aspect 209, wherein the block copolymer comprises a copolymer of styrene and one or both of ethylene and butylene.

Aspect 198. The article of footwear according to any one of Aspect 171 to Aspect 209, wherein the textile is disposed on the sole component by injection molding the sole component onto the textile, by laminating the textile onto the sole component, by welding the textile onto the sole component, and/or by bonding to the textile to the sole component using an adhesive.

Aspect 199. The article of footwear according to any one of Aspect 171 to Aspect 209, wherein the textile is selected from the group consisting of a woven textile, a non-woven textile, a knit textile, a braided textile, and a combination thereof.

Aspect 200. The article of footwear according to any one of Aspect 171 to Aspect 209, wherein the textile comprises one or more fibers comprising a polymer selected from the group consisting of a polyester, a polyamide, a polyolefin, a blend thereof, and a combination thereof.

Aspect 201. The article of footwear according to any one of Aspect 164 to Aspect 171, wherein the textile comprises a yarn comprising the fibers.

Aspect 202. The article of footwear according to any one of Aspect 164 to Aspect 209, wherein a surface roughness of the surface comprising the textile is greater than a surface roughness of the otherwise same surface except without the textile.

Aspect 203. The article of footwear according to any one of Aspect 164 to Aspect 209, wherein the textile is on the ground facing side of the sole structure, and wherein the textile is a knit textile, a woven textile, a non-woven textile, a braided textile, or a combination thereof.

Aspect 204. The article of footwear according to any one of Aspect 164 to Aspect 209, wherein the sole structure further includes an adhesive, a primer, or a tie layer located between the ground facing side and the elastomeric material.

Aspect 205. The article of footwear according to any one of Aspect 164 to Aspect 209, wherein one or more of the adhesive, the primer, and the tie layer include a polymer having epoxy segments, urethane segments, acrylic segments, cyanoacrylate segments, silicone segments, or any combination thereof.

Aspect 206. The article of footwear according to any one of Aspect 164 to Aspect 209, wherein one or more of the polyolefin resin of the plate, the adhesive, the primer, and the tie layer include a polymer having maleic anhydride functional groups.

Aspect 207. The article of footwear according to any one of Aspect 164 to Aspect 209, wherein one or more of the plate, the adhesive, the primer, and the tie layer include maleic anhydride.

Aspect 208. The article of footwear according to any one of Aspect 164 to Aspect 209, wherein the adhesive, the primer or the tie layer includes a thermoplastic polyurethane.

Aspect 209. The article of footwear according to any one of Aspect 164 to Aspect 209, wherein a ground facing side of the sole structure includes a texture.

Aspect 210. A method of manufacturing an article of footwear, the method comprising: affixing an upper and a sole structure to each other, wherein the upper or the sole structure or both the upper and the sole structure comprise a synthetic leather material, and the synthetic leather material comprises a synthetic leather polymeric coating layer affixed to a synthetic leather textile layer; wherein the synthetic leather polymeric coating layer comprises a synthetic leather polymeric coating composition; and wherein the synthetic leather textile layer comprises a fiber or a yarn comprising a fiber/yarn polymeric composition, and wherein the synthetic leather polymeric coating composition comprises a polyolefin resin composition, or the fiber/yarn polymeric composition comprises the polyolefin resin composition, or both the synthetic leather polymeric coating composition and the fiber/yarn polymeric composition comprises the polyolefin resin composition, or both the sole structure and the synthetic leather material.

Aspect 211. The method according to Aspect 210, wherein the synthetic leather material is a synthetic leather material according to any one of Aspect 1 to Aspect 145.

Aspect 212. The method according to Aspect 210 or Aspect 211, wherein the affixing the upper and the sole structure to each other comprises injection molding at least a portion of the sole structure onto at least a portion of the upper.

Aspect 213. The method according to any one of Aspect 210 to 212, wherein the affixing comprises affixing a surface of the sole structure to a surface of the upper, wherein the surface of the sole structure is defined by a polyolefin resin composition.

Aspect 214. The method according to Aspect 213, wherein the polyolefin resin composition defining the surface of the sole structure is a polyolefin resin composition according to any one of Aspect 92 to Aspect 145.

Aspect 215. The method according to any one of Aspect 210 to 214, wherein the affixing comprises affixing a surface of the sole structure to a surface of the upper, wherein the surface of the upper is defined by a polyolefin resin composition.

Aspect 216. The method according to Aspect 215, wherein the polyolefin resin composition defining the surface of the upper is a polyolefin resin composition according to any one of Aspect 92 to Aspect 145.

Aspect 217. The method according to any one of Aspect 210 to 216, wherein the affixing comprises forming a thermal bond between the surface of the sole structure and the surface of the upper, wherein the thermal bond includes a polyolefin resin composition, optionally a polyolefin resin composition according to any one of Aspect 92 to Aspect 145.

Aspect 218. The method according to Aspect 217, wherein the polyolefin resin composition of the thermal bond includes a polyolefin hot melt adhesive.

Aspect 219. The method according to any one of Aspect 210 to 218, wherein the affixing comprises forming a thermal bond between the surface of the sole structure and the surface of the upper, wherein forming the thermal bond includes injecting a polyolefin resin composition onto the upper, thereby forming at least a portion of the sole structure including the surface of the sole structure, and bonding the surface of the sole structure to the upper.

Now having described aspects of the present disclosure generally, additional discussion regarding aspects will be described in greater detail.

Before the present disclosure is described in greater detail, it is to be understood that this disclosure is not limited to particular aspects described, and as such may, of course, vary. Other systems, methods, features, and advantages of resin compositions and articles and components thereof will be or become apparent to one with skill in the art upon examination of the following drawings and detailed description. It is intended that all such additional systems, methods, features, and advantages be included within this description, be within the scope of the present disclosure, and be protected by the accompanying claims. It is also to be understood that the terminology used herein is for the purpose of describing particular aspects only, and is not intended to be limiting. The skilled artisan will recognize many variants and adaptations of the aspects described herein. These variants and adaptations are intended to be included in the teachings of this disclosure and to be encompassed by the claims herein.

Articles of Footwear

In some aspects, the present disclosure is directed to articles of footwear including a synthetic leather material as described herein, wherein the upper of the article of footwear, or the sole structure of the article of footwear, or both comprise the synthetic leather material. The sole structure of the article of footwear can comprise a sole component such as one or more plates. At least a portion of the surface of the upper affixed to the sole structure can comprise a synthetic leather material as described herein, optionally where the affixed surface of the upper is defined by a polyolefin resin composition as described herein. In some aspects, both the affixed surface of the upper, and the affixed surface of the sole structure, can comprise a polyolefin resin composition. The strength of bonds between two surfaces both formed of polyolefin compositions typically are stronger than the strength of bonds between a first surface formed of a polyolefin composition and a non-polyolefin polymeric composition, as the surface energy of polyolefins are typically different from other types of polymeric materials commonly used in footwear manufacturing. As the bond strength of a thermal bond formed between two polyolefin resin compositions is typically greater than an adhesive bond (e.g. a bond formed using a hot-melt adhesive or a cement), when both the surface of the upper and the surface of the sole structure are defined by a polyolefin resin composition, it is advantageous to affix the surfaces together using a thermal bond in which a polyolefin resin composition of the upper and/or of the sole structure is softened or melted and then re-solidified to for the bond. The polyolefin resin composition of the synthetic leather material can be the same as the polyolefin resin composition of the sole structure. The polymeric component of the two polyolefin resin compositions (i.e., the portion of the composition consisting of all the polymers present in the polyolefin resin composition) can include the same types of polymers in the same concentrations, or can include the same types of polymers in different concentrations, or can include different types of polymers. The polyolefin component of the two polyolefin resin compositions (i.e., the portion of the composition consisting of all the polyolefins present in the polyolefin resin composition) can include the same types of polyolefins in the same concentrations, or can include the same types of polyolefins in different concentrations, or can include different types of polyolefins.

In some aspects, the sole structure comprises a polyolefin resin composition, including a polyolefin resin composition as described herein. Sole structures and sole components comprising a polyolefin resin composition desirably exhibit high levels of mechanical strength and yet flexural durability. However, applicants have found that in some aspects, when polyolefin resin compositions are used to form a bonding surface of a sole structure or sole component, bonding to the surface defined by the polyolefin resin composition (e.g. bonding between a plate and the upper) may be unsatisfactory, particularly when the other surface to be affixed to the bonding surface of the sole structure or sole component (e.g., a surface of the upper, such as an externally-facing surface of a strobel) is defined by a polymeric composition having a significantly different surface energy than the polyolefin resin composition. For example, it can be difficult to bond polyurethanes, polyamides, or polyesters to a polyolefin resin composition using only adhesive systems conventionally used in the footwear industry. One way to improve the bond strength between polyolefin resin compositions and polymeric materials which are relatively incompatible with polyolefins is to use a textile layer as an interface between the surface of the upper and the surface of the sole structure, and bond one side of the textile to the surface of the upper and bond the opposite side of the textile to the surface of the sole structure. Therefore, in some aspects, the sole structures include a sole component comprising a polyolefin resin composition and a textile disposed on one or more surfaces of the sole component. In one example, using a textile comprising fibers or yarns formed of a polymeric material having a different surface energy as compared to the surface energy of the polyolefin resin composition of the sole component may facilitate bonding between an upper which comprises a polymeric material having a surface energy which is closer to the surface energy of the textile than to the surface energy of the polyolefin resin composition of the sole component, thereby increasing the strength of a bond between the sole component and the upper as compared to using a plate without the textile. Using a textile can provide a textured surface having a greater surface area, providing greater opportunity to form mechanical bonds between the upper and the plate, thereby increasing the strength of a bond between the sole component and the upper as compared to using a sole component without the textile. As an additional benefit, the textile can be used to provide a decorative or stylistic surface in some aspects.

Figure 1B:
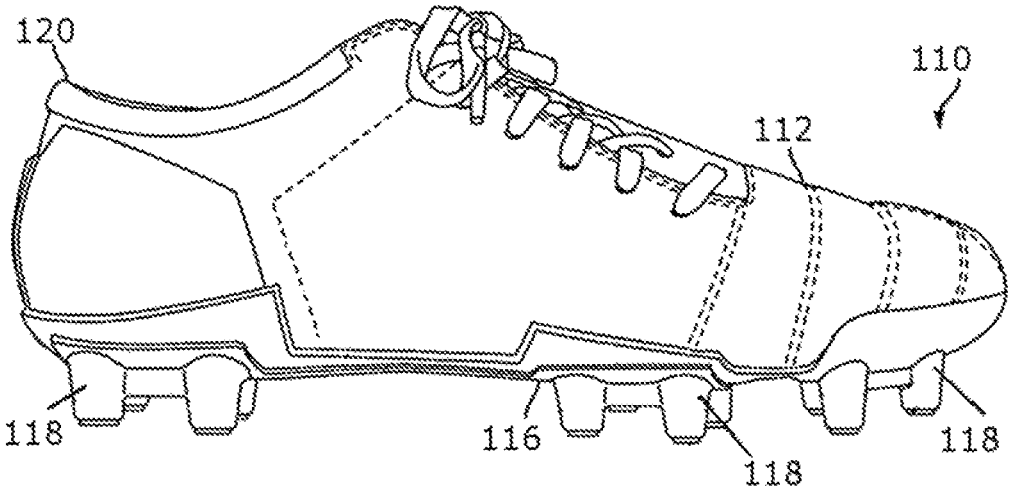
Figure 1C:
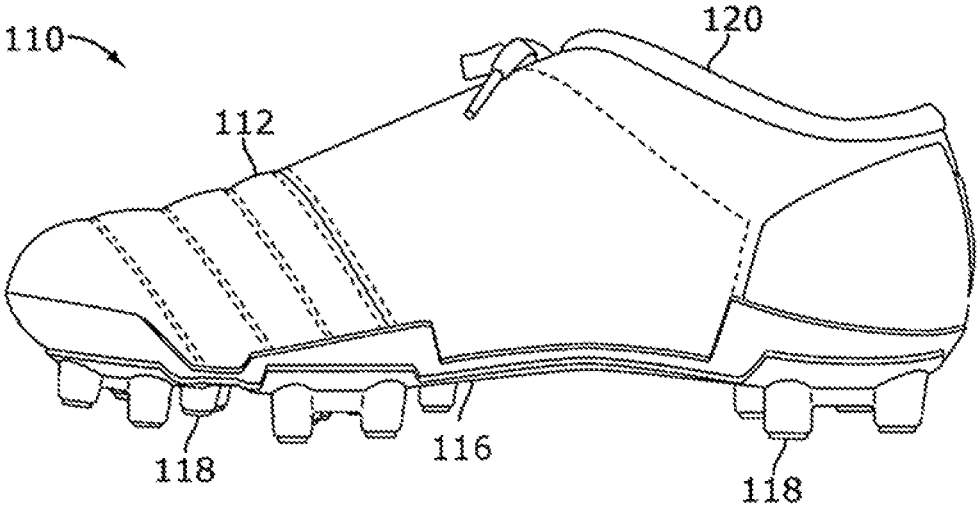
Figure 1D:
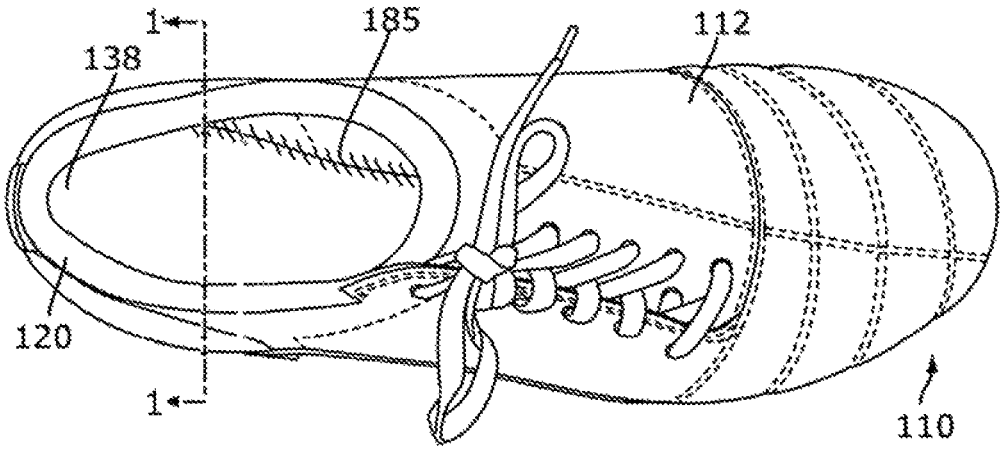
Figure 1E:
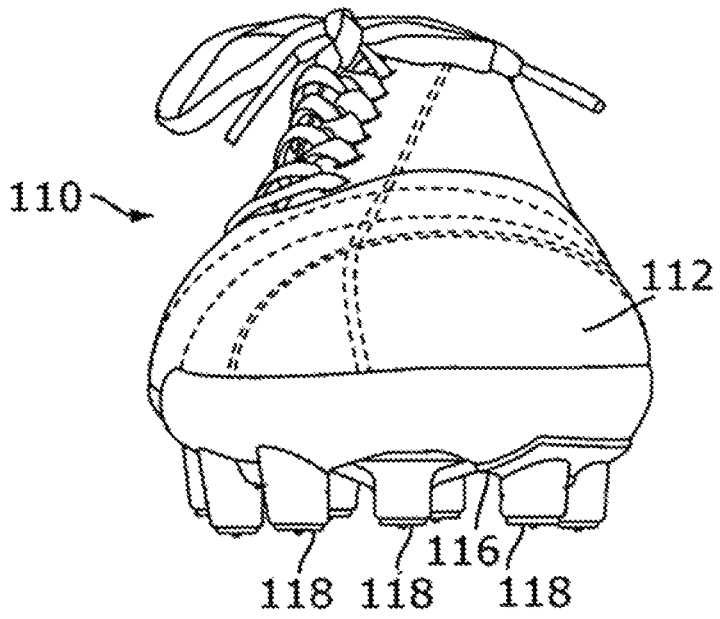
Figure 1F:
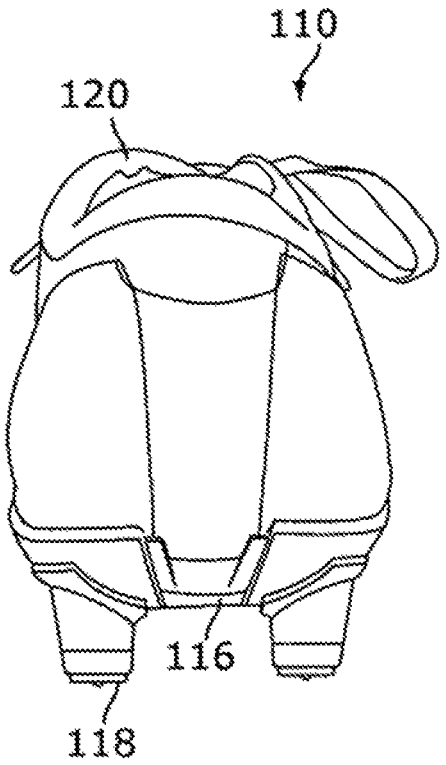

FIG. 1A is a lateral side perspective view of an exemplary cleated article of athletic footwear 110, for example a soccer/futbol boot. As seen in FIG. 1A, the article of footwear 110 includes an upper 112 and a sole structure 113, which includes a plate 116 and a textile 114 disposed on the upper side 152 of the plate. The textile 114 is located between the plate 116 and the upper 112. The plate 116 includes multiple traction elements 118. When worn, traction elements 118 provide traction to a wearer so as to enhance stability. One or more of the traction elements 118 can be integrally formed with the plate, as illustrated in FIG. 1A, or can be removable. Optionally, one or more of the traction elements 118 can include a traction element tip (not pictured) configured to be ground-contacting. The traction element tip can be integrally formed with the traction element 118. Optionally, the traction element tip can be formed of a different material (e.g., a metal, or a polymeric material containing different polymers) than the rest of the traction element 118. FIG. 1B is a lateral side elevational view of article of footwear 110. When the article of footwear 110 is worn, the lateral side of the article 110 is generally oriented on the side facing away from the centerline of the wearer's body. FIG. 1C is a medial side elevational view of the article of footwear 110. When the article of footwear 110 is worn, the medial side generally faces toward the centerline of the wearer's body. FIG. 1D is a top view of the article of footwear 110 (with no sock liner in place) and without a lasting board or other board-like member 115, and further shows upper 112. Upper 112 includes a padded collar 120. Alternatively or in addition, the upper can include a region configured to extend up to or over a wearer's ankle (not illustrated). In at least one aspect, upper 112 is tongueless, with the upper wrapping from the medial side of the wearer's foot, over the top of the foot, and under the lateral side portion of the upper, as illustrated in FIG. 1D. Alternatively, the article of footwear can include a tongue (not illustrated). As illustrated in FIG. 1A-1G, the laces of the article of footwear 110 optionally can be located on the lateral side of the article. In other examples, the article of footwear may have a slip-on design or may include a closure system other than laces (not illustrated). FIG. 1E and FIG. 1F are, respectively, front and rear elevational views of the article of footwear 110.

Figure 1G:
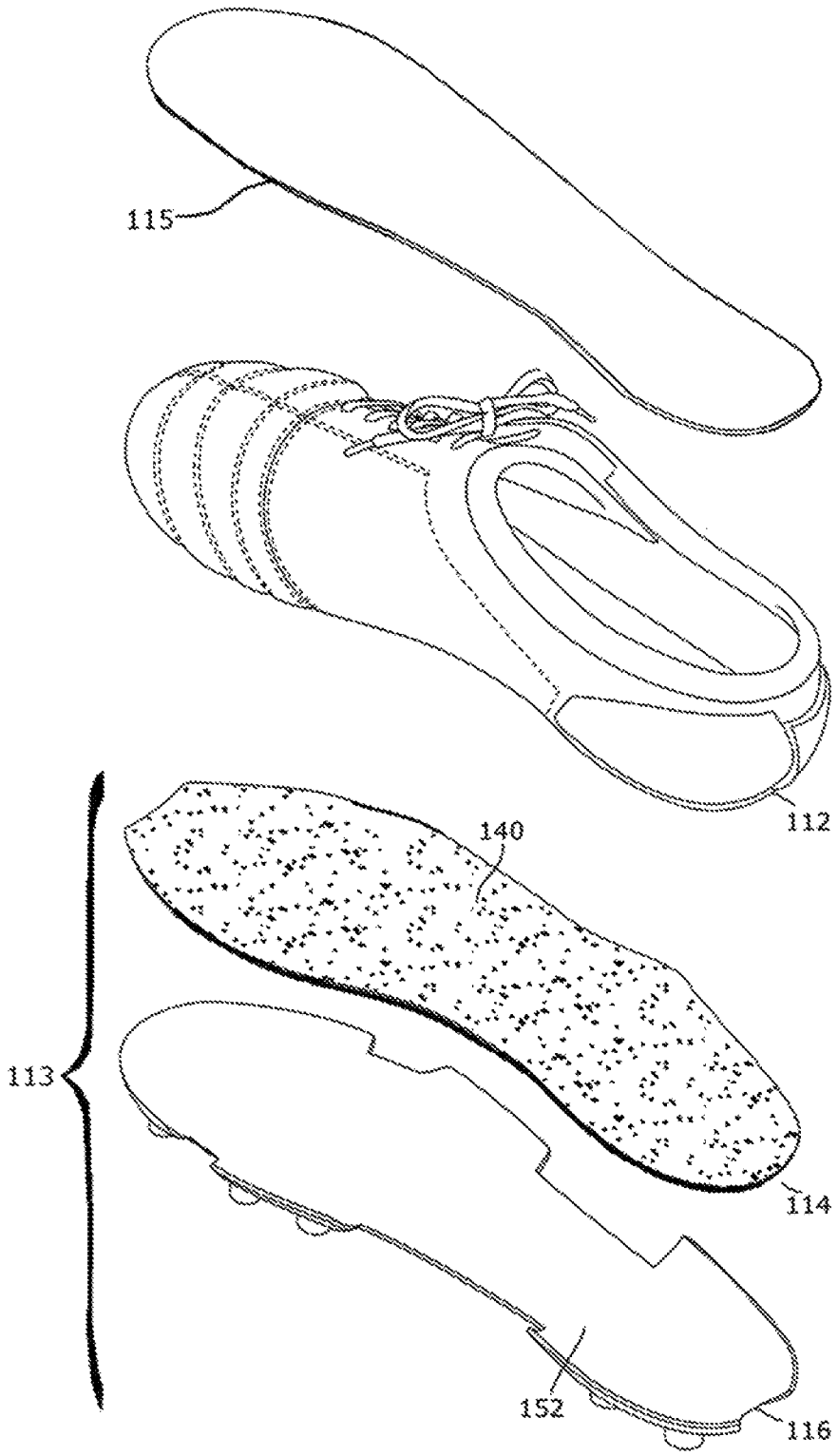
Figure 1H:
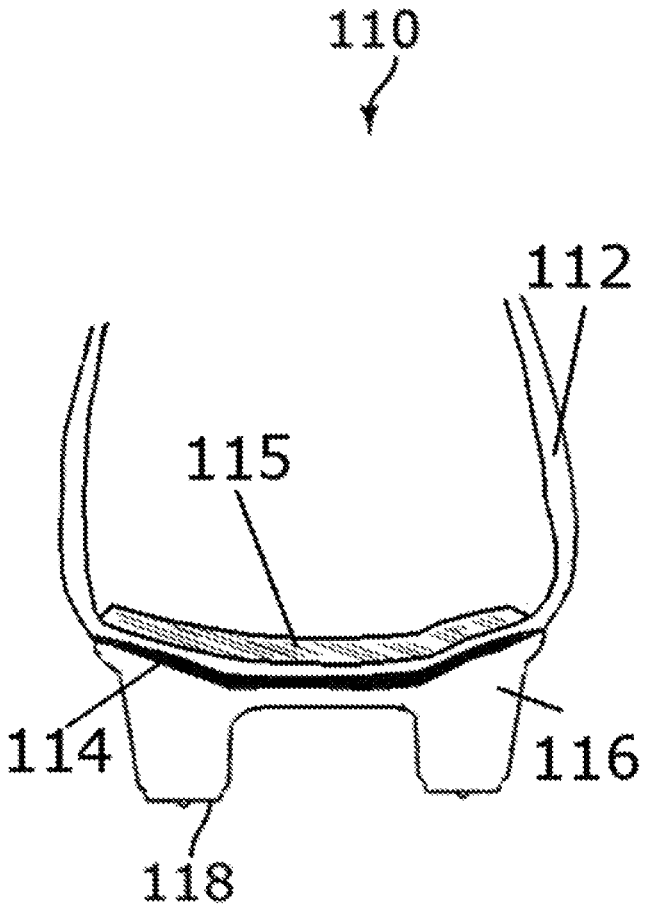

FIG. 1G is an exploded perspective view of the article of footwear 110 showing upper 112, plate 116, and textile 114. As seen in FIG. 1D, upper 112 includes a strobel 138. As illustrated in FIG. 1D, the strobel 138 is roughly the shape of a wearer's foot, and closes the bottom of the upper 112, and is stitched to other components to form the upper 112 along the periphery of the strobel 138 with stitching 185. A lasting board or other board-like member 115 can be located above or below the strobel 138. In some aspects, a lasting board or other board-like member can replace the strobel. The lasting board or other board-like member 115 can extend substantially the entire length of the plate, or can be present in a portion of the length of the plate, such as, for example, in the toe region 130, or in the midfoot region, or in the heel region. Upper 112 including strobel 138 is bonded to the upper surface 140 of the textile 114 (FIGS. 1G-1H). The lower surface 142 of the textile 114 can be bonded or melded to the upper surface 152 of the plate 116. In some aspects, the lower surface 142 of the textile 114 can be mechanically bonded to the upper surface 152 of the plate 116 by melding polymers in the textile 114 and the polymeric resin of the plate 116. Alternatively or in addition, upper 112 including strobel 138 are mechanically bonded to the upper surface 140 of the textile 114 by melding the polymeric resin of the upper 112 or strobel 138 with the polymeric resin of the plate 116. In some aspects, the bonding can include both adhesive bonding and mechanical bonding.

In at least one aspect, plate 116 and textile 114 are first bonded before upper 112 and/or strobel 138 is bonded to textile 114. In some aspects, the article of footwear 110 can include a removable sock liner (not pictured). As is known in the art, a sock liner conforms to and lines the inner bottom surface of a shoe and is the component contacted by the sole (or socked sole) of a wearer's foot.

Figure 2A:
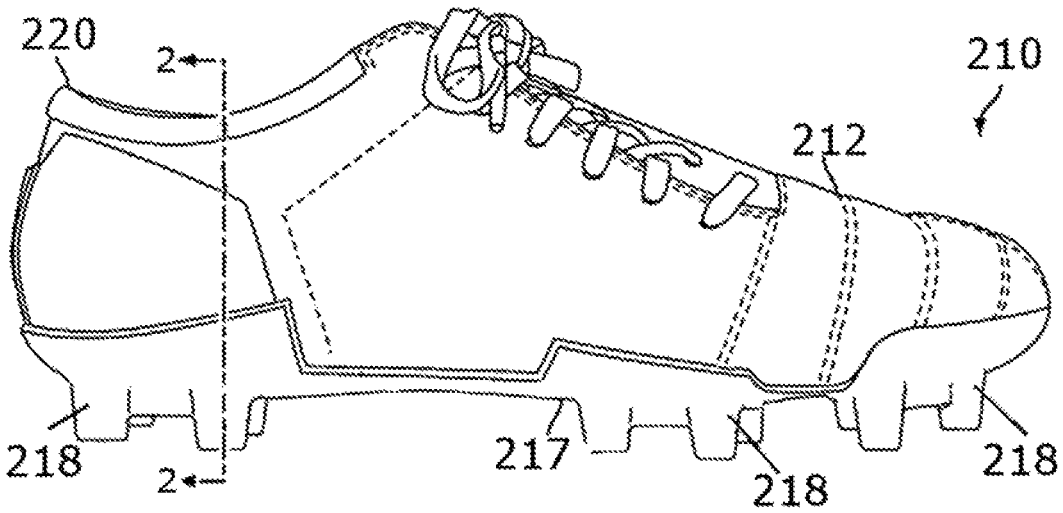
FIGS. 2A-2C depict a second exemplary article of athletic footwear.
Figure 2B:
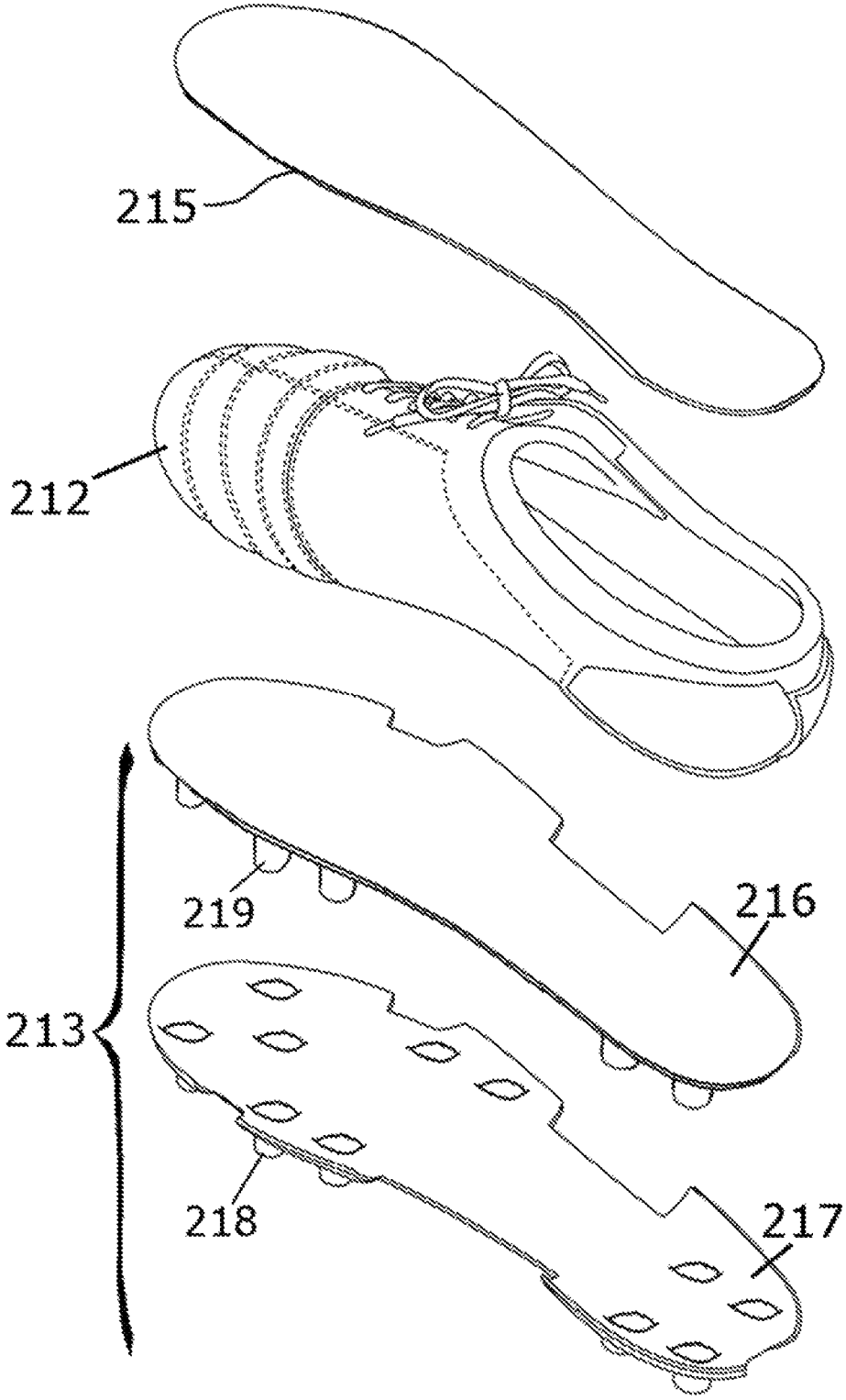
Figure 2C:
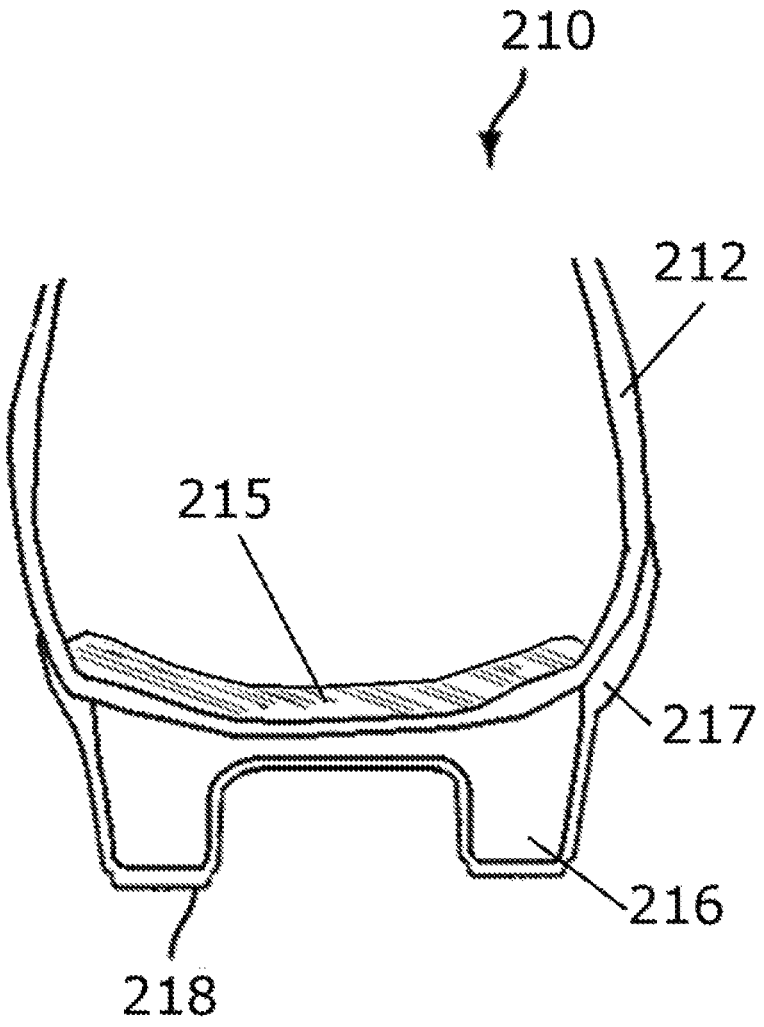

FIGS. 2A-2C depict a second exemplary article of athletic footwear. FIG. 2A is a lateral side elevational view of the exemplary article of athletic footwear. FIG. 2B is an exploded perspective view of the second exemplary article of athletic footwear. FIG. 2C is a sectional view along 2-2 of the second exemplary article of athletic footwear. FIG. 2A is a lateral side elevational view of an exemplary article of footwear 210 that does not have a textile. The article of footwear 210 includes an upper 212 and a sole structure 213 having a plate 216 and a chassis 217. The chassis 217 includes multiple traction elements 218. The traction elements 218 can be formed entirely from the chassis 217 material or, as pictured in FIG. 2B, the traction elements 118 can have a corresponding inner traction element 219 that is formed in the plate 216 and encased by the chassis 217. Optionally, one or more of the traction elements 218 can include a traction element tip (not pictured) configured to be ground-contacting. The article of footwear 210 can include a lasting board member 215 which can extend substantially the entire length of the plate 216.

Figure 3:
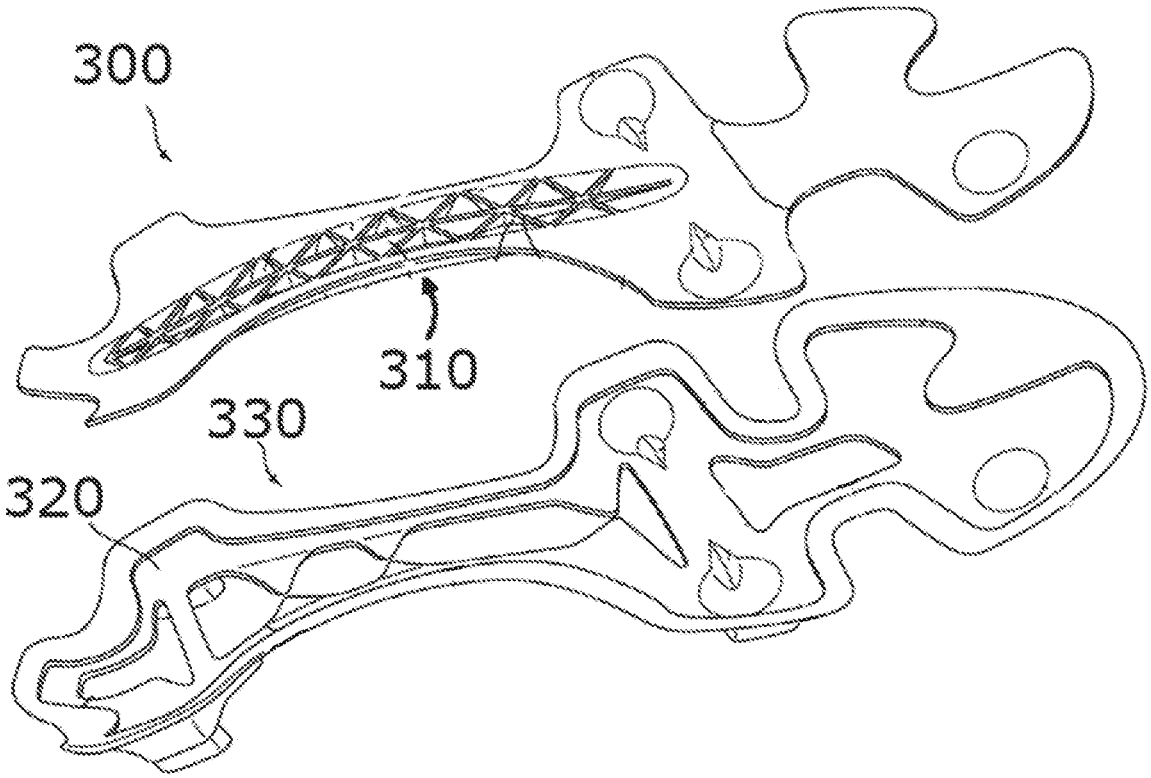
FIG. 3 depicts an exploded view of a third exemplary sole structure having a chassis and a rigid plate providing rigidity without adding substantial amounts of extra material, and therefore maintaining a low weight.

In some aspects, the sole structure may include a plate to provide rigidity, strength, and/or support without substantially adding weight. For example, some exemplary sole structure aspects may include a plate having certain features that provide resistance to vertical bending, lateral bending, and/or torsion. As depicted in FIG. 3, the plate 300 can include a reinforcing rib 310 longitudinally along the plate. The reinforcing rib can include a hollow structure, and thus, may provide rigidity without adding substantial amounts of extra material, and therefore maintains a low weight. The plate 300 can sit within a chassis 330, for example with a recess 320 in the chassis 330.

Figure 4A:
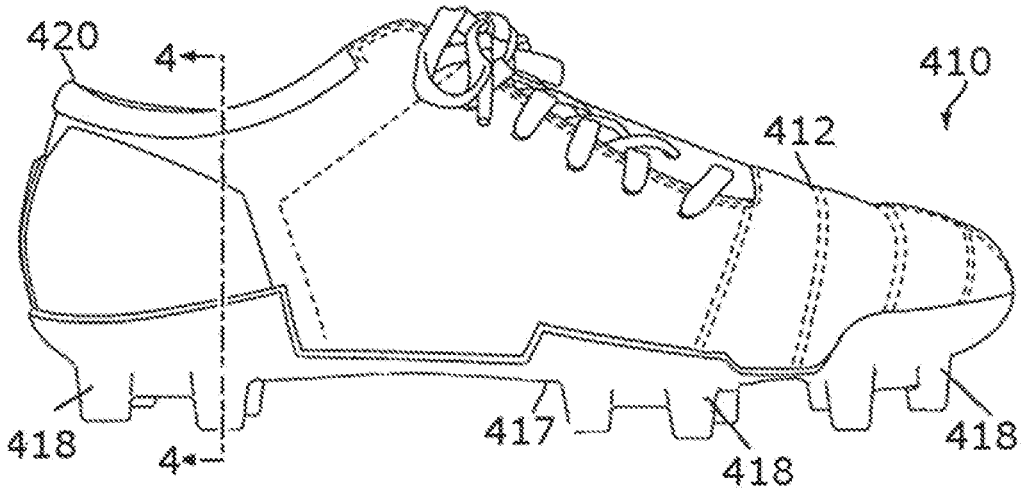
FIGS. 4A-4C depict a fourth exemplary article of athletic footwear.
Figure 4B:
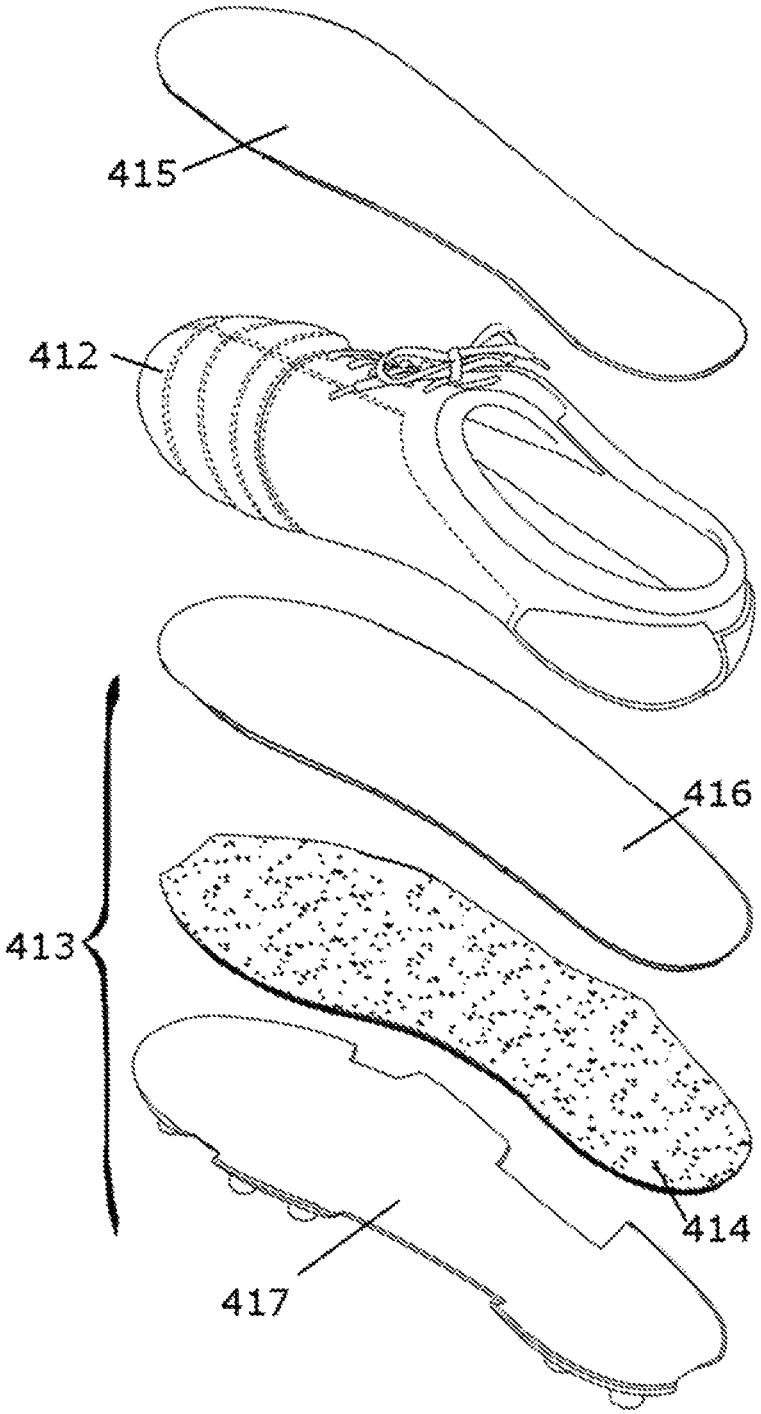
Figure 4C:
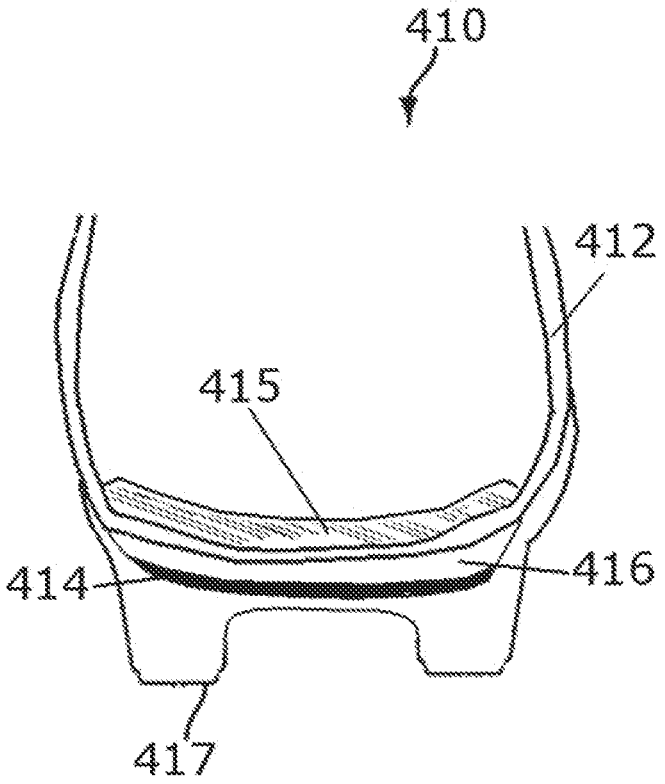

In some aspects, when the sole structure includes a plate and a chassis configured to wrap around the plate and to engage or be attached to an upper when the sole structure is a component of an article of footwear, the sole structure also includes one or more textiles. For example, a textile can be between the plate and the upper and can provide for improved bonding between the plate and the upper. A textile can also be positioned between the plate and the chassis. In aspects where the textile is between the plate and the chassis, the textile can provide for improved adhesion between the plate and the chassis and/or the textile can be a decorative or ornamental textile. In some aspects, the sole structure can include a decorative textile on the exterior or ground facing surface of the chassis. For example, as depicted in FIGS. 4A-4C, the article of footwear 410 includes an upper 412 and a sole structure 413 having a plate 416 and a chassis 417. The chassis 417 includes multiple traction elements 418. The traction elements 418 can be formed entirely from the chassis 417 material as pictured. Optionally, one or more of the traction elements 418 can include a traction element tip (i.e., terminal end) (not pictured) configured to be ground-contacting. A textile 414 is positioned between the plate 416 and the chassis 417. The article of footwear 410 can include a lasting board member 415 which can extend substantially the entire length of the plate 416.

Figure 5A:
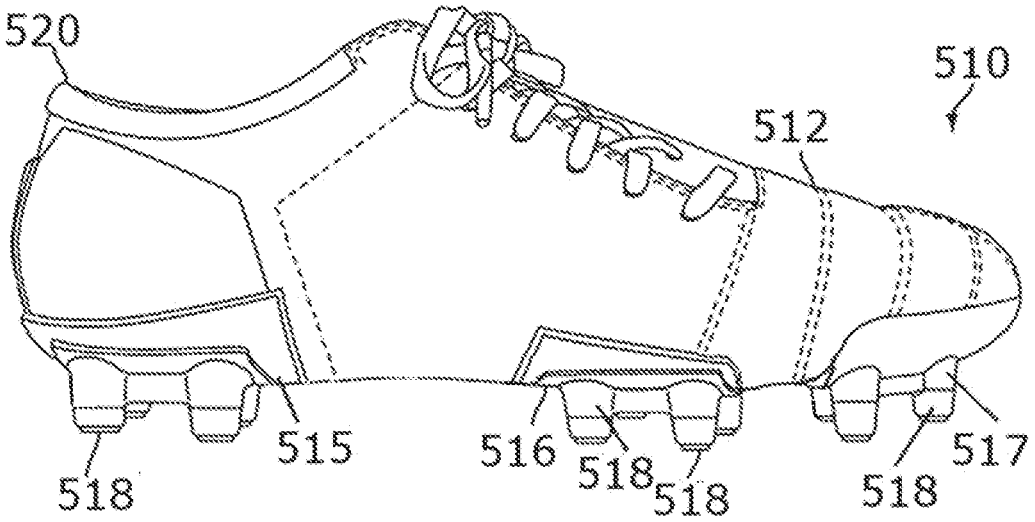
FIGS. 5A-5B depict a fifth exemplary article of athletic footwear.
Figure 5B:
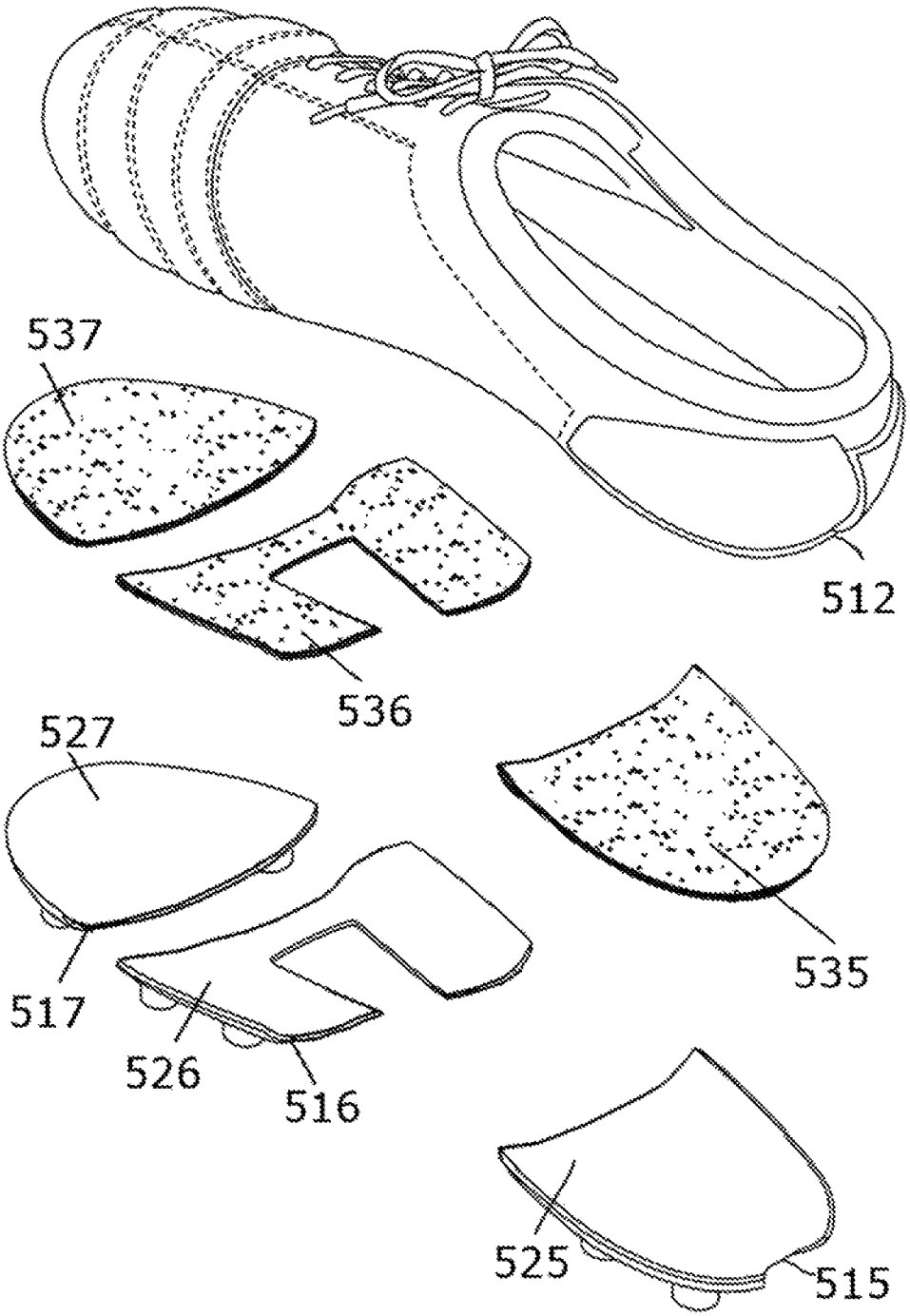

FIG. 5A is a lateral side elevational view of an exemplary article of footwear 510 including separate heel plate 515, midfoot plate 516, and toe plate 517. The article of footwear 510 includes an upper 512 and a heel plate 515, midfoot plate 516, and toe plate 517. Each of the heel plate 515, midfoot plate 516, and toe plate 517 include multiple traction elements 518. When worn, traction elements 518 provide traction to a wearer so as to enhance stability. One or more of the traction elements 518 can be integrally formed with the heel plate 515, midfoot plate 516, and/or toe plate 517, as illustrated in FIG. 5A, or can be removable. FIG. 5B is an exploded perspective view of the article of footwear 510 showing upper 512, heel plate 515, midfoot plate 516, and toe plate 517. In this aspect, the upper surface 525 of the heel plate 515 can include a heel textile 535. The upper surface 527 of the toe plate 517 can include a toe textile 537. Likewise, the upper surface 526 of the midfoot plate 516 includes a midfoot textile 536. The textiles can provide for improved bonding between upper 512, heel plate 515, midfoot plate 516, and toe plate 517.

This disclosure provides a variety of sole structures including a polyolefin plate, i.e. including a plate containing a polyolefin resin composition. The plate includes a polyolefin resin composition, for example any of the polyolefin resin compositions described herein. The sole structures can also include an elastomeric material, including a cured rubber. The cured rubber can form an outsole portion of the sole structure, or can form the tip of one or more traction elements.

The sole structures can include a textile on one or more surfaces of the plate. For instance, when the plate has a first side and a second side, the first side can be configured to be ground-facing when the plate is a component of an article of footwear and the second side can be configured to be upward facing. In some aspects, the textile is on one or both of the first side and the second side. The textile can provide for improved bonding between the plate and other components of the sole structure, e.g. between the plate and a chassis. The textile can also provide for improved bonding between the plate and the upper when the sole structure is a component of an article of footwear. In some aspects, the textile is a patterned or decorative textile.

In some aspects, the sole structures include a chassis. In some aspects, the chassis is in combination with one or more textiles in the sole structure, while in some aspects the sole structure includes a chassis and no textile. The chassis can be configured to be on the first side or ground facing side of the plate. In some aspects, the chassis is configured to wrap around the plate and to engage or be attached to an upper when the sole structure is a component of an article of footwear. The chassis can attach to the upper at the bite line.

In some aspects, the traction elements are made from the same or nearly the same polyolefin resin composition as the plate. In other aspects, the traction elements are made from a second resin that is different from the polyolefin resin. In some aspects, the sole structure includes a chassis and the chassis is made from the second resin. The second resin can include a polystyrene, a polyethylene, an ethylene-α-olefin copolymer, an ethylene-propylene rubber (EPDM), a polybutene, a polyisobutylene, a poly-4-methylpent-1-ene, a polyisoprene, a polybutadiene, an ethylene-methacrylic acid copolymer, an olefin elastomer, a copolymer thereof, or a blend or mixture thereof. In some aspects, the second resin includes about 20 percent, about 10 percent, or less of a polyolefin. The second resin can include about 20 percent, about 10 percent, or less of polypropylene. The second resin can include an ethylene-propylene rubber (EPDM) dispersed in a polypropylene. The second resin can include a block copolymer comprising a polystyrene block. The block copolymer comprises can be, for example, a copolymer of styrene and one or both of ethylene and butylene. In general, the second resin can be any resin that is compatible with the polyolefin resin and that has the appropriate durability and mechanical properties.

In particular, the second resin (e.g. a polystyrene, a polyethylene, an ethylene-α-olefin copolymer, an ethylene-propylene rubber (EPDM), a polybutene, a polyisobutylene, a poly-4-methylpent-1-ene, a polyisoprene, a polybutadiene, an ethylene-methacrylic acid copolymer, an olefin elastomer, a copolymer thereof, or a blend or mixture thereof) have been found to bond well to the resin compositions of the present disclosure.

Additionally, second resins containing an ethylene-propylene rubber (EPDM) dispersed in a polypropylene, or containing a block copolymer having a polystyrene block; and wherein the block copolymer includes a copolymer of styrene and one or both of ethylene and butylene, have been found to be particularly useful in ground-contacting portions of traction elements, as these compositions both bond well to the resin compositions of the present disclosure, and can provide an even higher level of abrasion-resistance than the resin compositions of the present disclosure, which may be desired in the ground-contacting portions of traction elements.

In some aspects, it can be beneficial to include a clarifying agent in the plate (in the polyolefin resin) and/or, when a chassis is present, in the chassis. The clarifying agent can allow for clear visibility of a textile through the plate. The clarifying agent can be present in any suitable amount to provide sufficient optical clarity of the final plate or sole structure. In some aspects, the clarifying agent is present in an amount from about 0.5 percent by weight to about 5 percent by weight or about 1.5 percent by weight to about 2.5 percent by weight based upon a total weight of the polyolefin resin. The clarifying agent can include those selected from the group of substituted or unsubstituted dibenzylidene sorbitol, 1,3-O-2,4-bis(3,4-dimethylbenzylidene) sorbitol, 1,2,3-trideoxy-4,6:5,7-bis-O-[(4-propylphenyl)methylene], and a derivative thereof. The clarifying agent can include an acetal compound that is the condensation product of a polyhydric alcohol and an aromatic aldehyde. The polyhydric alcohol can include those selected from the group consisting of acyclic polyols such as xylitol and sorbitol and acyclic deoxy polyols such as 1,2,3-trideoxynonitol or 1,2,3-trideoxynon-1-enitol. The aromatic aldehyde can include those selected from the group consisting of benzaldehyde and substituted benzaldehydes.

Polyolefin Resin Compositions

As disclosed herein, a polyolefin resin composition is a mixture or blend of one or more polyolefins, optionally with one or more additional ingredients chosen from a polymeric resin modifier, a clarifying agent, a coloring agent, a filler, a processing aid, a non-polyolefin polymer, or any combination thereof.

A variety of polyolefin resin compositions are provided having the abrasion resistance and flexural durability suitable for use in the articles and components described above. In some aspects, a polyolefin resin composition is provided including a polyolefin copolymer, and an effective amount of a polymeric resin modifier. The effective amount of the resin modifier provides improved flexural durability while maintaining a suitable abrasion resistance. For example, in some aspects the effective amount of the polymeric resin modifier is an amount effective to allow the resin composition to pass a flex test pursuant to the Cold Ross Flex Test using the Plaque Sampling Procedure. At the same time, the resin composition can still have a suitable abrasion loss when measured pursuant to the Abrasion Loss Test using the Neat Material Sampling Procedure. In some aspects, the otherwise same resin composition except without the polymeric resin modifier does not pass the cold Ross flex test using the Neat Material Sampling Procedure.

The polymeric resin modifier can provide improved flexural strength, toughness, creep resistance, or flexural durability without a significant loss in the abrasion resistance. In some aspects, a resin composition is provided including a polyolefin copolymer, and an effective amount of a polymeric resin modifier, where the effective amount of the polymeric resin modifier is an amount effective to allow the resin composition to pass a flex test pursuant to the Cold Ross Flex Test using the Plaque Sampling Procedure without a significant change in an abrasion loss as compared to an abrasion loss of a second resin composition identical to the resin composition except without the polymeric resin modifier when measured pursuant to the Abrasion Loss Test using the Neat Material Sampling Procedure. In other words, in some aspects, the effective amount of the polymeric resin modifier is an amount which is sufficient to produce a resin composition that does not stress whiten or crack during 150,000 flex cycles of the Cold Ross Flex test, while the abrasion resistance of the resin composition has not been significantly degraded and thus is not significantly different than the abrasion resistance of a comparator resin composition which is otherwise identical to the resin composition except that it is free of the polymeric resin modifier.

In some aspects, the polyolefin resin composition has an abrasion loss of about 0.05 cubic centimeters ($cm^3$) to about 0.1 cubic centimeters ($cm^3$), about 0.07 cubic centimeters ($cm^3$) to about 0.1 cubic centimeters ($cm^3$), about 0.08 cubic centimeters ($cm^3$) to about 0.1 cubic centimeters ($cm^3$), or about 0.08 cubic centimeters ($cm^3$) to about 0.11 cubic centimeters ($cm^3$) pursuant to the Abrasion Loss Test using the Neat Material Sampling Procedure. In some aspects, the resin composition has no significant change in the abrasion loss as compared to an abrasion loss of a second resin composition identical to the resin composition except without the polymeric resin modifier when measured pursuant to the Abrasion Loss Test using the Neat Material Sampling Procedure. A change in abrasion loss, as used herein, is said to not be significant when the change is about 30 percent, about 25 percent, about 20 percent, about 15 percent, about 10 percent, or less when measured pursuant to the Abrasion Loss Test using the Neat Material Sampling Procedure.

The polyolefin resin compositions can include a variety of polyolefin copolymers. The copolymers can be alternating copolymers or random copolymers or block copolymers or graft copolymers. In some aspects, the copolymers are random copolymers. In some aspects, the copolymer includes a plurality of repeat units, with each of the plurality of repeat units individually derived from an alkene monomer having about 1 to about 6 carbon atoms. In other aspects, the copolymer includes a plurality of repeat units, with each of the plurality of repeat units individually derived from a monomer selected from the group consisting of ethylene, propylene, 4-methyl-1-pentene, 1-butene, 1-octene, and a combination thereof. In some aspects, the polyolefin copolymer includes a plurality of repeat units each individually selected from Formula 1A-1D. In some aspects, the polyolefin copolymer includes a first plurality of repeat units having a structure according to Formula 1A, and a second plurality of repeat units having a structure selected from Formula 1B-1D.

Formula 1A

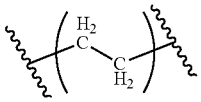

Formula 1B

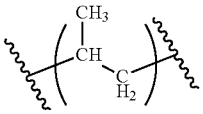

Formula 1C

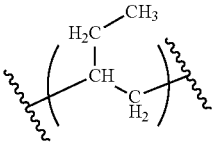

Formula 1D

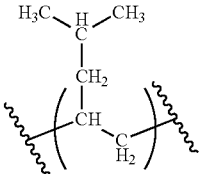

In some aspects, the polyolefin copolymer includes a plurality of repeat units each individually having a structure according to Formula 2

Formula 2

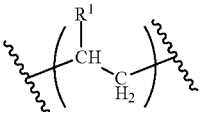

where $R^1$ is a hydrogen or a substituted or unsubstituted, linear or branched, $C_1$-$C_{12}$ alkyl. $C_1$-$C_6$ alkyl, $C_1$-$C_3$ alkyl, $C_1$-$C_{12}$ heteroalkyl, $C_1$-$C_6$ heteroalkyl, or $C_1$-$C_3$ heteroalkyl. In some aspects, each of the repeat units in the first plurality of repeat units has a structure according to Formula 1A above, and each of the repeat units in the second plurality of repeat units has a structure according to Formula 2 above.

In some aspects, the polyolefin copolymer is a random copolymer of a first plurality of repeat units and a second plurality of repeat units, and each repeat unit in the first plurality of repeat units is derived from ethylene and the each repeat unit in the second plurality of repeat units is derived from a second olefin. In some aspects, the second olefin is an alkene monomer having about 1 to about 6 carbon atoms. In other aspects, the second olefin includes propylene, 4-methyl-1-pentene, 1-butene, or other linear or branched terminal alkenes having about 3 to 12 carbon atoms. In some aspects, the polyolefin copolymer contains about 80 percent to about 99 percent, about 85 percent to about 99 percent, about 90 percent to about 99 percent, or about 95 percent to about 99 percent polyolefin repeat units by weight based upon a total weight of the polyolefin copolymer. In some aspects, the polyolefin copolymer consists essentially of polyolefin repeat units. In some aspects, polymers in the resin composition consist essentially of polyolefin copolymers.

The polyolefin copolymer can include ethylene, i.e. can include repeat units derived from ethylene such as those in Formula 1A. In some aspects, the polyolefin copolymer includes about 1 percent to about 5 percent, about 1 percent to about 3 percent, about 2 percent to about 3 percent, or about 2 percent to about 5 percent ethylene by weight based upon a total weight of the polyolefin copolymer.

The polyolefin resin compositions can be made without the need for polyurethanes and/or without the need for polyamides. For example, in some aspects the polyolefin copolymer is substantially free of polyurethanes. In some aspects, the polymer chains of the polyolefin copolymer are substantially free of urethane repeat units. In some aspects, the resin composition is substantially free of polymer chains including urethane repeat units. In some aspects, the polyolefin copolymer is substantially free of polyamide. In some aspects, the polymer chains of the polyolefin copolymer are substantially free of amide repeat units. In some aspects, the resin composition is substantially free of polymer chains including amide repeat units.

In some aspects, the polyolefin copolymer includes polypropylene or is a polypropylene copolymer. In some aspects, the polymeric component of the resin composition (i.e., the portion of the resin composition that is formed by all of the polymers present in the composition) consists essentially of polypropylene copolymers. In some aspects the resin composition is provided including a polypropylene copolymer, and an effective amount of a polymeric resin modifier, wherein the resin composition has an abrasion loss as described above, and wherein the effective amount of the polymeric resin modifier is an amount effective to allow the resin composition to pass a flex test pursuant to the Cold Ross Flex Test using the Plaque Sampling Procedure. In some aspects, the effective amount of the polymeric resin modifier is an amount effective to allow the resin composition to pass a flex test pursuant to the Cold Ross Flex Test using the Plaque Sampling Procedure without a significant change in an abrasion loss as compared to an abrasion loss of a second resin composition identical to the resin composition except without the polymeric resin modifier when measured pursuant to the Abrasion Loss Test using the Neat Material Sampling Procedure.

The polypropylene copolymer can include a random copolymer, e.g. a random copolymer of ethylene and propylene. The polypropylene copolymer can include about 80 percent to about 99 percent, about 85 percent to about 99 percent, about 90 percent to about 99 percent, or about 95 percent to about 99 percent propylene repeat units by weight based upon a total weight of the polypropylene copolymer. In some aspects, the polypropylene copolymer includes about 1 percent to about 5 percent, about 1 percent to about 3 percent, about 2 percent to about 3 percent, or about 2 percent to about 5 percent ethylene by weight based upon a total weight of the polypropylene copolymer. In some aspects, the polypropylene copolymer is a random copolymer including about 2 percent to about 3 percent of a first plurality of repeat units by weight and about 80 percent to about 99 percent by weight of a second plurality of repeat units based upon a total weight of the polypropylene copolymer; wherein each of the repeat units in the first plurality of repeat units has a structure according to Formula 1A above and each of the repeat units in the second plurality of repeat units has a structure according to Formula 1B above.

The combination of abrasion resistance and flexural durability can be related to the overall crystallinity of the resin composition. In some aspects, the resin composition has a percent crystallization (% crystallization) of about 45 percent, about 40 percent, about 35 percent, about 30 percent, about 25 percent or less when measured according to the Crystallinity Test using the Neat Material Sampling Procedure. It has been found that adding the polymeric resin modifier to the resin composition in an amount which only slightly decreases the percent crystallinity of the resin composition as compared to an otherwise identical resin composition except without the polymeric resin modifier can result in resin compositions which are able to pass the Cold Ross Flex test while maintaining a relatively low abrasion loss. In some aspects, the polymeric resin modifier leads to a decrease in the percent crystallinity (% crystallinity) of the resin composition. In some aspects, the resin composition has a percent crystallization (% crystallization) that is at least 6, at least 5, at least 4, at least 3, or at least 2 percentage points less than a percent crystallization (% crystallization) of the otherwise same resin composition except without the polymeric resin modifier when measured according to the Crystallinity Test using the Neat Material Sampling Procedure.

In some aspects, the effective amount of the polymeric resin modifier is about 5 percent to about 30 percent, about 5 percent to about 25 percent, about 5 percent to about 20 percent, about 5 percent to about 15 percent, about 5 percent to about 10 percent, about 10 percent to about 15 percent, about 10 percent to about 20 percent, about 10 percent to about 25 percent, or about 10 percent to about 30 percent by weight based upon a total weight of the resin composition. In some aspects, the effective amount of the polymeric resin modifier is about 20 percent, about 15 percent, about 10 percent, about 5 percent, or less by weight based upon a total weight of the resin composition.

The polymeric resin modifier can include a variety of exemplary resin modifiers described herein. In some aspects, the polymeric resin modifier is a metallocene catalyzed copolymer primarily composed of isotactic propylene repeat units with about 11 percent by weight-15 percent by weight of ethylene repeat units based on a total weight of metallocene catalyzed copolymer randomly distributed along the copolymer. In some aspects, the polymeric resin modifier includes about 10 percent to about 15 percent ethylene repeat units by weight based upon a total weight of the polymeric resin modifier. In some aspects, the polymeric resin modifier includes about 10 percent to about 15 percent repeat units according to Formula 1A above by weight based upon a total weight of the polymeric resin modifier. In some aspects, the polymeric resin modifier is a copolymer of repeat units according to Formula 1B above, and the repeat units according to Formula 1B are arranged in an isotactic stereochemical configuration.

In some aspects, the polymeric resin modifier is a copolymer containing isotactic propylene repeat units and ethylene repeat units. In some aspects, the polymeric resin modifier is a copolymer including a first plurality of repeat units and a second plurality of repeat units; wherein each of the repeat units in the first plurality of repeat units has a structure according to Formula 1A above and each of the repeat units in the second plurality of repeat units has a structure according to Formula 1B above, and wherein the repeat units in the second plurality of repeat units are arranged in an isotactic stereochemical configuration.

The term "externally facing" as used in "externally facing layer" refers to the position the element is intended to be in when the element is present in an article during normal use. If the article is footwear, the element is positioned toward the ground during normal use by a wearer when in a standing position, and thus can contact the ground including unpaved surfaces when the footwear is used in a conventional manner, such as standing, walking or running on an unpaved surface. In other words, even though the element may not necessarily be facing the ground during various steps of manufacturing or shipping, if the element is intended to face the ground during normal use by a wearer, the element is understood to be externally-facing or more specifically for an article of footwear, ground-facing. In some circumstances, due to the presence of elements such as traction elements, the externally facing (e.g., ground-facing) surface can be positioned toward the ground during conventional use but may not necessarily come into contact the ground. For example, on hard ground or paved surfaces, the terminal ends of traction elements on the outsole may directly contact the ground, while portions of the outsole located between the traction elements do not. As described in this example, the portions of the outsole located between the traction elements are considered to be externally facing (e.g., ground-facing) even though they may not directly contact the ground in all circumstances.

Synthetic Leather Materials

In various aspects, disclosed herein are synthetic leather materials comprising a synthetic leather polymeric coating layer affixed to a synthetic leather textile layer; where the synthetic leather polymeric coating layer comprises a synthetic leather polymeric coating composition; and optionally where the synthetic leather textile layer comprises a fiber or a yarn comprising a synthetic leather fiber/yarn polymeric composition. In some aspects, the disclosed synthetic leather materials can optionally further comprise a synthetic leather protective or decorative layer affixed to the polymeric coating layer.

The disclosed synthetic leather materials are believed to possess several advantages, particularly for use in the manufacture of articles, such as articles of footwear or articles of clothing. In some aspects, the use of polyolefin resins makes it possible to create synthetic leather materials that are less susceptible to stress whitening. Additionally or alternatively, it is believe that the use of polyolefin resin compositions in the disclosed synthetic leather materials can promote better bonding between other components or materials used in articles, such as articles of footwear or articles of clothing or articles of sporting equipment. For example, in aspects in which the disclosed synthetic leather materials, comprising polyolefin resin composition, are used in the manufacture of an upper, such an upper can show enhanced bonding to polyolefin components, such as a sole structure. Accordingly, use of the same or similar polymeric materials for the component and the synthetic leather material increases the ability to recycle both components in the same stream without having to separate them, reducing waste. Additionally or alternatively, use of polyolefin resin compositions in a disclosed synthetic leather provides materials having a lower density as compared to more traditional footwear materials such as TPU. Accordingly, use of a high percentage of these polyolefins in an article of footwear can result in a lighter article of footwear as compared to an article of footwear made using the same amount of a denser polymer such as TPU.

Figure 6A:
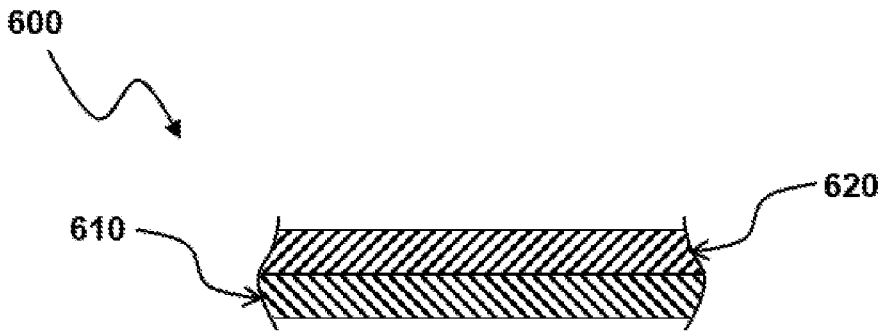
FIGS. 6A-6B show cross-sectional view of a disclosed synthetic leather material.
Figure 6B:
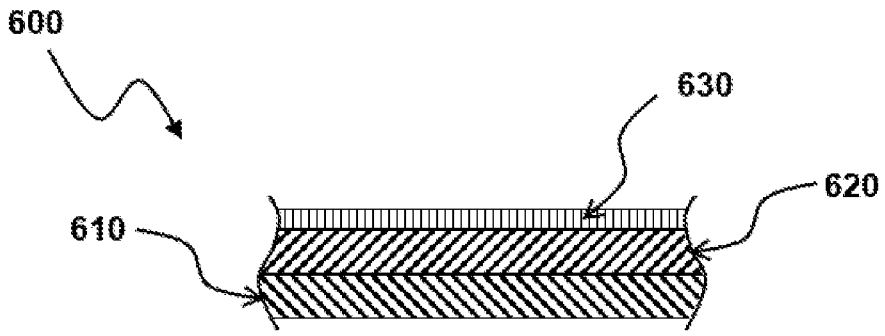

FIG. 6A is a cross-sectional view of a disclosed synthetic leather material 600 comprising a synthetic leather textile layer 610, to which is affixed a synthetic leather polymeric coating layer 620, in which it is understood that the synthetic leather polymeric coating layer comprises a synthetic leather polymeric coating composition and the synthetic leather textile layer comprises a fiber or a yarn comprising a synthetic leather fiber/yarn polymeric composition. FIG. 6B is a cross-sectional view of a disclosed synthetic leather material 600 comprising a synthetic leather textile layer 610, to which is affixed a synthetic leather polymeric coating layer 620, and further comprising a synthetic leather protective or decorative layer 630 affixed to the synthetic leather polymeric coating layer 620. It is understood that the synthetic leather textile layer can be any suitable textile, including, but not limited to, a knit textile, a woven textile, a non-woven textile, a crocheted textile, and a braided textile. Knit textiles suitable for use in the disclosed synthetic leather materials include, but are not limited to, a flat knit textile, a circular knit textile, or a weft knit textile.

Figure 7A:
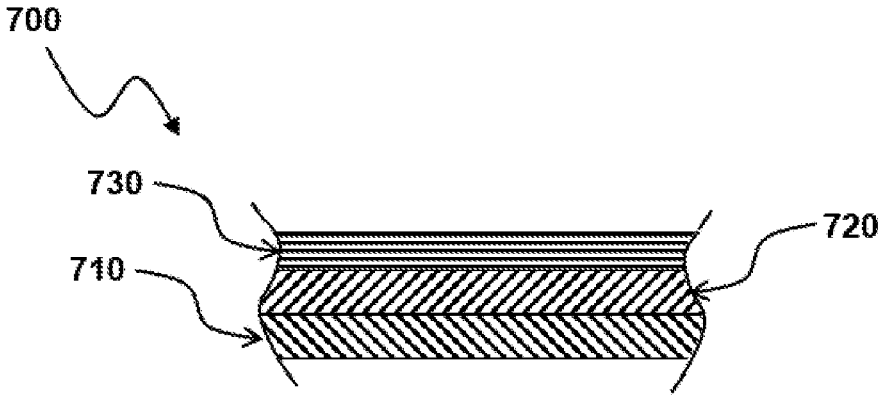
FIGS. 7A-7B show cross-sectional view of a disclosed synthetic leather material.

The disclosed synthetic leather materials can comprise a plurality of synthetic leather polymeric coating layers, where plurality as used herein is two or more coating layers. FIG. 7A is a cross-sectional view of a disclosed synthetic leather material 700 comprising a synthetic leather textile layer 710, to which is affixed a first synthetic leather polymeric coating layer 720, and a second synthetic leather polymeric coating layer 730 affixed to the first synthetic leather polymeric coating layer 720, where it is understood that each of the plurality of the synthetic leather polymeric coating layers comprises a synthetic leather polymeric coating composition and the synthetic leather textile layer comprises a fiber or a yarn comprising a synthetic leather fiber/yarn polymeric composition. As illustrated in FIG. 7A, the synthetic leather textile layer 710 and the first synthetic leather polymeric coating layer 720 can be distinct layers. Alternatively, the combination of the synthetic textile and the first synthetic leather polymeric coating can form a single composite layer.

When a plurality of synthetic leather polymeric coating layers are used, the polymeric component of each polymeric coating (i.e., the portion of the coating material formed of all the polymers present in the material) can comprise the same or different types polymers. Examples of different types of polymers include polyolefins, polyesters, polyethers, polyamides, polyurethanes, and polyacrylates. For examples referring to FIG. 7A, the first synthetic leather polymeric coating composition 720 is substantially free of the polyolefin resin composition described herein and is composed of one or more thermoplastic polymers such as, for example, polyesters, polyethers, polyamides, and polyurethanes, and the second synthetic leather polymeric coating composition 730 comprises a polyolefin resin composition as described herein.

Alternatively, the first synthetic leather polymeric coating composition 720 comprises a polyolefin resin composition as described herein and the second synthetic leather polymeric coating composition 730 is substantially free of the polyolefin resin composition described herein and is composed of one or more polymers such as, for example, polyesters, polyethers, polyamides, and polyurethanes as provided herein.

Alternatively, the first synthetic leather polymeric coating composition 720 and the second synthetic leather polymeric coating composition 730 are each a polyolefin resin composition as described herein, where the first synthetic leather polymeric coating composition and the second synthetic leather polymeric coating compositions comprise the same or different polyolefin resin compositions. For example, when the first and second polymeric coating compositions comprise different polyolefin resin compositions, the polymeric component of the different polyolefin resin compositions can comprise polyolefins having different chemical structures, or can comprise polyolefins having the same chemical structures but in different concentrations.

Figure 7B:
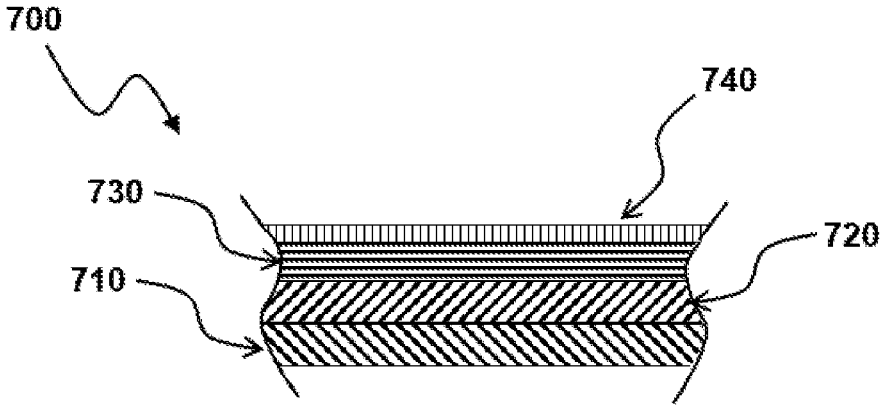

FIG. 7B is a cross-sectional view of a disclosed synthetic leather material 700 comprising a synthetic leather textile layer 710, to which is affixed a first synthetic leather polymeric coating layer 720, and a second synthetic leather polymeric coating layer 730 affixed to the first synthetic leather polymeric coating layer 720, and further comprising a synthetic leather protective or decorative layer 740 affixed to the synthetic leather polymeric coating layer 730. It is understood that the synthetic leather textile layer can be any suitable textile, including, but not limited to, a textile chosen from a knit textile, a woven textile, a non-woven textile, a crocheted textile, or a braided textile. Knit textiles suitable for use in the disclosed synthetic leather materials include, but are not limited to, a knit textile chosen from a flat knit textile, a circular knit textile, or a weft knit textile.

The thickness of the synthetic leather polymeric coating layer can modified as needed. In the case when two or more synthetic leather polymeric coating layers are used, the thickness of each layer can vary or can be modified. Referring to FIG. 7A, in one aspect, the thickness of the first synthetic leather polymeric coating composition 720 is less than thickness of the second synthetic leather polymeric coating composition 730, for example at least 5 percent less. In another aspect, the thickness of the first synthetic leather polymeric coating composition 720 is greater than thickness of the second synthetic leather polymeric coating composition 730, for example, at least 5 percent greater. In another aspect, the thickness of the first synthetic leather polymeric coating composition 720 is equal to the thickness of the second synthetic leather polymeric coating composition 730.

In one aspect, the synthetic leather polymeric coating layer can be a film that is affixed to the synthetic leather textile layer. For example, the polyolefin resin compositions described herein can be extruded into a film that is subsequently affixed to the synthetic leather textile layer. In other aspects, two or more different films can be extruded and sequentially affixed to the synthetic leather textile layer. For example, the first and second synthetic leather polymeric coating compositions depicted in FIGS. 7A and 7B can each be films that have been affixed to the synthetic leather textile layer.

The disclosed synthetic leather materials can comprise a disclosed polyolefin resin composition in one or more of the synthetic leather textile layer, the synthetic leather polymeric coating, and/or the synthetic leather protective or decorative layer. As disclosed herein above, a disclosed polyolefin resin composition can comprise a polyolefin resin with a polymeric resin modified, and optionally with a clarifying agent), to form one or more layers of a synthetic leather material.

For example, the disclosed polyolefin resin compositions can be used to form one or more films that are combined with a non-woven textile to form an outer skin of the synthetic leather material. In other instances, the disclosed polyolefin resins can be used to form fibers or filaments, which in turn can be used to form a yarn, which can be used to form a non-woven textile portion of the synthetic leather material. In a further instance, the disclosed polyolefin resins can be used to form both the skin layer and the non-woven textile layer.

In some examples, the synthetic leather polymeric coating layer can be porous (e.g., foamed). Alternatively, or in combination with a porous synthetic leather polymer coating layer, a porous polymer layer can be positioned between the synthetic leather coating layer and the synthetic leather textile layer. Optionally, in various aspects, a clear or colored protective or decorative coating may be applied or affixed to the outer surface of the polymeric layer.

Although polyester (PET) yarns or fibers can be used manufacture of a synthetic leather textile layer, e.g., used in a fiber or yarn used to make the textile layer, it is possible to use other types of synthetic fibers, natural fibers, or regenerated fibers. Moreover, the synthetic leather textile layer can utilize one or more fibers or yarns comprising a thermoplastic polymeric composition as disclosed herein. The use of microfibers in the synthetic leather textile layer can improve the hand (softness and flexibility) of the synthetic leather material.

In some instances, the synthetic leather polymeric coating layer can comprise a synthetic leather polymeric coating composition comprising a disclosed thermoplastic polymer composition. For example, a synthetic leather polymeric coating layer can comprise a synthetic leather polymeric coating composition comprising a polyurethane or a polyvinylchloride. It may be desirable to use a polyurethane-based synthetic leather materials in articles of footwear, and a polyvinylchloride-based synthetic leather materials are commonly used in sporting equipment. In other instances, the synthetic leather polymeric coating layer can comprise a synthetic leather polymeric coating composition comprising a disclosed polyolefin resin composition.

As described above, the synthetic leather material includes a synthetic leather textile layer including a textile (e.g., a first textile). The textile can be a nonwoven textile, a knit textile, or a woven textile. A "textile" may be defined as any material manufactured from fibers, filaments, or yarns characterized by flexibility, fineness, and a high ratio of length to thickness. Textiles generally fall into two categories. The first category includes textiles produced directly from webs of filaments or fibers by randomly interlocking to construct non-woven fabrics and felts. The second category includes textiles formed through a mechanical manipulation of yarn, thereby producing a woven fabric, a knitted fabric, a braided fabric, a crocheted fabric, and the like.

The terms "filament," "fiber," or "fibers" as used herein refer to materials that are in the form of discrete elongated pieces that are significantly longer than they are wide. The fiber can include natural, manmade or synthetic fibers. The fibers may be produced by conventional techniques, such as extrusion, electrospinning, interfacial polymerization, pulling, and the like. The fibers can include carbon fibers, boron fibers, silicon carbide fibers, titania fibers, alumina fibers, quartz fibers, glass fibers, such as E, A, C, ECR, R, S, D, and NE glasses and quartz, or the like. The fibers can be fibers formed from synthetic polymers capable of forming fibers such as poly(ether ketone), polyimide, polybenzoxazole, poly(phenylene sulfide), polyesters, polyolefins (e.g., polyethylene, polypropylene), aromatic polyamides (e.g., an aramid polymer such as para-aramid fibers and meta-aramid fibers), aromatic polyimides, polybenzimidazoles, polyetherimides, polytetrafluoroethylene, acrylic, modacrylic, poly(vinyl alcohol), polyamides, polyurethanes, and copolymers such as polyether-polyurea copolymers, polyester-polyurethanes, polyether block amide copolymers, or the like. The fibers can be natural fibers (e.g., silk, wool, cashmere, vicuna, cotton, flax, hemp, jute, sisal). The fibers can be man-made fibers from regenerated natural polymers, such as rayon, lyocell, acetate, triacetate, rubber, and poly (lactic acid).

The fibers can have an indefinite length. For example, man-made and synthetic fibers are generally extruded in substantially continuous strands. Alternatively, the fibers can be staple fibers, such as, for example, cotton fibers or extruded synthetic polymer fibers can be cut to form staple fibers of relatively uniform length. The staple fiber can have a have a length of about 1 millimeter to 100 centimeters or more as well as any increment therein (e.g., 1 millimeter increments).

The fiber can have any of a variety of cross-sectional shapes. Natural fibers can have a natural cross-section, or can have a modified cross-sectional shape (e.g., with processes such as mercerization). Man-made or synthetic fibers can be extruded to provide a strand having a predetermined cross-sectional shape. The cross-sectional shape of a fiber can affect its properties, such as its softness, luster, and wicking ability. The fibers can have round or essentially round cross sections. Alternatively, the fibers can have non-round cross sections, such as flat, oval, octagonal, rectangular, wedge-shaped, triangular, dog-bone, multilobal, multi-channel, hollow, core-shell, or other shapes.

The fiber can be processed. For example, the properties of fibers can be affected, at least in part, by processes such as drawing (stretching) the fibers, annealing (hardening) the fibers, and/or crimping or texturizing the fibers.

The fiber can be a multi-component fiber, such as one comprising two or more co-extruded polymeric materials. The two or more co-extruded polymeric materials can be extruded in a core-sheath, islands-in-the-sea, segmented-pie, striped, or side-by-side configuration. A multi-component fiber can be processed in order to form a plurality of smaller fibers (e.g., microfibers) from a single fiber, for example, by remove a sacrificial material.

As used herein, the term "yarn" refers to an assembly formed of one or more fibers, wherein the strand has a substantial length and a relatively small cross-section, and is suitable for use in the production of textiles by hand or by machine, including textiles made using weaving, knitting, crocheting, braiding, sewing, embroidery, or ropemaking techniques. Thread is a type of yarn commonly used for sewing.

Yarns can be made using fibers formed of natural, man-made and synthetic materials. Synthetic fibers are most commonly used to make spun yarns from staple fibers, and filament yarns. Spun yarn is made by arranging and twisting staple fibers together to make a cohesive strand. The process of forming a yarn from staple fibers typically includes carding and drawing the fibers to form sliver, drawing out and twisting the sliver to form roving, and spinning the roving to form a strand. Multiple strands can be plied (twisted together) to make a thicker yarn. The twist direction of the staple fibers and of the plies can affect the final properties of the yarn. A filament yarn can be formed of a single long, substantially continuous filament, which is conventionally referred to as a "monofilament yarn," or a plurality of individual filaments grouped together. A filament yarn can also be formed of two or more long, substantially continuous filaments which are grouped together by grouping the filaments together by twisting them or entangling them or both. As with staple yarns, multiple strands can be plied together to form a thicker yarn.

Once formed, the yarn can undergo further treatment such as texturizing, thermal or mechanical treating, or coating with a material such as a synthetic polymer. The fibers, yarns, or textiles, or any combination thereof, used in the disclosed articles can be sized. Sized fibers, yarns, and/or textiles are coated on at least part of their surface with a sizing composition selected to change the absorption or wear characteristics, or for compatibility with other materials. The sizing composition facilitates wet-out and wet-through of the coating or resin upon the surface and assists in attaining desired physical properties in the final article. An exemplary sizing composition can comprise, for example, epoxy polymers, urethane-modified epoxy polymers, polyester polymers, phenol polymers, polyamide polymers, polyurethane polymers, polycarbonate polymers, polyetherimide polymers, polyamideimide polymers, polystylylpyridine polymers, polyimide polymers bismaleimide polymers, polysulfone polymers, polyethersulfone polymers, epoxy-modified urethane polymers, polyvinyl alcohol polymers, polyvinyl pyrrolidone polymers, and mixtures thereof.

Two or more yarns can be combined, for example, to form composite yarns such as single- or double-covered yarns, and core-spun yarns. Accordingly, yarns may have a variety of configurations that generally conform to the descriptions provided herein.

The yarn can comprise at least one thermoplastic material (e.g., one or more of the fibers can be made of thermoplastic material). The yarn can be made of a thermoplastic material. The yarn can be coated with a layer of a material such as a thermoplastic material.

The linear mass density or weight per unit length of a yarn can be expressed using various units, including denier (D) and tex. Denier is the mass in grams of 9000 meters of yarn. The linear mass density of a single filament of a fiber can also be expressed using denier per filament (DPF). Tex is the mass in grams of a 1000 meters of yarn. Decitex is another measure of linear mass, and is the mass in grams for a 10,000 meters of yarn.

As used herein, tenacity is understood to refer to the amount of force (expressed in units of weight, for example: pounds, grams, centinewtons or other units) needed to break a yarn (i.e., the breaking force or breaking point of the yarn), divided by the linear mass density of the yarn expressed, for example, in (unstrained) denier, decitex, or some other measure of weight per unit length. The breaking force of the yarn is determined by subjecting a sample of the yarn to a known amount of force, for example, using a strain gauge load cell such as an INSTRON brand testing system (Norwood, Mass., USA). Yarn tenacity and yarn breaking force are distinct from burst strength or bursting strength of a textile, which is a measure of how much pressure can be applied to the surface of a textile before the surface bursts.

Generally, in order for a yarn to withstand the forces applied in an industrial knitting machine, the minimum tenacity required is approximately 1.5 grams per Denier. Most yarns formed from commodity polymeric materials generally have tenacities in the range of about 1.5 grams per Denier to about 4 grams per Denier. For example, polyester yarns commonly used in the manufacture of knit uppers for footwear have tenacities in the range of about 2.5 to about 4 grams per Denier. Yarns formed from commodity polymeric materials which are considered to have high tenacities generally have tenacities in the range of about 5 grams per Denier to about 10 grams per Denier. For example, commercially available package dyed polyethylene terephthalate yarn from National Spinning (Washington, N.C., USA) has a tenacity of about 6 grams per Denier, and commercially available solution dyed polyethylene terephthalate yarn from Far Eastern New Century (Taipei, Taiwan) has a tenacity of about 7 grams per Denier. Yarns formed from high performance polymeric materials generally have tenacities of about 11 grams per Denier or greater. For example, yarns formed of aramid fiber typically have tenacities of about 20 grams per Denier, and yarns formed of ultra-high molecular weight polyethylene (UHMWPE) having tenacities greater than 30 grams per Denier are available from Dyneema (Stanley, N.C., USA) and Spectra (Honeywell-Spectra, Colonial Heights, Va., USA).

Various techniques exist for mechanically manipulating yarns to form a textile. Such techniques include, for example, interweaving, intertwining and twisting, and interlooping. Interweaving is the intersection of two yarns that cross and interweave at right angles to each other. The yarns utilized in interweaving are conventionally referred to as "warp" and "weft." A woven textile includes include a warp yarn and a weft yarn. The warp yarn extends in a first direction, and the weft strand extends in a second direction that is substantially perpendicular to the first direction. Intertwining and twisting encompasses various procedures, such as braiding and knotting, where yarns intertwine with each other to form a textile. Interlooping involves the formation of a plurality of columns of intermeshed loops, with knitting being the most common method of interlooping. The textile may be primarily formed from one or more yarns that are mechanically-manipulated, for example, through interweaving, intertwining and twisting, and/or interlooping processes, as mentioned above.

The textile can be a nonwoven textile. Generally, a nonwoven textile or fabric is a sheet or web structure made from fibers and/or yarns that are bonded together. The bond can be a chemical and/or mechanical bond, and can be formed using heat, solvent, adhesive or a combination thereof. Exemplary nonwoven fabrics are flat or tufted porous sheets that are made directly from separate fibers, molten plastic and/or plastic film. They are not made by weaving or knitting and do not necessarily require converting the fibers to yarn, although yarns can be used as a source of the fibers. Nonwoven textiles are typically manufactured by putting small fibers together in the form of a sheet or web (similar to paper on a paper machine), and then binding them either mechanically (as in the case of felt, by interlocking them with serrated or barbed needles, or hydro-entanglement such that the inter-fiber friction results in a stronger fabric), with an adhesive, or thermally (by applying binder (in the form of powder, paste, or polymer melt) and melting the binder onto the web by increasing temperature). A nonwoven textile can be made from staple fibers (e.g., from wetlaid, airlaid, carding/crosslapping processes), or extruded fibers (e.g., from meltblown or spunbond processes, or a combination thereof), or a combination thereof. Bonding of the fibers in the nonwoven textile can be achieved with thermal bonding (with or without calendering), hydro-entanglement, ultrasonic bonding, needlepunching (needlefelting), chemical bonding (e.g., using binders such as latex emulsions or solution polymers or binder fibers or powders), meltblown bonding (e.g., fiber is bonded as air attenuated fibers intertangle during simultaneous fiber and web formation), spun-bond, non-woven, carded non-woven, and a melt-blown non-woven.

In some aspect, the synthetic leather textile layer can include fibers or filaments comprising or consisting essentially of a fiber/yarn polymeric composition. The fiber/yarn polymeric composition can be thermoplastic. The fiber/yarn polymeric composition can include a polyolefin, or a polyamide, or a polyurethane, or a polyester, or a polyether polymer, or any combination thereof. The polymeric component of the fiber/yarn polymeric composition can consist essentially of one or more polyesters. The polymeric component of the fiber/yarn polymeric composition can consist essentially of one or more polyolefins. The one or more polyolefins can include or consist essentially of one or more polypropylenes.

The synthetic leather material can have a thickness of about 0.8 millimeters to about 2.5 millimeters, or about 0.9 millimeters to about 2.2 millimeters, or about 1 millimeter to about 2 millimeters, or about 1.2 millimeters to about 1.4 millimeters, or about 1.3 millimeters to about 1.5 millimeters, or about 1.4 millimeters to about 1.6 millimeters. The synthetic leather material can have a weight of about 400 to about 1,000, or about 450 to about 900, or about 500 to about 700 grams per square meter. The synthetic leather material can have a Mullen burst score in the range of 15 to 25, or of 10 to 22, as determined according to the Mullen Burst Test, described herein.

Various methods can be used to manufacture a disclosed synthetic leather material. In general, these methods have a step of bringing together the synthetic leather textile layer with the synthetic leather polymeric coating layer and/or the synthetic leather polymeric coating composition. In one aspect, the synthetic leather polymeric coating can be applied to the synthetic leather textile layer as a liquid, followed by curing or drying. The particular approach to provide the liquid polymeric coating layer(s) can be any suitable method for application of a liquid polymer composition to a textile layer, including, but not limited to, spreading onto or spraying onto the textile layer. In some instances, depending on the properties of the liquid and the manufacturing process, the liquid polymeric coating layer may impregnate the textile layer. In another aspect, the polymeric coating can be initially formed into a film, and the film is then affixed to the textile layer, either using a separate adhesive layer, or by applying a solvent which softens the film and pressure, or by applying heat to soften the film and pressure. In some aspects, affixing the synthetic leather textile layer to the synthetic leather polymeric coating layer comprises applying a liquid synthetic leather polymeric coating composition to the synthetic leather textile layer, and allowing the liquid synthetic leather polymeric coating composition to cure to a solid synthetic leather polymeric coating composition while in contact with the synthetic leather textile layer, thereby forming the synthetic leather polymeric coating layer and mechanically bonding the synthetic leather coating layer to the synthetic leather textile layer In other aspects, when a plurality of synthetic leather polymeric coating layers and/or synthetic leather polymeric coating compositions are to be applied to the synthetic leather textile layer, each polymeric coating layer or composition can be applied sequentially to the synthetic leather textile. In some aspects, one or more layers of polymeric coating compositions or layers can be applied to the synthetic leather textile layer in the form of a film, including a single layer film or a multi-layer film. For example, the single layer film can be an extruded film, or the multi-layer film can be a co-extruded multi-layer film or a laminated multi-layer film. In other aspects, one or more layers of polymeric coatings can be applied to the synthetic leather textile layer in the form of a liquid. The particular approach to provide the liquid polymeric coating layer(s) can be any suitable method for application of a liquid polymer composition to a substrate, including, but not limited to, spreading onto or spraying onto a polymeric coating layer that has been previously applied to the textile layer.

It is to be understood that the method of making a disclosed synthetic leather material can further include a step of texturizing the synthetic leather material. The texture can be applied during formation of the coating layer, or during adhesion of the coating layer and the textile layer to each other, or can be applied after affixing the textile layer and the coating layer to each other. The texture can be applied using a roller (e.g., a heated metal roller), or using a textured release paper.

In various aspects, the disclosed synthetic leather material uses a composition comprising a disclosed polyolefin resin, e.g., a polyolefin copolymer and a polymeric resin modifier, optionally with a clarifying agent, as the coating layer of the synthetic leather material, or as a clear or colored protective or decorative coating applied to the outer surface of the polymeric layer, or both.

In various aspects, the disclosed synthetic leather material uses fibers comprising a disclosed polyolefin resin, e.g., a polyolefin copolymer and a polymeric resin modifier, optionally with a clarifying agent, in the textile layer, optionally with the polyolefin-based coating or protective/decorative coating or both.

A polyolefin-based coating or protective/decorative layer can be formed by extruding a disclosed polyolefin resin composition into one or more films, which can be affixed to a textile layer.

In one aspect, a dispersion of a polyolefin resin composition, for example a water-borne dispersion, can be sprayed onto the textile layer, impregnating the textile layer and forming the synthetic leather material.

As noted above, it is believed that one advantage of using a disclosed polyolefin resin composition to form an outer surface of a disclosed synthetic leather material (i.e., the polymeric coating layer or the protective/decorative layer on the "top" or "front" side of the synthetic leather material) is that it provides an outer layer of the synthetic leather material which is easier to bond to other polyolefin-based polymers. For example, the bond score of a synthetic leather material having polyolefin-based solid resin components (e.g., a polypropylene-based plate) is improved as compared to PU-based or PVC-based synthetic leather materials.

In various further aspects, it is believed that an advantage of using a disclosed polyolefin resin composition to form at least a portion of the fibers present in the synthetic leather textile layer of the synthetic leather (the "bottom" or "back" side of the synthetic leather material) is that it creates an outer layer of the synthetic leather material which is easier to bond to other polyolefin-based polymers. For example, the bond score with polyolefin-based solid resin components (such as a polypropylene-based plate) is improved as compared to PU-based or PVC-based synthetic leather materials.

Additionally or alternatively, when a synthetic leather material having a synthetic leather polymeric coating layer and/or a synthetic leather protective/decorative layer comprising a disclosed polyolefin resin composition, is that the fibers present in the textile layer of the synthetic leather material (the "bottom" or "back" side of the synthetic leather material) can be formed of other polymers, such as TPUs, polyesters or nylons, and can be substantially free of polyolefin-based fibers. In this instance, the "front" of the synthetic leather material can be easier to bond to other polyolefin-based polymers, while the "back" of the synthetic leather material is easier to bond to other polyester or nylon-based materials.

In some aspects, the synthetic leather textile layer comprises lower-melting thermoplastic fibers or yarns (e.g., having a melting or softening temperature below about 150 degrees centigrade, or having a melting or softening temperature that is at least 20 degrees centigrade lower than the softening temperature of the polymeric coating layer and, if present, the protective/decorative layer). In such an instance, it is believed that an advantage of using lower-melting thermoplastic fibers or yarns in the synthetic leather textile layer is that it provides a synthetic leather material in which the "back" textile layer can be thermally bonded to another component, without affecting the appearance of the "front" of the synthetic leather material.

In has been previously observed that conventional materials comprising polyolefin resins that coloration of polyolefins can be more difficult than for other polymers. For example, unlike many synthetic, natural and regenerated fibers, it can be difficult to package dye polyolefin fibers. However, such issues can be obviated in the present disclosure by using package dyed fibers that are substantially free of polyolefins in the textile layer in combination with a clear or nearly clear polyolefin-based coating layer.

Polymeric Materials

In various aspects, disclosed herein are compositions and materials, e.g., textiles, polymeric coating layers, and protective or decorative layers that comprise one or more polymeric materials, such as a thermoplastic polymeric material. The polymers utilized in preparation of the disclosed compositions and materials can include polymers of the same or different types of monomers (e.g., homopolymers and copolymers, including terpolymers). In certain aspects, the polymers can include different monomers randomly distributed in the polymer (e.g., a random co-polymer). The term "polymer" refers to a polymerized molecule having one or more monomer species that can be the same or different. When the monomer species are the same, the polymer can be termed homopolymer and when the monomers are different, the polymer can be referred to as a copolymer. The term "copolymer" is a polymer having two or more types of monomer species, and includes terpolymers (i.e., copolymers having three monomer species). In an aspect, the "monomer" can include different functional groups or segments, but for simplicity is generally referred to as a monomer.

For example, the polymer can be a polymer having repeating polymeric units of the same chemical structure (segments) which are relatively harder (hard segments), and repeating polymeric segments which are relatively softer (soft segments). In various aspects, the polymer has repeating hard segments and soft segments. Physical crosslinks can be present within the segments or between the segments or both within and between the segments. Particular examples of hard segments include isocyanate segments. Particular examples of soft segments include an alkoxy group such as polyether segments and polyester segments. As used herein, the polymeric segment can be referred to as being a particular type of polymeric segment such as, for example, an isocyanate segment (e.g., diisocynate segment), an alkoxy polyamide segment (e.g., a polyether segment, a polyester segment), and the like. It is understood that the chemical structure of the segment is derived from the described chemical structure. For example, an isocyanate segment is a polymerized unit including an isocyanate functional group. When referring to polymeric segments of a particular chemical structure, the polymer can contain up to 10 mole percent of segments of other chemical structures. For example, as used herein, a polyether segment is understood to include up to 10 mole percent of non-polyether segments.

In certain aspects, the polymer can be a thermoplastic polyurethane (also referred to as "TPU"). The polyurethane polymer can include hard and soft segments. In aspects, the hard segments can comprise or consist of isocyanate segments (e.g., diisocyanate segments). In the same or alternative aspects, the soft segments can comprise or consist of alkoxy segments (e.g., polyether segments, or polyester segments, or a combination of polyether segments and polyester segments). In a particular aspect, the thermoplastic material can comprise or consist essentially of an elastomeric thermoplastic polyurethane having repeating hard segments and repeating soft segments.

Polyamides

In various aspects, the polymer can comprise a polyamide, including a thermoplastic polyamide. The polyamide can be a polyamide homopolymer having repeating polyamide segments of the same chemical structure. Alternatively, the polyamide can comprise a number of polyamide segments having different polyamide chemical structures (e.g., polyamide 6 segments, polyamide 11 segments, polyamide 12 segments, polyamide 66 segments, etc.). The polyamide segments having different chemical structure can be arranged randomly, or can be arranged as repeating blocks.

The polyamide can be a co-polyamide (i.e., a co-polymer including polyamide segments and non-polyamide segments). The polyamide segments of the co-polyamide can comprise or consist of polyamide 6 segments, polyamide 11 segments, polyamide 12 segments, polyamide 66 segments, or any combination thereof. The polyamide segments of the co-polyamide can be arranged randomly, or can be arranged as repeating segments. In a particular example, the polyamide segments can comprise or consist of polyamide 6 segments, or polyamide 12 segments, or both polyamide 6 segment and polyamide 12 segments. In the example where the polyamide segments of the co-polyamide include of polyamide 6 segments and polyamide 12 segments, the segments can be arranged randomly. The non-polyamide segments of the co-polyamide can comprise or consist of polyether segments, polyester segments, or both polyether segments and polyester segments. The co-polyamide can be a co-polyamide, or can be a random co-polyamide. The thermoplastic copolyamide can be formed from the polycondensation of a polyamide oligomer or prepolymer with a second oligomer prepolymer to form a copolyamide (i.e., a co-polymer including polyamide segments. Optionally, the second prepolymer can be a hydrophilic prepolymer.

In aspects, the polyamide can be a block co-polyamide. For example, the block co-polyamide can have repeating hard segments, and repeating soft segments. The hard segments can comprise polyamide segments, and the soft segments can comprise non-polyamide segments. The polymer can be an elastomeric co-polyamide comprising or consisting of block co-polyamides having repeating hard segments and repeating soft segments. In block co-polymers, including block co-polymers having repeating hard segments and soft segments, physical crosslinks can be present within the segments or between the segments or both within and between the segments. In one aspect, the polyamide can be a poly(ether block amide) polymer.

Exemplary commercially available polyamide copolymers include, but are not limited to, those available under the tradenames of "VESTAMID" (Evonik Industries); "PLATAMID" (Arkema), e.g., product code H2694; "PEBAX" (Arkema), e.g., product code "PEBAX MH1657" and "PEBAX MV1074"; "PEBAX RNEW" (Arkema); "GRILAMID" (EMS-Chemie AG), or also to other similar materials produced by various other suppliers.

Polyesters

In aspects, the polymers can comprise a polyester, including a thermoplastic polyester. The polyester can be formed by reaction of one or more carboxylic acids, or its ester-forming derivatives, with one or more bivalent or multivalent aliphatic, alicyclic, aromatic or araliphatic alcohols or a bisphenol. The polyester can be a polyester homopolymer having repeating polyester segments of the same chemical structure. Alternatively, the polyester can comprise a number of polyester segments having different polyester chemical structures (e.g., polyglycolic acid segments, polylactic acid segments, polycaprolactone segments, polyhydroxyalkanoate segments, polyhydroxybutyrate segments, etc.). The polyester segments having different chemical structure can be arranged randomly, or can be arranged as repeating blocks.

In some aspects, the polyester is a polybutylene terephthalate (PBT), a polytrimethylene terephthalate, a polyhexamethylene terephthalate, a poly-1,4-dimethylcyclohexane terephthalate, a polyethylene terephthalate (PET), a polyethylene isophthalate (PEI), a polyarylate (PAR), a polybutylene naphthalate (PBN), a liquid crystal polyester, or a blend or mixture of two or more of the foregoing.

The polyester can be a co-polyester (i.e., a co-polymer including polyester segments and non-polyester segments). The co-polyester can be an aliphatic co-polyester (i.e., a co-polyester in which both the polyester segments and the non-polyester segments are aliphatic). Alternatively, the co-polyester can include aromatic segments. The polyester segments of the co-polyester can comprise or consist of polyglycolic acid segments, polylactic acid segments, polycaprolactone segments, polyhydroxyalkanoate segments, polyhydroxybutyrate segments, or any combination thereof. The polyester segments of the co-polyester can be arranged randomly, or can be arranged as repeating blocks.

For example, the polyester can be a block co-polyester having repeating blocks of polymeric units of the same chemical structure (segments) which are relatively harder (hard segments), and repeating blocks of polymeric segments which are relatively softer (soft segments). In block co-polyesters, including block co-polyesters having repeating hard segments and soft segments, physical crosslinks can be present within the blocks or between the blocks or both within and between the blocks. In one aspect, material can comprise or consist essentially of an elastomeric thermoplastic co-polyester having repeating blocks of hard segments and repeating blocks of soft segments.

The non-polyester segments of the co-polyester can comprise or consist of polyether segments, polyamide segments, or both polyether segments and polyamide segments. The co-polyester can be a block co-polyester, or can be a random co-polyester. The thermoplastic co-polyester can be formed from the polycondensation of a polyester oligomer or prepolymer with a second oligomer prepolymer to form a block copolyester. Optionally, the second prepolymer can be a hydrophilic prepolymer. For example, the co-polyester can be formed from the polycondensation of terephthalic acid or naphthalene dicarboxylic acid with ethylene glycol, 1,4-butanediol, or 1-3 propanediol. Examples of co-polyesters include polyethelene adipate, polybutylene succinate, poly (3-hydroxybutyrate-co-3-hydroxyvalerate), polyethylene terephthalate, polybutylene terephthalate, polytrimethylene terephthalate, polyethylene napthalate, and combinations thereof. In a particular example, the co-polyamide can comprise or consist of polyethylene terephthalate.

In some aspects, the polyester is a block copolymer comprising segments of one or more of polybutylene terephthalate (PBT), a polytrimethylene terephthalate, a polyhexamethylene terephthalate, a poly-1,4-dimethylcyclohexane terephthalate, a polyethylene terephthalate (PET), a polyethylene isophthalate (PEI), a polyarylate (PAR), a polybutylene naphthalate (PBN), and a liquid crystal polyester. For example, a suitable thermoplastic polyester that is a block copolymer can be a PET/PEI copolymer, a polybutylene terephthalate/tetraethylene glycol copolymer, a polyoxyalkylenediimide diacid/polybutylene terephthalate copolymer, or a blend or mixture of any of the foregoing.

Polyolefins

In some aspects, the polymers can comprise or consist essentially of a polyolefin, including a thermoplastic polyolefin. Exemplary polyolefins include, but are not limited to, polyethylene, polypropylene, and thermoplastic olefin elastomers (e.g., metallocene-catalyzed block copolymers of ethylene and $\alpha$-olefins having 4 to about 8 carbon atoms). In a further aspect, the polyolefin is a polymer comprising a polyethylene, an ethylene-$\alpha$-olefin copolymer, an ethylene-propylene rubber (EPDM), a polybutene, a polyisobutylene, a poly-4-methylpent-1-ene, a polyisoprene, a polybutadiene, an ethylene-methacrylic acid copolymer, and an olefin elastomer such as a dynamically cross-linked polymer obtained from polypropylene (PP) and an ethylene-propylene rubber (EPDM), and blends or mixtures of the foregoing. Further exemplary polyolefins include polymers of cycloolefins such as cyclopentene or norbornene.

It is to be understood that polyethylene, which optionally can be crosslinked, is inclusive a variety of polyethylenes, including, but not limited to, low density polyethylene (LDPE), linear low density polyethylene (LLDPE), (VLDPE) and (ULDPE), medium density polyethylene (MDPE), high density polyethylene (HDPE), high density and high molecular weight polyethylene (HDPE-HMW), high density and ultrahigh molecular weight polyethylene (HDPE-UHMW), and blends or mixtures of any the foregoing polyethylenes. A polyethylene can also be a polyethylene copolymer derived from monomers of monoolefins and diolefins copolymerized with a vinyl, acrylic acid, methacrylic acid, ethyl acrylate, vinyl alcohol, and/or vinyl acetate. Polyolefin copolymers comprising vinyl acetate-derived units can be a high vinyl acetate content copolymer, e.g., greater than about 50 wt percent vinyl acetate-derived composition.

In some aspects, the polyolefin can be formed through free radical, cationic, and/or anionic polymerization by methods well known to those skilled in the art (e.g., using a peroxide initiator, heat, and/or light). In a further aspect, the disclosed thermoplastic polyolefin can be prepared by radical polymerization under high pressure and at elevated temperature. Alternatively, the polyolefin can be prepared by catalytic polymerization using a catalyst that normally contains one or more metals from group IVb, Vb, VIb or VIII metals. The catalyst usually has one or more than one ligand, typically oxides, halides, alcoholates, esters, ethers, amines, alkyls, alkenyls and/or aryls that can be either p- or s-coordinated complexed with the group IVb, Vb, VIb or VIII metal. In various aspects, the metal complexes can be in the free form or fixed on substrates, typically on activated magnesium chloride, titanium (III) chloride, alumina, or silicon oxide. It is understood that the metal catalysts can be soluble or insoluble in the polymerization medium. The catalysts can be used by themselves in the polymerization or further activators can be used, typically a group Ia, IIa and/or IIIa metal alkyls, metal hydrides, metal alkyl halides, metal alkyl oxides or metal alkyloxanes. The activators can be modified conveniently with further ester, ether, amine or silyl ether groups.

Suitable polyolefins can be prepared by polymerization of monomers of monoolefins and diolefins as described herein. Exemplary monomers that can be used to prepare disclosed thermoplastic polyolefin include, but are not limited to, ethylene, propylene, 1-butene, 1-pentene, 1-hexene, 2-methyl-1-propene, 3-methyl-1-pentene, 4-methyl-1-pentene, 5-methyl-1-hexene and mixtures thereof.

Suitable ethylene-α-olefin copolymers can be obtained by copolymerization of ethylene with an α-olefin such as propylene, butene-1, hexene-1, octene-1,4-methyl-1-pentene or the like having carbon numbers of 3 to 12.

Suitable dynamically cross-linked polymers can be obtained by cross-linking a rubber component as a soft segment while at the same time physically dispersing a hard segment such as PP and a soft segment such as EPDM by using a kneading machine such as a Banbury mixer and a biaxial extruder.

In some aspects, the polyolefin can be a mixture of polyolefins, such as a mixture of two or more polyolefins disclosed herein above. For example, a suitable mixture of polyolefins can be a mixture of polypropylene with polyisobutylene, polypropylene with polyethylene (for example PP/HDPE, PP/LDPE) or mixtures of different types of polyethylene (for example LDPE/HDPE).

In some aspects, the polyolefin can be a copolymer of suitable monoolefin monomers or a copolymer of a suitable monoolefin monomer and a vinyl monomer. Exemplary polyolefin copolymers include, but are not limited to, ethylene/propylene copolymers, linear low density polyethylene (LLDPE) and mixtures thereof with low density polyethylene (LDPE), propylene/but-1-ene copolymers, propylene/isobutylene copolymers, ethylene/but-1-ene copolymers, ethylene/hexene copolymers, ethylene/methylpentene copolymers, ethylene/heptene copolymers, ethylene/octene copolymers, propylene/butadiene copolymers, isobutylene/isoprene copolymers, ethylene/alkyl acrylate copolymers, ethylene/alkyl methacrylate copolymers, ethylene/vinyl acetate copolymers and their copolymers with carbon monoxide or ethylene/acrylic acid copolymers and their salts (ionomers) as well as terpolymers of ethylene with propylene and a diene such as hexadiene, dicyclopentadiene or ethylidene-norbornene; and mixtures of such copolymers with one another and with polymers mentioned in 1) above, for example polypropylene/ethylene-propylene copolymers, LDPE/ethylene-vinyl acetate copolymers (EVA), LDPE/ethylene-acrylic acid copolymers (EAA), LLDPE/EVA, LLDPE/EAA and alternating or random polyalkylene/carbon monoxide copolymers and mixtures thereof with other polymers, for example polyamides.

In some aspects, the polyolefin can be a polypropylene homopolymer, a polypropylene copolymers, a polypropylene random copolymer, a polypropylene block copolymer, a polyethylene homopolymer, a polyethylene random copolymer, a polyethylene block copolymer, a low density polyethylene (LDPE), a linear low density polyethylene (LLDPE), a medium density polyethylene, a high density polyethylene (HDPE), or blends or mixtures of one or more of the preceding polymers.

In some aspects, the polyolefin is a polypropylene. The term "polypropylene," as used herein, is intended to encompass any polymeric composition comprising propylene monomers, either alone or in mixture or copolymer with other randomly selected and oriented polyolefins, dienes, or other monomers (such as ethylene, butylene, and the like). Such a term also encompasses any different configuration and arrangement of the constituent monomers (such as atactic, syndiotactic, isotactic, and the like). Thus, the term as applied to fibers is intended to encompass actual long strands, tapes, threads, and the like, of drawn polymer. The polypropylene can be of any standard melt flow (by testing); however, standard fiber grade polypropylene resins possess ranges of Melt Flow Indices between about 1 and 1000.

In some aspects, the polyolefin is a polyethylene. The term "polyethylene," as used herein, is intended to encompass any polymeric composition comprising ethylene monomers, either alone or in mixture or copolymer with other randomly selected and oriented polyolefins, dienes, or other monomers (such as propylene, butylene, and the like). Such a term also encompasses any different configuration and arrangement of the constituent monomers (such as atactic, syndiotactic, isotactic, and the like). Thus, the term as applied to fibers is intended to encompass actual long strands, tapes, threads, and the like, of drawn polymer. The polyethylene can be of any standard melt flow (by testing); however, standard fiber grade polyethylene resins possess ranges of Melt Flow Indices between about 1 and 1000.

Methods of Making Resin Compositions

In various aspects, this disclosure describes various polymeric compositions, including polyolefin resin compositions, synthetic leather polymeric coating compositions, and fiber/yarn polymeric compositions. The polymeric compositions can be made by dry blending, or by melt blending the various ingredients. Methods of blending polymers can include film blending in a press, blending in a mixer (e.g. mixers commercially available under the tradename "HAAKE" from Thermo Fisher Scientific, Waltham, Mass.), solution blending, hot melt blending, and extruder blending. In some aspects, the polymeric resin modifier and polyolefin copolymer are miscible such that they can be readily mixed by the screw in the injection barrel during injection molding, e.g. without the need for a separate blending step.

The methods can further include extruding the polymeric composition to form an extruded polymeric composition. The methods of extruding the polymeric composition can include manufacturing long products of relatively constant cross-section (rods, sheets, pipes, films, wire insulation coating). The methods of extruding the polymeric composition can include conveying a softened polymeric composition through a die with an opening. The polymeric composition can be conveyed forward by a feeding screw and forced through the die. Heating elements, placed over the barrel, can soften and melt the polymeric composition. The temperature of the polymeric composition can be controlled by thermocouples. The polymeric composition going out of the die can be cooled by blown air or in a water bath to form the extruded polymeric composition. Alternatively, the polymeric composition going out of the die can be pelletized with little cooling as described below.

The method can further include injection molding the polymeric composition to form an article. The injection molding can include the use of a non-rotating, cold plunger to force the polymeric composition through a heated cylinder wherein the polymeric composition is heated by heat conducted from the walls of the cylinder to the polymeric composition. The injection molding can include the use of a rotating screw, disposed co-axially of a heated barrel, for conveying the polymeric composition toward a first end of the screw and to heat the polymeric composition by the conduction of heat from the heated barrel to the polymeric composition. As the polymeric composition is conveyed by the screw mechanism toward the first end, the screw is translated toward the second end so as to produce a reservoir space at the first end. When sufficient melted polymeric composition is collected in the reservoir space, the screw mechanism can be pushed toward the first end so as to inject the polymeric composition into a selected mold.

Methods of Making Components and Articles

The disclosure provides several methods for making components and articles described herein. The methods comprise affixing a synthetic leather material to a second element to form the component or article. The second element can include a textile or multilayer film. For example, the second element can include an upper. The second element can include one or both of polyolefin fibers and polyolefin yarns. The second element can comprise an injection molded element. The methods can further include injection molding a polymeric composition as described herein, including a polyolefin resin composition, to form the injection molded second element. The disclosure provides methods for manufacturing a component for an article of footwear, apparel or sporting equipment.

In some aspects, a polyolefin resin composition defines a side or outer layer of the second element, and the method includes affixing together two sides or outer layers each of which is defined by a polyolefin resin composition. The second element can include a yarn, a textile, a film, or some other element. Affixing the component to the second element can include directly injecting a polymeric composition, such as a polyolefin resin composition, onto the second element. Affixing the component to the second element can include forming a mechanical bond between the polymeric composition and the second element. The mechanical bond can include a textile bonded at the interface between the component and the second element. Affixing the component to the second element can include (i) increasing a temperature of the polymeric composition to a first temperature above a melting or softening temperature (e.g., the Vicat softening temperature) of the polymeric composition, (ii) contacting the polymeric composition and the second element while the polymeric composition is at the first temperature, and (iii) keeping the polymeric composition and the second element in contact with each other while decreasing the temperature of the polymeric composition to a second temperature below the melting or softening temperature of the polymeric composition, forming a thermal bond between the polymeric composition and the second element.

The second element can comprise a second polymeric composition which is thermoplastic (e.g., a second thermoplastic composition), and affixing the component to the second element can include (i) increasing a temperature of the second thermoplastic composition to a first temperature above a melting or softening temperature of the second thermoplastic composition, (ii) contacting the polymeric composition and the second element with each other while the second thermoplastic composition is at the first temperature, and (iii) keeping the polymeric composition and the second element in contact with each other while decreasing the temperature of the second thermoplastic composition to a second temperature below the melting or softening temperature of the second thermoplastic composition, forming a thermal bond between the polymeric composition and the second element.

The polymeric composition can be a first thermoplastic composition, and the second element can include a second thermoplastic composition, and affixing the component to the second element can include (i) increasing a temperature of both the first thermoplastic composition and the second thermoplastic composition to a first temperature above both a melting or softening temperature of the first thermoplastic composition and a melting or softening temperature of the second thermoplastic composition, (ii) contacting the first thermoplastic composition and the second thermoplastic composition with each other while both the first thermoplastic composition and the second thermoplastic composition are at the first temperature, and (iii) keeping the first thermoplastic composition and the second thermoplastic composition in contact with each other while decreasing the temperature of both the first thermoplastic composition and the second thermoplastic composition to a second temperature below both the melting or softening temperature of the first thermoplastic composition and the melting or softening temperature of the second thermoplastic composition, forming a thermal bond between the first thermoplastic composition and the second thermoplastic composition in which polymer chains of the first thermoplastic composition and the second thermoplastic composition intermingle with each other.

In some aspects, the article is an article of footwear and the method includes injection molding a plate directly onto the upper. Property Analysis and Characterization Procedures Cold Ross Flex Test Protocol The cold Ross flex test is determined according the following test method. The purpose of this test is to evaluate the resistance to cracking of a sample under repeated flexing to 60 degrees in a cold environment. A thermoformed plaque of the material for testing is sized to fit inside the flex tester machine. Each material is tested as five separate samples. The flex tester machine is capable of flexing samples to 60 degrees at a rate of 100 plus or minus 5 cycles per minute. The mandrel diameter of the machine is 10 millimeters. Suitable machines for this test are the Emerson AR-6, the Satra STM141F, the Gotech GT-7006, and the Shin II Scientific SI-LTCO (DaeSung Scientific). The sample(s) are inserted into the machine according to the specific parameters of the flex machine used. The machine is placed in a freezer set to −6 degrees Celsius for the test. The motor is turned on to begin flexing with the flexing cycles counted until the sample cracks. Cracking of the sample means that the surface of the material is physically split. Visible creases of lines that do not actually penetrate the surface are not cracks. The sample is measured to a point where it has cracked but not yet broken in two.

Abrasion Loss Test Protocol ASTM D 5963-97a

Abrasion loss is tested on cylindrical test pieces with a diameter of 16 plus or minus 0.2 millimeter and a minimum thickness of 6 millimeters cut from sheets using a ASTM standard hole drill. The abrasion loss is measured using Method B of ASTM D 5963-97a on a Gotech GT-7012-D abrasion test machine. The tests are performed as 22 degrees Celsius with an abrasion path of 40 meters. The Standard Rubber #1 used in the tests has a density of 1.336 grams per cubic centimeter (g/cm$^3$). The smaller the abrasion loss volume, the better the abrasion resistance.

Crystallinity Test Protocol

To determine percent crystallinity of a resin composition including a copolymer, or of the copolymer in neat resin form, and of a homopolymer of the main component of the copolymer (e.g., polypropylene homopolymer polypropylene), samples are analyzed by differential scanning calorimetry (DSC) over the temperature range from −80 degrees Celsius to 250 degrees Celsius. A heating rate of 10 degrees Celsius per minute is used. The melting endotherm is measured for each sample during heating. Universal Analysis software (TA Instruments, New Castle, Del., USA) is used to calculate percent crystallinity (% crystallinity) based upon the melting endotherm for the homopolymer (e.g., 207 Joules per gram for 100 percent crystalline polypropylene material). Specifically, the percent crystallinity (% crystallinity) is calculated by dividing the melting endotherm measured for the copolymer or for the resin composition by the 100 percent crystalline homopolymer melting endotherm.

Method to Determine the Vicat Softening Temperature Test Protocol

The Vicat softening temperature is be determined according to the test method detailed in ASTM $T_m$ D1525-09 Standard Test Method for Vicat Softening Temperature of Plastics, preferably using Load A and Rate A. Briefly, the Vicat softening temperature is the temperature at which a flat-ended needle penetrates the specimen to the depth of 1 millimeter under a specific load. The temperature reflects the point of softening expected when a material is used in an elevated temperature application. It is taken as the temperature at which the specimen is penetrated to a depth of 1 millimeter by a flat-ended needle with a 1 square millimeter$^2$ circular or square cross-section. For the Vicat A test, a load of 10 Newtons (N) is used, whereas for the Vicat B test, the load is 50 Newtons. The test involves placing a test specimen in the testing apparatus so that the penetrating needle rests on its surface at least 1 millimeter from the edge. A load is applied to the specimen per the requirements of the Vicat A or Vicat B test. The specimen is then lowered into an oil bath at 23° C. degrees Celsius. The bath is raised at a rate of 50 degrees Celsius or 120 degrees Celsius per hour until the needle penetrates 1 millimeter. The test specimen must be between 3 and 6.5 millimeter thick and at least 10 millimeter in width and length. No more than three layers can be stacked to achieve minimum thickness.

Melting Temperature and Glass Transition Temperature Test Protocol

The melting temperature and glass transition temperature are determined using a commercially available Differential Scanning calorimeter ("DSC") in accordance with ASTM D3418-97. Briefly, a 10-15 gram sample is placed into an aluminum DSC pan and then the lead was sealed with the crimper press. The DSC is configured to scan from −100 degrees Celsius to 225 degrees Celsius with a 20 degrees Celsius/minute heating rate, hold at 225 degrees Celsius for 2 minutes, and then cool down to 25 degrees Celsius at a rate of −10 degrees Celsius/minute. The DSC curve created from this scan is then analyzed using standard techniques to determine the glass transition temperature and the melting temperature.

Melt Flow Index Test Protocol.

The melt flow index is determined according to the test method detailed in ASTM D1238-13 Standard Test Method for Melt Flow Rates of Thermoplastics by Extrusion Plastometer, using Procedure A described therein. Briefly, the melt flow index measures the rate of extrusion of thermoplastics through an orifice at a prescribed temperature and load. In the test method, approximately 7 grams of the material is loaded into the barrel of the melt flow apparatus, which has been heated to a temperature specified for the material. A weight specified for the material is applied to a plunger and the molten material is forced through the die. A timed extrudate is collected and weighed. Melt flow rate values are calculated in grams per 10 minutes. Alternatively, melt flow index can be determined using International Standard ISO1133 Determination of the Melt Mass-Flow Rate (MFR) and Melt Volume-Flow Rate (MVR) of Thermoplastics using Procedure A described therein, at 190 degrees Celsius and a load of 2.16 kilograms.

Durometer Hardness Test Protocol

The hardness of a material is determined according to the test method detailed in ASTM D-2240 Durometer Hardness, using a Shore A scale.

Flexural Modulus Test Protocol

The flexural modulus (modulus of elasticity) for a material is determined according to the test method detailed in ASTM D790. The modulus is calculated by taking the slope of the stress (megapascals) versus the strain in the steepest initial straight-line portion of the load-deflection curve.

Modulus Test Protocol (of plaque).

The (tensile) modulus for a thermoformed plaque of material is determined according to the test method detailed in ASTM D412-98 Standard Test Methods for Vulcanized Rubber and Thermoplastic Rubbers and Thermoplastic Elastomers-Tension, with the following modifications. The sample dimension is the ASTM D412-98 Die C, and the sample thickness used is 2.0 millimeters plus or minus 0.5 millimeters. The grip type used is a pneumatic grip with a metal serrated grip face. The grip distance used is 75 millimeters. The loading rate used is 500 millimeters per minute. The modulus (initial) is calculated by taking the slope of the stress in megapascals (MPa) versus the strain in the initial linear region.

Modulus Test Protocol (of yarn).

The modulus for a yarn is determined according to the test method detailed in EN ISO 2062 (Textiles-Yarns from Packages)—Determination of Single-End Breaking Force and Elongation at Break Using Constant Rate of Extension (CRE) Tester, with the following modifications. The sample length used is 600 millimeters. The equipment used is an Instron and Gotech Fixture. The grip distance used is 250 millimeters. The pre-loading is set to 5 grams and the loading rate used is 250 millimeters per minute. The first meter of yarn is thrown away to avoid using damaged yarn. The modulus (initial) is calculated by taking the slope of the stress in megapascals (MPa) versus the strain in the initial linear region.

Tenacity and Elongation Test Protocol.

The tenacity and elongation of yarn can be determined according to the test method detailed in EN ISO 2062 Determination of single end breaking force and elongation at break using constant rate of extension tester with the pre-load set to 5 grams.

Mullen Burst Test Protocol

The Mullen burst of a web of material, such as textile or synthetic leather material, can be determined according to the test method detailed in ASTM D3786, Standard Test Method for Bursting Strength of Textile Fabrics.

Sampling Procedures

Using the Test Protocols described above, various properties of the materials disclosed herein and components and other articles formed therefrom can be characterized using samples prepared with the following sampling procedures:

Neat Material Sampling Procedure

A material sampling procedure can be used to obtain a neat sample of a polymer or a polymeric composition. The material is provided in media form, such as flakes, granules, powders, pellets, and the like. If a source of the polymer or polymeric composition is not available in a neat form, the sample can be cut from a film or plate or other component containing the polymeric composition, thereby isolating a sample of the material.

Plaque Sampling Procedure

A sample of a polymer or a polymeric composition is prepared A portion of the polymer or polymeric composition is then molded into a film or plaque sized to fit inside the testing apparatus. For example, when using a Ross flexing tester, the film or plaque is sized to fit inside the Ross flexing tester used, the plaque having dimensions of about 15 centimeters (cm) by 2.5 centimeters (cm) and a thickness of about 1 millimeter (mm) to about 4 millimeters (mm) by thermoforming the polymer or polymeric composition in a mold, or extruding the polymer or polymeric composition into a film and cutting the film to size. A plaque sample is prepared by mixing the components of the polymer or polymeric composition together, melting the components, pouring or injecting the melted polymer or polymeric composition into the mold cavity, cooling the melted polymer or composition to solidify it in the mold cavity to form the plaque, and then removing the solid plaque from the mold cavity.

Component Sampling Procedure

This procedure can be used to obtain a sample of a polymer or polymeric composition from an article or component of an article, such as an article of footwear, apparel or sporting equipment. A sample including the polymer or polymeric composition in a non-wet state (e.g., at 25 degrees Celsius and 20 percent relative humidity) is cut from the article or component using a blade. If the polymer or polymeric composition is bonded to one or more additional materials, the procedure can include separating the additional materials from the polymer or polymeric composition to be tested. For example, to test a polymer or polymeric composition on a bottom surface of a sole structure, such as an outsole, the top surface can be skinned, abraded, scraped, or otherwise cleaned to remove any adhesives, yarns, fibers, foams, and the like which are affixed to the polymer or polymeric material to be tested. The resulting sample includes the polymer or polymeric composition and may include any additional materials bonded to it.

Definitions

Unless defined otherwise, all technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

All publications, patents, and patent applications cited in this specification are cited to disclose and describe the methods and/or materials in connection with which the publications are cited. All such publications, patents, and patent applications are herein incorporated by references as if each individual publication or patent were specifically and individually indicated to be incorporated by reference. Such incorporation by reference is expressly limited to the methods and/or materials described in the cited publications, patents, and patent applications and does not extend to any lexicographical definitions from the cited publications, patents, and patent applications. Any lexicographical definition in the publications, patents, and patent applications cited that is not also expressly repeated in the instant specification should not be treated as such and should not be read as defining any terms appearing in the accompanying claims.

Although any methods and materials similar or equivalent to those described herein can also be used in the practice or testing of the present disclosure, the preferred methods and materials are now described. Functions or constructions well-known in the art may not be described in detail for brevity and/or clarity. Aspects of the present disclosure will employ, unless otherwise indicated, techniques of nanotechnology, organic chemistry, material science and engineering and the like, which are within the skill of the art. Such techniques are explained fully in the literature.

It should be noted that ratios, concentrations, amounts, and other numerical data can be expressed herein in a range format. Where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'". It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., 1%, 2%, 3%, and 4%) and the sub-ranges (e.g., 0.5%, 1.1%, 2.4%, 3.2%, and 4.4%) within the indicated range.

The term "providing," as used herein and as recited in the claims, is not intended to require any particular delivery or receipt of the provided item. Rather, the term "providing" is merely used to recite items that will be referred to in subsequent elements of the claim(s), for purposes of clarity and ease of readability.

The terms and phrases used herein to refer to sampling procedures and testing protocols, for example, "Neat Material Sampling Procedure", "Plaque Sampling Procedure", "Cold Ross Flex Test", "ASTM D 5963-97a", "Crystallinity Test," and the like, refer to the respective sampling procedures and test methodologies described in the Property Analysis and Characterization Procedure section. These sampling procedures and test methodologies characterize the properties of the recited materials, films, articles and components, and the like, and are not required to be performed as active steps in the claims.

The term "about," as used herein, can include traditional rounding according to significant figures of the numerical value. In some aspects, the term about is used herein to mean a deviation of 10%, 5%, 2.5%, 1%, 0.5%, 0.1%, 0.01%, or less from the specified value.

The articles "a" and "an," as used herein, mean one or more when applied to any feature in aspects of the present disclosure described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

A random copolymer of propylene with about 2.2 percent by weight (wt %) ethylene is commercially available under the tradename "PP9054" from ExxonMobil Chemical Company, Houston, Tex. It has a MFR (ASTM-1238D, 2.16 kilograms, 230° C.) of about 12 grams/10 minutes and a density of 0.90 grams/cubic centimeter (g/cm$^3$).

PP9074 is a random copolymer of propylene with about 2.8 weight by weight (wt %) ethylene and is commercially available under the tradename "PP9074" from ExxonMobil Chemical Company, Houston, Tex. It has a MFR (ASTM-1238D, 2.16 kilograms, 230° C.) of about 24 grams/10 minutes and a density of 0.90 grams/cubic centimeter (g/cm$^3$).

PP1024E4 is a propylene homopolymer commercially available under the tradename "PP1024E4" from ExxonMobil Chemical Company, Houston, Tex. It has an MFR (ASTM-1238D, 2.16 kilograms, 230° C.) of about 13 grams/10 minutes and a density of 0.90 grams/cubic centimeter (g/cm$^3$).

"VISTAMAXX 6202" is a copolymer primarily composed of isotactic propylene repeat units with about 15 percent by weight (wt %) of ethylene repeat units randomly distributed along the copolymer. It is a metallocene catalyzed copolymer available from ExxonMobil Chemical Company, Houston, Tex. and has an MFR (ASTM-1238D, 2.16 kilograms, 230° C.) of about 20 grams/10 minutes, a density of 0.862 grams/cubic centimeter (g/cm$^3$), and a Durometer Hardness of about 64 (Shore A).

"VISTAMAXX 3000" is a copolymer primarily composed of isotactic propylene repeat units with about 11 percent by weight (wt %) of ethylene repeat units randomly distributed along the copolymer. It is a metallocene catalyzed copolymer available from ExxonMobil Chemical Company and has an MFR (ASTM-1238D, 2.16 kilograms, 230° C.) of about 8 grams/10 minutes, a density of 0.873 grams/cubic centimeter (g/cm$^3$), and a Durometer Hardness of about 27 (Shore D).

"VISTAMAXX 6502" is a copolymer primarily composed of isotactic propylene repeat units with about 13 percent by weight of ethylene repeat units randomly distributed along the copolymer. It is a metallocene catalyzed copolymer available from ExxonMobil Chemical Company and has an MFR (ASTM-1238D, 2.16 kilograms, 230° C.) of about 45 grams/10 minutes, a density of 0.865 grams/cubic centimeter (g/cm$^3$), and a Durometer Hardness of about 71 (Shore A).

EXAMPLES

Now having described the aspects of the present disclosure, in general, the following Examples describe some additional aspects of the present disclosure. While aspects of the present disclosure are described in connection with the following examples and the corresponding text and figures, there is no intent to limit aspects of the present disclosure to this description. On the contrary, the intent is to cover all alternatives, modifications, and equivalents included within the spirit and scope of the present disclosure.

Materials

For the examples described below, the following base resins were used.

TABLE 1

Base Resins
Base Resin Description

| Polyolefin Base Resin | Supplier | MFI | Description |
|---|---|---|---|
| PP9054 | ExxonMobil | 12 | Propylene Random Copolymer |
| PP9074Med | ExxonMobil | 24 | Propylene Random Copolymer/ High Clarity |
| PP1024E4 | ExxonMobil | 13 | Propylene Homopolymer |

The following polymeric resin modifiers were used in the examples.

TABLE 2

Polymeric Resin Modifiers
Modifier/Blend Description

| Polymeric Resin Modifiers | Supplier | MFI | Loading % | Ethylene Percent |
|---|---|---|---|---|
| VISTAMAXX 6202 | ExxonMobil | 21 | 30 | 15 |
| VISTAMAXX 3000 | ExxonMobil | 9.1 | 50 | 11 |
| VISTAMAXX 6502 | ExxonMobil | 43 | 40 | 13 |

Polyolefin Resin Compositions

The polyolefin resin compositions including the polyolefin polymers (i.e., the base resins) and varying amounts of polymeric resin modifier were prepared and tested to determine the abrasion loss pursuant to the Abrasion Loss Test described herein and using the Neat Material Sampling Procedure; and by a flex test pursuant to the Cold Ross Flex Test using the Plaque Sampling Procedure. The results are presented in Table 3. The percent (%) crystallization was measured for sample resin compositions using according to the Crystallinity Test using the Neat Material Sampling Procedure. The results are reported in Table 4.

TABLE 3

Density, DIN Abrasion Loss, and Cold Ross Flex Summary of Resin Compositions With Varying Amounts of Polymeric Resin Modifier

| Polyolefin Base Resin | Base Resin wt % | Polymeric Resin Modifier | Resin Modifier wt % | Cold Ross Flex Summary | Density | DIN Abrasion Loss (cm$^3$) |
|---|---|---|---|---|---|---|
| PP9054 | 100 | n/a | 0 | Fail | 0.896 | 0.089 |
| PP9054 | 85 | 6202 | 15 | Pass | 0.891 | 0.085 |
| PP9054 | 70 | 6202 | 30 | * | 0.891 | 0.095 |
| PP9054 | 50 | 6202 | 50 | * | 0.883 | 0.158 |
| PP9054 | 85 | 6502 | 15 | * | 0.896 | 0.084 |
| PP9054 | 80 | 6502 | 20 | Pass | * | * |
| PP9054 | 60 | 6502 | 40 | * | * | * |
| PP9054 | 85 | 3000 | 15 | * | 0.897 | 0.078 |
| PP9054 | 75 | 3000 | 25 | Pass | * | * |
| PP9054 | 50 | 3000 | 50 | * | * | * |
| PP9074Med | 100 | n/a | 0 | Fail | 0.902 | 0.089 |

TABLE 3-continued

Density, DIN Abrasion Loss, and Cold Ross Flex Summary of Resin Compositions With Varying Amounts of Polymeric Resin Modifier

| Polyolefin Base Resin | Base Resin wt % | Poly-meric Resin Modifier | Resin Modifier wt % | Cold Ross Flex Summary | Density | DIN Abrasion Loss ($cm^3$) |
|---|---|---|---|---|---|---|
| PP9074Med | 85 | 6202 | 15 | * | 0.894 | 0.101 |
| PP9074Med | 70 | 6202 | 30 | Pass | * | * |
| PP1024E4 | 100 | n/a | 0 | Pass | 0.903 | 0.083 |
| PP1024E4 | 85 | 6202 | 15 | * | 0.899 | 0.162 |
| PP1024E4 | 50 | 3000 | 50 | Pass | * | * |

* not determined

TABLE 4

Percent Crystallization of Representative Resin Compositions

| Base Resin | Base Resin wt % | Blend Resin | Blend Resin wt % | % Crystallization |
|---|---|---|---|---|
| PP9054 | 100 | n/a | 0 | 38% |
| PP9054 | 85 | 6202 | 15 | 34% |
| PP9054 | 70 | 6202 | 30 | 30% |
| PP9054 | 80 | 6502 | 20 | 24% |
| PP9054 | 60 | 6502 | 40 | 24% |
| PP9054 | 75 | 3000 | 25 | 29% |
| PP9054 | 50 | 3000 | 50 | 23% |
| PP9074Med | 100 | n/a | 0 | 45% |
| PP9074Med | 70 | 6202 | 30 | 30% |
| PP1024E4 | 100 | n/a | 0 | 54% |
| PP1024E4 | 50 | 3000 | 50 | 30% |

It should be emphasized that the above-described aspects of the present disclosure are merely possible examples of implementations, and are set forth only for a clear understanding of the principles of the disclosure. Many variations and modifications may be made to the above-described aspects of the disclosure without departing substantially from the spirit and principles of the disclosure. All such modifications and variations are intended to be included herein within the scope of this disclosure.

What is claimed:

1. An article of footwear comprising:

a sole structure comprising a sole component, the sole component having a first side and a second side, wherein the first side is configured to be ground-facing when the component is a component of an article of footwear, and the second side is defined by a sole structure thermoplastic composition; and an upper operably coupled with the second side of the sole component, the upper comprising a synthetic leather material, the synthetic leather material comprising a synthetic leather polymeric coating layer affixed to a synthetic leather textile layer, the synthetic leather coating layer comprising a synthetic leather coating composition, the synthetic leather textile layer comprising a synthetic leather textile composition, and the synthetic leather coating composition or the synthetic leather textile composition define an externally-facing side of the upper;

wherein the synthetic leather coating composition is a synthetic leather coating thermoplastic polyolefin resin composition.

2. The article of footwear of claim 1, wherein the second side of the sole component is thermally bonded to the upper at least in part by the polyolefin resin composition and synthetic leather coating thermoplastic.

3. The article of footwear of claim 1, wherein the synthetic leather textile layer comprises a knit textile, a woven textile, a non-woven textile, a crocheted textile, or a braided textile.

4. The article of footwear of claim 1, wherein the synthetic leather textile layer comprises a first fiber or a first yarn comprising the synthetic leather coating thermoplastic polyolefin resin composition.

5. The article of footwear of claim 4, wherein the synthetic leather textile layer further comprises a second fiber or a second yarn comprising a second fiber/yarn thermoplastic composition, and the second fiber/yarn thermoplastic composition comprises a thermoplastic polymer chosen from a polyester, a polyether, a polyamide, a polyurethane, or any combination thereof.

6. The article of footwear of claim 1, wherein the synthetic leather coating thermoplastic polyolefin resin composition comprises at least one polyolefin chosen from a polyethylene homopolymer, a polyethylene copolymer, a polypropylene homopolymer, a polypropylene copolymer, or a combination thereof.

7. The article of footwear of claim 6, wherein the synthetic leather coating thermoplastic polyolefin resin composition comprises the polypropylene copolymer.

8. The article of footwear of claim 1, wherein a polyolefin component of the synthetic leather coating thermoplastic polyolefin resin composition consisting of all polyolefin polymers present in the synthetic leather coating thermoplastic polyolefin resin composition consists of a polypropylene homopolymer, a polypropylene copolymer, or a combination of both a polypropylene homopolymer and a polypropylene copolymer.

9. The article of footwear of claim 8, wherein the polyolefin component comprises the polypropylene copolymer, and the polypropylene copolymer comprises about 80 percent to about 99 percent polypropylene repeat units by weight based upon a total weight of the polypropylene copolymer.

10. The article of footwear of claim 9, wherein the polypropylene copolymer includes a polypropylene/polyethylene copolymer.

11. The article of footwear of claim 10, wherein the polypropylene copolymer comprises about 1 percent to about 5 percent ethylene repeat units by weight based upon a total weight of the polypropylene copolymer.

12. The article of footwear of claim 1, wherein the synthetic leather coating thermoplastic polyolefin resin composition further comprises a polymeric resin modifier, or a clarifying agent, or both.

13. The article of footwear of claim 12, wherein the synthetic leather coating thermoplastic polyolefin resin composition comprises from about 1 weight percent to about 30 weight percent of the polymeric resin modifier based upon a total weight of the synthetic leather coating thermoplastic polyolefin resin composition.

14. The article of footwear of claim 12, wherein the synthetic leather coating thermoplastic polyolefin resin composition comprises from about 0.1 weight percent to about 5 weight percent of the clarifying agent based upon a total weight of the synthetic leather coating thermoplastic polyolefin resin composition.

15. The article of footwear of claim 1, wherein the synthetic leather textile layer comprises a first fiber or a first yarn comprising a first fiber/yarn thermoplastic composition, and the first fiber/yarn thermoplastic composition comprises a thermoplastic polymer chosen from a polyester, a polyether, a polyamide, a polyurethane, or any combination thereof.

16. The article of footwear of claim 15, wherein the first fiber/yarn thermoplastic composition comprises the thermoplastic polyester.

17. The article of footwear of claim 3, wherein the synthetic leather textile layer comprises the non-woven textile, the non-woven textile comprises a first fiber or a first yarn comprising a first fiber/yarn thermoplastic composition, and the first fiber/yarn thermoplastic composition comprises a thermoplastic polyester.

18. The article of footwear of claim 1, wherein the sole structure thermoplastic composition is a sole structure thermoplastic polyolefin resin composition.

* * * * *